United States Patent [19]

Abe et al.

[11] Patent Number: 5,055,381

[45] **Date of Patent: * Oct. 8, 1991**

[54] METHOD FOR PROCESSING SILVER HALIDE PHOTOSENSITIVE MATERIALS INCLUDING THE REPLENISHING OF WASHING WATER HAVING A CONTROLLED AMOUNT OF CALCIUM AND MAGNESIUM COMPOUNDS

[75] Inventors: Akira Abe; Yoshihiro Fujita; Toshio Koshimizu, all of Minami-Ashigara, Japan

[73] Assignee: Fuji Photo Film Co., Ltd., Minami-Ashigara, Japan

[ * ] Notice: The portion of the term of this patent subsequent to Jun. 13, 2006 has been disclaimed.

[21] Appl. No.: 57,254

[22] Filed: Jun. 3, 1987

[30] Foreign Application Priority Data

Jun. 6, 1986 [JP] Japan ..... 61-131632
Sep. 12, 1986 [JP] Japan ..... 61-215143

[51] Int. Cl.[5] ..... G03C 5/395; G03C 11/00

[52] U.S. Cl. ..... 430/398; 430/372; 430/373; 430/401; 430/421; 430/428; 430/430; 430/463; 430/467; 430/490; 430/491

[58] Field of Search ..... 430/401, 491, 421, 463, 430/393, 430, 467, 490, 372, 420, 398

[56] References Cited

U.S. PATENT DOCUMENTS

| | | | |
|---|---|---|---|
| 3,647,461 | 3/1972 | Suresh et al. | 434/467 |
| 3,647,462 | 3/1972 | Surash et al. | 430/467 |
| 4,336,324 | 6/1982 | Koboshi et al. | 430/372 |
| 4,839,273 | 6/1989 | Yamada et al. | 430/399 |
| 4,855,218 | 8/1989 | Fujita et al. | 430/401 |

FOREIGN PATENT DOCUMENTS

| | | |
|---|---|---|
| 182566 | 5/1986 | European Pat. Off. . . |
| 0248450 | 12/1987 | European Pat. Off. . |
| 3221350 | 9/1985 | Fed. Rep. of Germany . |
| 2042585 | 4/1987 | Fed. Rep. of Germany . |
| 1480893 | 6/1968 | France . |
| 1465873 | 7/1969 | France . |
| 1063669 | 3/1967 | United Kingdom . |

OTHER PUBLICATIONS

"Performance of Porous Cellulose Acetate Membranes for the Reverse . . . ", A. R. Hauck et al., *Environmental Science and Technology,* vol. 3, No. 9, 12/69, 1269–1275.

*Chemical Abstracts,* vol. 105, 1986, p. 375, abstract no. 196954t, Columbus, Ohio.

*Chemical Abstracts,* vol. 85, 1976, p. 420, abstract no. 166266w, Columbus, Ohio.

*Chemical Abstracts,* vol. 90, 1979, p. 105, abstract no. 146322m, Columbus, Ohio.

*Chemical Abstracts,* vol. 89, 1978, p. 307, abstract no. 80253k, Columbus, Ohio.

Goldwasser, SMPTE Journal, "Water Flow Rates in Immersion Washing of Motion-Picture Film", May 1955.

(List continued on next page.)

*Primary Examiner*—Charles L. Bowers, Jr.
*Assistant Examiner*—Lee C. Wright
*Attorney, Agent, or Firm*—Burns, Doane, Swecker & Mathis

[57] ABSTRACT

In a method for processing silver halide photosensitive materials comprising developing an exposed silver halide photosensitive material, fixing the developed material and washing it with a washing water, the amount of calcium and magnesium compounds present in the replenishing washing water is reduced to not more than 5 mg/l on the basis of the weight of elemental calcium or magnesium and washing water is replenished in an amount of 1 to 50 times the volume of liquid carried over by the photosensitive material from a bath preceding the washing bath per unit area thereof or that the replenishing washing water is introduced into a washing bath after reducing the amount of calcium and magnesium compounds to the range mentioned above and sterilizing the same. The method makes it possible to substantially reduce the amount of washing water while reliably suppressing turbidity and proliferation of microorganisms in the washing water during and after completion of processing.

18 Claims, 2 Drawing Sheets

OTHER PUBLICATIONS

C. R. Dupree, "Practical Operation of Ion-Exchange Equipment for Photographic Wash Water Purification", Photographic Exp., vol. 2, No. 3, 1951, pp. 110-115.

H. P. Gregor, Application of Ion Exchange Resins in Photographic Processing Photographic Exp., vol. 2, No. 3, 1951, pp. 102-109.

J. H. Priesthoff, "Improved Technique for Ion-Exchange Recovery of Eastman Color Developers", Journal of the SMPTE, vol. 66, Feb. 1957, pp. 64-65.

Deggan et al., "Control of Microbial Growth in Photographic Materials", Research Disclosure, Mar. 1983, No. 227.

The Quality of Water for Photographic Processing, Lloyd E. West, Photographic Science and Engineering, vol. 3, No. 6, Nov.-Dec. 1959, p. 283.

METHOD FOR PROCESSING SILVER HALIDE PHOTOSENSITIVE MATERIALS INCLUDING THE REPLENISHING OF WASHING WATER HAVING A CONTROLLED AMOUNT OF CALCIUM AND MAGNESIUM COMPOUNDS

BACKGROUND OF THE INVENTION (1) Field of the Invention

The present invention relates to a method for processing silver halide (color) photosensitive materials, in particular to a processing method which makes it possible to suppress turbidity due to the proliferation of bacteria and propagation of mold in a washing bath even when the processing is continuously conducted while substantially saving the amount of washing water and which provides an excellent processed photosensitive material. Moreover, the present invention also relates to an apparatus for effectively conducting such a processing method.

(2) Prior Art

Recently, it has been proposed to reduce the amount of washing water used in water washing and other processes for processing silver halide photosensitive materials, in view of environmental protection, exhaustion of water resources and enhanced economy. For example, one of such techniques for reducing the amount of washing water is proposed by S. R. Goldwasser in his article entitled "Water Flow Rates in Immersion-Washing of Motion Picture Film", Journal of the Society of Motion Picture and Television Engineers, 64, 248–253 (1955) in which saving of the amount of washing water is achieved by employing a multistage washing system including the use of a plurality of washing tanks and countercurrently passing water therethrough. Likewise, U.S. Pat. No. 4,336,324 discloses another method comprising directly transferring bleached and fixed photosensitive materials to stabilization process without substantially passing them through washing process to save the amount of washing water. These methods have been adopted in different kinds of automatic processor as an effective means for water-saving.

However, if the water-saving is effected without implementing any other means, the retention time of water in a washing bath is substantially increased, which results in the proliferation of bacteria and in turn causes the formation of suspended matters and the increase in turbidity of washing water. Moreover, various molds are liable to proliferate.

The proliferation of bacteria and molds lower the quality of processed (color) photosensitive materials (hereunder simply referred to as "photosensitive material(s)", because the bacteria and molds deposit on the photosensitive materials. In addition, there remains an inevitable problem that mold and/or bacteria severely proliferate on the materials processed under such conditions during storage. Besides these problems, the proliferation of such microorganisms causes problems such that a circulating pumps and filters provided such baths as the washing and stabilizing baths become clogged within a very short time and that the water becomes rotten and give out a bad smell.

In order to solve such problems, many attempts have been made, for example, Japanese Patent Un-examined Publication No. 57-8542 proposes a method which comprises adding an antibacterial or antifungus agent such as isothiazolone type agents, benzoisothiazolone type agents to the washing bath and/or stabilizing bath.

The addition of such an antibacterial or antifungus agent is effective to solve the foregoing problems. However, the presence thereof in these baths may impair the safety of the working environment since they are heated in the drying process subsequent to the washing process and evaporate into the ambient atmosphere. Therefore, an extra investment is required for installing an exhaust system or the like. Furthermore, under the high temperature conditions which are likely to occur during summer which is quite favorable to the proliferation of bacteria and mold, the effectiveness of these antibacterial and/or antifungus agents to suppress the proliferation thereof is incomplete. In particular, if an automatic processor is stopped for a long time, for example, more than 2 days under such a high temperature condition favorable to the proliferation of microorganisms, conveying the liquid surfaces by floating bacteria and/or mold (hereunder referred to as "a bacterial floating matter") is not completely prevented. This bacterial floating matter formed while the automatic processor is stopped tends to adhere to the photosensitive materials if they are brought into contact with the film by, for instance, passing them through the washing bath or by again starting the automatic processor, which results., in additional serious troubles. Therefore, it is usually required to add antibacterial agents even when the automatic processor is out of operation in order to suppress the proliferation of bacteria and/or mold or the formation of bacterial floating matter, or prior to restarting the automatic processor any treatments such as the disposal of the water in the baths are required. Moreover, the use of these antibacterial agents causes side effects such that they make the processed photosensitive materials quite sticky and these materials are liable to adhere to one another or to other materials. Thus, there has not yet been proposed a processing method for silver halide photosensitive material, which can completely eliminate the foregoing problems

SUMMARY OF THE INVENTION

Under such circumstances, the inventors of this invention have conducted studies to eliminate aforementioned drawbacks associated with the conventional processing methods for silver halide photosensitive materials and to develop a new processing method which permits the complete elimination of such disadvantages and the substantial saving of the amount of washing water.

Accordingly, it is a principal object of this invention to provide a method for processing silver halide photosensitive materials which makes it possible to possitively suppress the proliferation of bacteria and mold in washing baths while substantially saving the amount of washing water.

Another object of the present invention is to provide a processing method in which the proliferation of bacteria and mold is suppress without using any antibacterial or antifungus agents.

Another object of this invention is to provide a processing method which permits the suppression of proliferation of microorganisms on the processed photosensitive materials even if the amount of washing water is remarkably reduced.

Another object of the present invention is to provide a processing method having a maintenance-free water washing step.

Another object of the present invention is to provide an apparatus for processing silver halide photosensitive materials, which permits the effective practice of the foregoing processing methods capable of saving the amount of washing water.

These and other objects of the present invention will be clear from the following description.

The inventors of the present invention found that the foregoing drawbacks of the conventional method for processing silver halide photosensitive materials can effectively be eliminated by restricting the amount of washing water to be replenished to washing bath to a specific range and simultaneously limiting the amount of calcium ions and magnesium ions present in the washing bath to not more than a specific value The present invention has been completed on the basis of these findings.

In accordance with the present invention, there is provided a method for processing silver halide photosensitive materials which comprises color developing an exposed silver halide photosensitive material, treating the color developed photosensitive material in a fixing process and then washing the photosensitive material with washing water, the method comprising that the washing water is replenished in an amount of 1 to 50 times the volume of liquid carried over by the photosensitive material from a bath preceding the water washing bath per unit area thereof and that the amount of calcium and magnesium compounds present in the replenishing washing water are reduced to not more than 5 mg/l respectively on the basis of elemental calcium or magnesium (hereunder referred to as "first method").

According to another aspect of the present invention, there is provided a method comprising the steps of reducing the amount of calcium and magnesium compounds included in replenishing washing water which is to be used in the water washing process to not more than 5 mg/l, respectively, on the basis of elemental calcium or magnesium, sterilizing the replenishing washing water and then introducing the replenishing washing water in a washing bath of water washing process (hereunder referred to as "second method").

According to a further aspect of the present invention, an apparatus for effectively carrying out the foregoing processing methods is also provided and comprises a bath for carrying out (color) development process, a bath containing a fixing liquid and baths for water washing, wherein the apparatus comprises a means for reducing the amount of the content of calcium and magnesium compounds included in washing water which is fed to the final bath for water washing to not more than 5 mg/l on the basis of elemental clacium or magnesium.

BRIEF EXPLANATION OF THE DRAWINGS

The present invention will hereunder be explained in more detail with reference to the accompanying drawings, in which.

DETAILED EXPLANATION OF THE PREFERRED EMBODIMENTS

Figure 1:
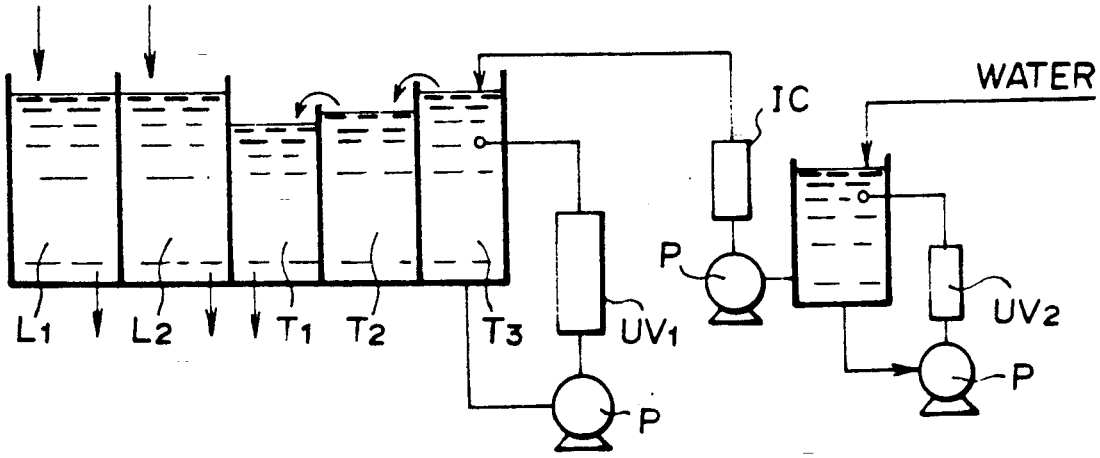
FIGS. 1 and 3 to 6 are schematic diagrams illustrating apparatuses for conducting the methods according to the present invention.

In the present invention, the term "water washing" means a process for washing out the processing liquid adhering to or absorbed by the processed photosensitive materials as well as components of the photosensitive materials which have become useless during the processing and thus is a process for maintaining the performance of the subsequent processing baths and/or assuring a variety of properties of the processed photosensitive materials such as shelf stability of images. Therefore, the washing process herein referred to includes any processes so far as the aforementioned purposes or effects are surely achieved even if liquids having any composition are used therein.

Thus, the methods according to the present invention can be applied to any washing processes in a series of development processing for photosensitive materials, irrespective of the washing process being an intermediate washing, a final washing or the like.

The first method of this invention will be explained in detail In this method, it is desirable that the water washing process comprises at least two washing baths, preferably 2 to 6 baths, more preferably 2 to 4 baths and it is also desirable to counter-currently introduce the replenishing washing water into the baths in an amount of 1 to 50 times, preferably 2 to 50 times, volume of liquid carried over by the processed photosensitive material from a bath preceding the washing bath per unit area thereof and more preferably 3 to 30 times volume thereof. Moreover, in the first method of this invention, the amount of calcium and magnesium compounds included in at least washing water in the final washing bath in the washing process is reduced to 5 mg/l or less expressed as elemental calcium and magnesium respectively. It is particularly preferred to control the concentration of calcium and magnesium in the baths, except for the first washing bath, to not more than 5 mg/l, more preferably not more than 3 mg and most preferably 2 mg/l or less.

The control of the amount of magnesium and calcium compounds in each washing bath may be accomplished by any known method For example, the amount thereof in the washing water (inclusive of replenishing water) can be reduced to not more than the above mentioned value by using an ion exchange technique, a technique employing zeolite and an reverse osmosis technique. These techniques may be used alone or in combination.

In the ion exchange technique, various cation exchange resins may be used herein Preferred examples thereof are those of Na-type capable of exchanging Ca, Mg with Na. In addition, H-type cationic ion exchange resins may also be used. However, in this case, it is preferable to use the resin together with an OH-type anion exchange resin since the pH of the processed water becomes acidic when H-type one is used alone.

In this respect, preferred ion exchange resins are strong acidic cation exchange resins which are mainly composed of styrene-divinylbenzene copolymer and have sulfonic groups as the ion exchange group. Examples of such an ion exchange resin include Diaion SK-1B or Diaion PK-216 (manufactured and sold by MITSUBISHI CHEMICAL INDUSTRIES LTD.) The basic copolymer of these ion exchange resins preferably comprises 4 to 16% by weight of divinylbenzene on the basis of the total charge weight of monomers at the time of preparation. Moreover, preferred examples of anion exchange resins which may be used in combination with H-type cation exchange resins are strong basic anion exchange resins which mainly comprise styrene-divinylbenzene copolymer and have tertiary or quaternary ammonium groups as the ion exchange group. Concrete examples thereof include Diaion SA-10A or Diaion PA-418 (also, manufactured and sold by MITSUBISHI CHEMICAL INDUSTRIES LTD.).

Any known methods may be employed when calcium and magnesium ions included in washing water are removed with these ion exchange resins. However, it is preferred to pass washing water to be treated through a column packed with such an ion exchange resin. The flow rate of the water in the column is in general 1 to 100 times of volumes of the resin packed therein per hour, preferably 5 to 50 times thereof.

Moreover, the control of the content of calcium and magnesium compounds may also be effected using, instead of the ion exchange resins, a chelate resin such as those having aminopolycarboxylic acid salt at their terminals, which can capture metal ions through a chelating reaction The membrane for reverse osmosis installed in the apparatus therefor includes, for instance, membrane of cellulose acetate, membrane of ethylcellulose.polyacrylic acid, membrane of polyacrylonitrile, membrane of polyvinylene carbonate and membrane of polyether sulfone.

The pressure for passing liquid through the membrane usually falls within the range of from 5 to 60 $kg/cm^2$. However, it is sufficient to use the pressure of not more than 30 $kg/cm^2$ to achieve the purposes of the present invention and a so-called low-pressure reverse osmotic apparatus drived at a pressure of 10 $kg/cm^2$ or less is also usable in the present invention effectively.

The structure of the membrane for reverse osmosis may be spiral, tubular, hollow fiber, pleated or rod type.

Zeolites which may be used in the present invention are water-insoluble aluminum silicates represented by the following general formula:

$$Na(AlO_2)_x.(SiO_2)_y.Z(H_2O)$$

In the present invention, A-type zeolites having the above general formula in which x is equal to y and X-type zeolites in which x is different from y may be used. In particular, X-type zeolites are preferred because of their high ion exchange capacity with respect to both calcium and magnesium. An example of such a zeolite includes molecular sieve LINDE ZB-300 (manufactured and sold by Union Carbide Corp.). Zeolites having different particle sizes are known However, those having a particle size of more than 30 mesh are preferable when packed in a column to come it into contact with washing water.

Furthermore, in the first method of this invention, it is preferred to irradiate, with ultraviolet rays, washing water included in at least one bath selected from water washing baths and their auxiliary tanks, which permits the suppression of proliferation of mold.

The source of ultraviolet light as used herein may be an ultraviolet lamp such as a low pressure mercury vapour discharge tube which emits light of 253 7 nm in wavelength. In the present invention, preferred are those having a power of bactericidal ray ranging from 0.5 W to 7.5 W.

The ultraviolet lamp may be disposed outside or inside the water to be irradiated.

As already explained above, an antibacterial or antifungus agent is not necessarily used in the first method of the present invention However, they may be used in the first method depending on purposes These antibacterial and antifungus agents which can be used in the first method include, for instance, isothiazolone type antibacterial agents such as 5-chloro-2-methyl-4-isothiazolin-3-one, 2-methyl-4-isothiazolin-3-one; benzoisothiazolone type antibacterial agents such as 1,2-benzoisothiazolin-3-one; triazole derivatives such as benzotriazole; sulfamide type antibacterial agents such as sulfanilamide; organoarsenide type mold control agents such as 10,10'-oxybisphenoxyarsine and those disclosed in "Bokin Bobaizai No Kagaku (Chemistry of antibacterial and mold control agents)", Hiroshi HORIGUCHI, Society of Hygienic Engineerings, entitled "Techniques for Sterilization, Pasteurization and Mold Control".

Each of the water washing baths should be adjusted to pH 5 to 9 in the first method and pH of washing water supplied to these baths is preferably in the range of 4 to 9, more preferably from 6 to 8.

The second method according to the present invention will now be explained in detail. This second method comprises the steps of reducing the amount of calcium and magnesium compounds included in replenishing washing water used in the water washing process to not more than 5 mg/l, respectively, on the basis of elemental calcium and magnesium, preferably to 3 mg/l or less and more preferably 2 mg/l and simultaneously sterilizing the replenishing washing water and then introducing it into a washing bath of water washing process. The control of the amount of calcium and magnesium compounds present in washing water can be achieved in the similar manner to that explained in connection with the first method.

In the second method, the term "sterilizing process" means that microorganisms such as bacteria and mold present in water to be used as washing water and/or washing water to which desired components are added are killed, removed or decreased in number prior to circulating them through the water washing baths.

The sterilization may be achieved by, for instance, adding a compound having antibacterial action to the replenishing water used as washing water or washing water containing necessary components, filtering them through a filter of not more than 0.8 $\mu$ in pore size, heating them or irradiating them with ultraviolet rays. However, from the view point of reliability in sterilizing effect and magnitude of synergistic effect with the reduction of the content of calcium and magnesium compounds, the addition of compounds having sterilizing effect and filtration with a filter having a pore size of 0.8 $\mu$ or less are preferred.

Particularly preferred examples of the compounds having sterilizing effect include compounds which release active halogen atoms such as hypochlorous acid, dichloroisocyanuric acid, trichloroisocyanuric acid, and salts thereof. In addition to those listed in connection with the first method, examples thereof further include compounds which release silver ions such as silver nitrate, silver chloride, silver oxide or the like.

Among them, compounds which release active halogen atoms or silver ions are preferred since they provide a high synergistic effect with the reduction of the amount of calcium and magnesium compounds. Concrete examples thereof are as follows:

COMPOUNDS RELEASING ACTIVE HALOGEN ATOMS 1. sodium hypochlorite;
2. sodium dichloroisocyanurate;
3. trichloroisocyanuric acid;
4. chloramine T;
5. chloramine B;
6. dichlorodimethylhydantoin;
7. 2-bromo-4'-hydroxyacetophenone;
8. 1,4-bisbromoacetoxy-2-butene;

COMPOUNDS RELEASING SILVER IONS 9. silver nitrate;
10. silver chloride;
11. silver bromide;
12. silver fluoride;
13. silver perchlorate;
14. silver chlorate;
15. silver acetate;
16. silver sulfate;
17. silver carbonate;
18. silver phosphate;
19. silver sulfite;
20. silver silicate;
21. silver bromate;
22. silver nitrite
23. silver iodate
24. silver lactate Among these, preferred are sodium hypochlorite, sodium dichloroisocyanurate, trichloroisocyanuric acid. Sodium hypochlorite is added to the washing water in the form of 5 to 15 % alkaline aqueous solution. Sodium dichloroisocyanurate and trichloroisocyanuric acid are commercially available in different form such as powder, granules, tablet or the like and they may be used depending on the intended purposes. Examples of such compounds commercially available include High Light Ace G, High Light 60G, High Light Clean or the like which are manufactured and sold by Nissan Chemical Industries, Ltd.

In view of the sterilization effect, these compounds having sterilizing action are used in an amount as much as possible, however, there are preferably used in an amount as low as possible since by the use of a large excess of such compound, the properties of the treated photosensitive materials are largely impaired. Therefore, the compounds releasing active halogen atoms are preferably used in an amount of 0.1 to 100 mg per one liter of washing water on the basis of pure compounds, more preferably from 1 to 50 mg/l and most preferably from 3 to 30 mg/l. While in the case of the compounds releasing silver ions, the amount of the compounds is adjusted so that the concentration of silver ions in the washing water to be treated falls within the range of 0.005 to 10 mg per one liter of washing water and more preferably 0.02 to 1 mg/l. In these respects, it is noted that these compounds should be added to the replenishing washing water prior to replenishing the same to a washing bath. This is because, if the compounds is added to the replenishing water after the introduction thereof into the bath i.e., it is added to the water contained in the washing bath, these compounds are possibly deactivated by the action of components carried over from a bath preceding thereto and thus present in the washing bath, for example, reducing agents such as thiosulfates, sulfites; oxidizing agents such as ethylenediaminetetraacetate-iron (III) complex as well as the components dissolved from the photosensitive materials, for instance, silver salts, gelatin or the like in the case of the compounds releasing active halogen atoms, while in the case of the compounds releasing silver ions, the silver ions are converted to silver thiosulfate and as a result they lose sterilizing effect. Thus, the addition thereof to the replenishing water prior to introducing it to washing bath is critical condition in the second method.

The addition of these compounds having sterilizing effect may be carried out by, for example, directly adding to the replenishing washing water stored in an auxiliary tank, in the form of powder, tablet, granules or the like or adding it to the replenishing water after dissolving it in an additional water. Moreover, they may gradually be dissolved by bringing them in a solid form packed in a proper container into contact with the replenishing washing water. Sodium hypochlorite and Silver nitrate are commercially available in the form of solution and, therefore, in such case they may be added to the replenishing water as they are or after diluting it with a suitable amount of water.

According to the second method, the sterilization of the replenishing washing water is also effected by filtering the same through a filter of 0.8 $\mu$m or less in pore size. The filter used herein should have a pore size of not more than 0.8 $\mu$ in order to assure the elimination of microorganisms such as bacteria and mold possibly present in the replenishing water, preferably not more than 0.5 $\mu$ and most preferably 0.3 $\mu$ or less. Materials of such filters include, for instance, cellulose acetate, ethyl cellulose, polyacrylic acid, polyacrylonitrile and polyvinylene carbonate and from the viewpoint of durability cellulose acetate such as triacetyl cellulose is preferred among others Examples of such filters are those manufactured and sold under the trade name of Fuji Microfilter FCE-80W, FCE-45W, FCE-22W cartridges by Fuji Photo Film Co., Ltd Microorganisms such as bacteria and mold can effectively be filtered off by passing the replenishing water through one of these filters.

In the second method, microorganisms such as bacteria and mold must not completely be removed from the replenishing water by the sterilizing treatment. The effect of the present invention can be expected if the number of living bacteria present in the treated replenishing washing water is not more than $10^3$ and preferably $10^2$ or less. This is one of important results of the synergistic effect with the control of the content of calcium and magnesium compounds in the replenishing washing water.

In other words, the inventors have found that if the content thereof is reduced to at most 5 mg/l, the proliferation of bacteria and mold in the water washing bath is extremely suppressed and as a result different troubles accompanied by the formation of bacterial floating matter can effectively be eliminated even when an automatic processor is stopped over a long period of time as referred to before. Moreover, even if the replenishing washing water is stored in a replenishing tank over a long term, the putrefaction of the replenishing water never takes place during storage thereof.

In the second method of this invention, the processing for reducing the content of calcium and magnesium compounds and for sterilization of the replenishing liquid may be carried out in any order, however, it is preferred to carry out the reduction of calcium and magnesium content and then the sterilization treatment, for the purpose of preventing the replenishing water from any contamination possibly caused after the sterilization processing.

The second method of the present invention may widely be applied to water washing processes for silver halide photosensitive materials, in particular to water washing processes in which the amount of replenishing water is largely reduced for the purpose of saving water. For example, it is preferred to apply the method to water washing processes to which the processed photosensitive materials convey a volume of the lqiuid from the bath preceding to the water washing bath and the replenishing water is added in an amount 1 to 50 times of volume of that carried over by the photosensitive material (per unit area thereof) from the preceding bath. The second method is most preferably applied when the washing bath is disposed subsequent to a bath having fixing ability and the amount of the replenishing water is 1 to 50 times of that carried over from the bath of fixing ability. In this case, the replenishing water is preferably supplied in an amount of 2 to 50 times, more preferably 3 to 30 times thereof and most preferably 5 to 20 times thereof.

In the water washing process of the second method, the pH of the washing water is not critical, however, it is usually adjusted to 3 to 10 and preferably 4 to 9.

To the washing water as used in the aforementioned methods of the present invention, there may be added different kinds of compounds according to need, although it is preferred not to use additives other than antibacterial or antifungus agents (in the case of the second method). However, it is also favorable to use chelating agents such as ethylenediaminetetraacetic acid which serve to suppress the putrefaction of waters such as hard and soft water in water washing baths; metal ions such as copper ions which enhance the mold control action or the like.

The term "stabilizing solution" as used herein means solutions capable of achieving an effect of image stabilization which cannot be attained by simply washing photosensitive materials with water as explained above and an example thereof is a stabilizing solution containing formaline as an image stabilizing agent.

In most of cases, such stabilizing solution is in general used in the final processing stage. In such cases, for the purpose of preventing the formation of drying marks, various kinds of surfactants such as nonionic surfactants are added to the stabilizing solution as an agent for water drainage. Moreover, it is also possible to use a chelating agent such as those listed below and salts thereof, for instance, sodium, potassium and ammonium salts to prohibit the decomposition of formaline by microorganisms present therein.

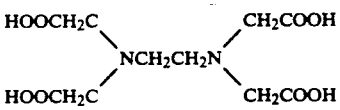
A-1

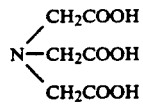
A-2

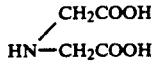
A-3

-continued

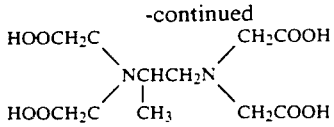
A-4

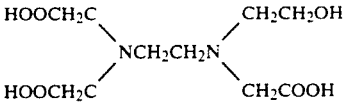
A-5

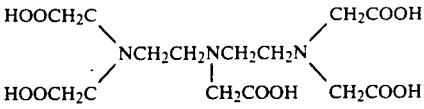
A-6

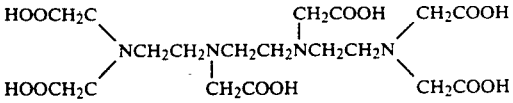
A-7

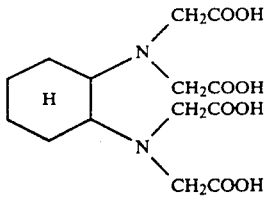
A-8

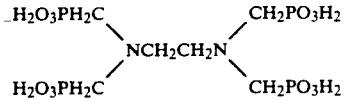
A-9

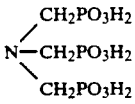
A-10

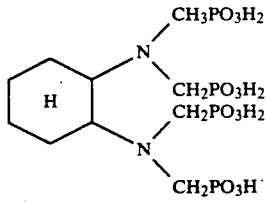
A-11

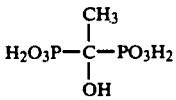
A-12

These amionocarboxylic acids, aminophosphonic acids, phosphonic acids, phosphonocarboxylic acids and salts thereof are in general used in an amount of $5\times10^{-5}$ to $1\times10^{-2}$ moles/l and preferably $1\times10^{-4}$ to $5\times10^{-3}$ moles/l.

According to a preferred embodiment of the present invention, the following isothiazoline type compounds may be added to the stabilizing solution as the sterilizing agent.

(1) 2-methyl-4-isothiazolin-3-one;
(2) 5-chloro-2-methyl-4-isothiazolin-3-one;
(3) 2-methyl-5-phenyl-4-isothiazolin-3-one;
(4) 4-bromo-5-chloro-2-methyl-4-isothiazolin-3-one;
(5) 2-hydroxymethyl-4-isothiazolin-3-one;
(6) 2-(2-ethoxyethyl)-4-isothiazolin-3-one;
(7) 2-(N-methylcarbamoyl)-4-isothiazolin-3-one;
(8) 5-bromomethyl-3-(N-dichlorophonylcarbamoyl)-4-isothiazolin-3-one;

(9) 5-chloro-2-(2-phenylethyl)-4-isothiazolin-3-one;
(10) 4-methyl-2-(3,4-dichlorophenyl)-4-isothiazolin-3-one.

The compounds listed above is employed in an amount of 1 to 100 mg/l and preferably 3 to 30 mg/l in the stabilizing solution.

In addition to the aforementioned compounds, the stabilizing solution may include other different compounds, for instance, a variety of buffering agents for adjusting pH thereof, such as borate, metaborate, borax, phosphates, carbonates, potassium hydroxide, sodium hydroxide, aqueous ammonia, monocarboxylic acids, dicarboxylic acids, and polycarboxylic acids which are used in a proper combination.

Furthermore, there may be added a various kind of ammonium salts as an agent for adjusting pH of emulsion layer of the photographic material after processing, which include, for instance, ammonium chloride, ammonium nitrate, ammonium sulfate, ammonium phosphate, ammonium sulfite and ammonium thiosulfate.

The methods according to the present invention as explained above may effectively be carried out using an apparatus for processing silver halide photosensitive materials, which is also an aspect of this invention. A preferred embodiment of such an apparatus is shown in FIG. 1.

Figure 2:
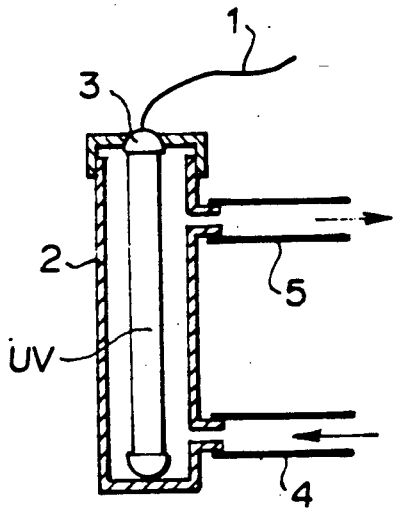
FIG. 2 is a schematic diagram illustrating an apparatus for irradiating washing water with ultraviolet rays used in the apparatus of the present invention
Figure 3:
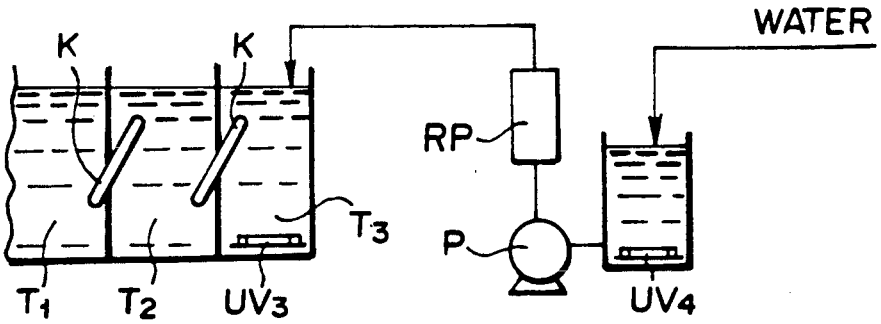
Figure 4:
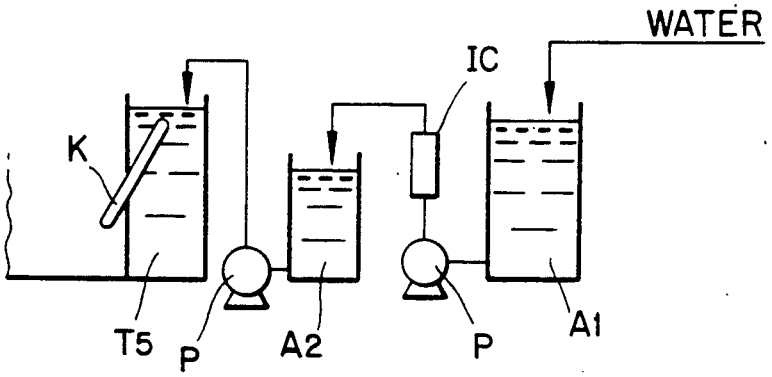
Figure 5:
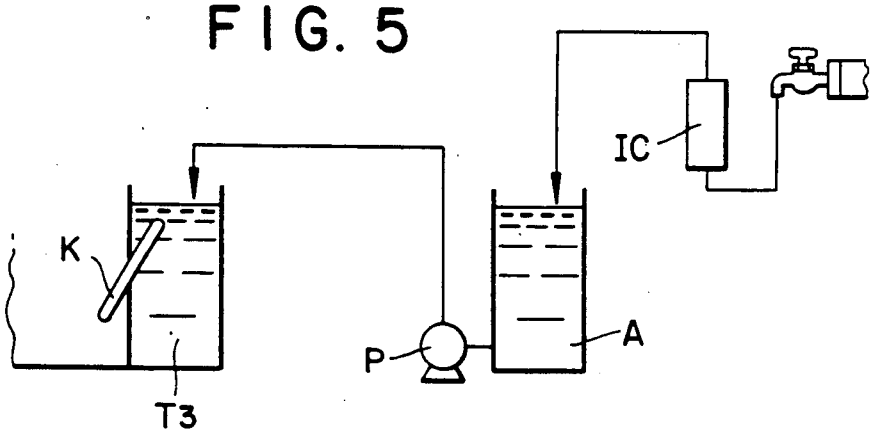

As seen from FIG. 1, the apparatus of the present invention mainly comprises a bath $L_1$ for color developemnt, a bath $L_2$ for bleaching and fixing, a first water washing bath $T_1$, a second water washing bath $T_2$, a third water washing bath $T_3$, devices $UV_1$ and $UV_2$ for emitting ultraviolet rays, a column packed with an ion exchange resin IC, an auxiliary tank A and a pump P. Moreover, it is preferred to use a device which comprises an ultraviolet lamp UV connected to a power supply code 1, a tube 2 for containing the ultraviolet lamp UV and a water resistant cover 3 of rubber as shown in FIG. 2. When the device for irradiating the washing water with ultraviolet light is used, the washing water is introduced into the container tube 2 through an inlet 4 and then delivered from an outlet 5 after being irradiated with ultraviolet rays therein. In addition, the ion exchange resin IC is preferably in the form capable of being automatically replaced with new one.

Apparatuses shown in FIGS. 3 to 6 may also be used in the processing methods of the present invention and the same effect as set forth above can be expected. In these FIGS. 3 to 6, the reference letters RP and K represent an apparatus for reverse osmosis and a cascade exhaust pipe respectively and other members are the same as those shown in FIG. 1.

The processing time of the water washing process in the methods according to the present invention is in general in the range of 20 seconds to 3 minutes, preferably 30 seconds to 2 minutes and the processing is carried out at a temperature of 20° to 40° C. and preferably 30° to 38° C.

The processing methods according to the present invention can be applied to a variety of processes for processing silver halide photosensitive materials. The processing methods of the invention with hereunder be explained in more detail mainly in connection with the processing method for silver halide color photosensitive material, however, it is a matter of course that the methods can be applied to processing silver halide photosensitive material other than color photosensitive materials.

The processes for silver halide color photosensitive materials to which the methods of this invention can be applied are, for example, as follows:

A. color development—bleaching and fixing—water washing—drying;
B. color development—water washing—bleaching and fixing—water washing—drying;
C. color development—bleaching—fixing—water washing—drying;
D. color development—bleaching—bleaching and fixing—water washing—drying;
E. color development—bleaching—bleaching and fixing—water washing—drying;
F. color development—fixing—bleaching and fixing—water washing—drying;
G. color development—bleaching—water washing—fixing—water washing—stabilization—drying;
H. color development—bleaching—fixing—water washing—stabilization—drying;
I. color development—bleaching—bleaching and fixing—water washing—stabilization—drying;
J. color development—bleaching and fixing—water washing—stabilization—drying;
K. color development—fixing—bleaching and fixing—water washing—stabilization—drying.

Each of the processing baths will now be explained below.

COLOR DEVELOPING SOLUTION

A color developing solution used for the development of the photosensitive materials of the present invention is preferably an aqueous alkaline solution containing an aromatic primary amine type color developing agent as a main component. Although, aminophenolic compounds are useful as the color developing agent, p-phenylenediamine type compounds are preferred.

As examples of the latter, there can be included 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline or sulfate, hydrochloride, phosphate, p-toluenesulfonate, tetraphenylborate and p-(t-octyl)benzensulfonate thereof. These diamines are generally more stable in a salt state than in a free state and, therefore, the salts are preferably used.

Examples of the aminophenol type derivatives are o-aminophenol, p-aminophenol, 4-amino-2-methylphenol, 2-amino-3-methylphenol, 2-oxy-3-amino-1, 4-dimethylbenzene.

In addition, those described in L. F. A. Mason "Photographic Processing Chemistry", Focal Press (1966), pp 26 to 229, U.S. Pat. Nos. 2,193,015 and 2,592,364 and Japanese Patent Un-examined Publication No. 48-64933 may be used.

These color developing agents may be used in combination if necessary.

A color developing solution generally contains a pH buffering agent such as carbonate, borate and phosphate of alkali metals; a development restrainer or antifoggant such as bromide, iodide, benzimidazols, benzthiazols and mercapto compounds; a preservative such as hydroxylamine, diethyl hydroxylamine, triethanolamine, compounds described in DEOS No. 2622950, sulfite and hydrogen sulfite; an organic solvent such as ethylene glycol; a development accelerator such as benzylalcohol, polyethylene glycol, quaternary ammonium salts, amines, thiocyanate and 3,6-thiaoctane-1,8-diol; a dye-forming coupler; a competing coupler; a nucleus forming agent such as sodium borohydride; an auxiliary developing agent such as 1-phenyl-3-pyrazolidone; a thickener; a chelating agent such as ethylenediaminetetraacetic acid, nitrirotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, aminopolycarboxylic acids as described in Japanese Patent Unexamined Publication No. 58-195845, 1-hydroxyethylidene-1,1'-diphosphonic acid, organic phosphonic acids as described in Research Disclosure 18170 (May, 1979), amino phosphonic acids such as aminotris (methylenephosphonic acid) and ethylenediamine-N,N,N',N'-tetramethylenephosphonic acid, and phosphonocarboxylic acids as described in Japanese Patent Unexamined Publications Nos. 52-102726, 53-42730, 54-121127, 55-4024, 55-4025, 55-126241, 55-65955 and 55-65956, and Research Disclosure 18170 (May, 1979).

The color developing agent is generally used in an amount of about 0.1 to about 30 g, preferably about 1 to about 15 g per liter of a color developing solution. The pH of the color developing solution is generally 7 or higher and most generally about 9 to about 13. Further, it is possible to use an auxiliary solution, in which the concentrations of halides, a color developing agent and the like are adjusted, so as to decrease the amount of a replenisher for the color developing bath.

In the methods of this invention, it is preferred that the color developing solution is substantially free from benzyl alcohol listed above as an example of development accelerator In this respect, the term "substantially free from" means that benzyl alcohol is present in the color developing solution in an amount of 2 ml or less per liter of the latter, preferably 0.5 ml or less and most preferably zero. If benzyl alcohol is not included in the color developing solution, a more excellent effect is attained.

The processing temperature in the color developing solution preferably ranges from 20° to 50° C. and more preferably from 30° to 40° C. The processing time is preferably in the range of from 20 seconds to 10 minutes and more preferably from 30 seconds to 5 minutes.

BLEACHING, BLEACHING-FIXING AND FIXING LIQUIDS

The photographic emulsion layers after the color development are usually subjected to a bleaching process. The bleaching may be carried out at the same time with a fixing treatment, as called bleaching-fixing, or may be carried out separately In the bleaching-fixing process, a counterflow supplement method may be used wherein two or more baths are present and the bleaching-fixing solution is fed to the later bath and a overflow liquid of the later bath is introduced in the former bath.

An example of bleaching agent used in the bleaching liquid or the bleaching-fixing liquid in the present invention is a ferric ion complex which is a complex of ferric ion with a chelating agent such as aminopolycarboxylic acid, aminopolyphosphonic acid or salts thereof. The aminopolycarboxylic acid salts or aminopolyphosphonic acid salts are an alkali metal salt, ammonium salt or water-soluble amine salt of aminopolycarboxylic acid or aminopolyphosphonic acid. The alkali metal is, for instance, sodium, potassium and lithium and examles of the water-soluble amines are alkyl amines such as methylamine, diethylamine, triethylamine and butylamine; alicyclic amines such as cyclohexylamine; arylamines such as aniline, m-toluidine; heterocyclic amines such as pyridine, morpholine and piperidine.

Typical examples of the chelating agents such as aminopolycarboxylic acid, aminopolyphosphonic acid and salts thereof are as follows, however, it should be appreciated that the invention is not limited to the following specific examples:

Ethylenediaminetetraacetic acid;
Disodium ethylenediaminetetraacetate;
Diammonium ethylenediaminetetraacetate;
Tetra(trimethylammonium) ethylenediaminetetraacetate;
Tetrapotassium ethylenediaminetetraacetate;
Tetrasodium ethylenediaminetetraacetate;
Trisodium ethylenediaminetetraacetate;
Diethylenetriaminepentaacetic acid;
Pentasodium diethylenetriaminepentaacetate;
Ethylenediamine-N-(β-oxyethyl)-N,N',N'-triacetic acid;
Trisodium ethylenediamine-N-(β-oxyethyl)-N,N',N'-triacetate;
Triammonium ethylenediamine-N-(β-oxyethyl)-N,N',N'-triacetate;
1,2-Diaminopropanetetraacetic acid;
Disodium 1,2-diaminopropanetetraacetate;
1,3-Diaminopropanetetraacetic acid;
Diammonium 1,3-diaminopropanetetraacetate;
Nitrilotriacetic acid;
Trisodium nitrilotriacetate;
Cyclohexanediaminetetraacetic acid;
Disodium cyclohexanediaminetetraacetic acid;
Iminodiacetic acid;
Dihydroxyethylglycine;
Ethyl ether diaminetetraacetic acid;
Glycol ether diaminetetraacetic acid;
Ethylenediaminetetrapropionic acid;
Phenylenediaminetetraacetic acid;
1,3-diaminepropanol-N,N,N'-N'-tetramethylenephosphonic acid;
Ethylenediamine-N,N,N',N'-tetramethylenephosphonic acid;
1,3-propylenediamine-N,N,N',N'-tetramethylenephosphonic acid.

The ferric ion complex salt may be used in a form of one or more complex salt previously prepared or may be formed in a solution using a ferric salt, such as ferric sulfate, ferric chloride, ferric nitrate, ferric ammonium sulfate and ferric phosphate, and a chelating agent such as aminopolycarboxylic acid, aminopolyphosphonic acid and phosphonocarboxylic acid. When the complex salt is formed in a solution, one or more ferric salts may be used, and one or more chelating agents may also be used. In eitehr case of the previously prepared complex salt or the in situ formed one, the chelating agent may be used in an excess amount greater than that required to form the desired ferric ion salt. Among iron complexes, preferred is a complex of ferric ion with aminopolycarboxylic acid and the amount thereof used is in the range of 0.1 to 1 mole/l, preferably 0.2 to 0.4 moles/l in the case of bleaching liquid for photographic color photosensitive materials such as color negative films. On the other hand, the compound is used in an amount of 0.05 to 0.5 moles/l, preferably 0.1 to 0.3 moles/l in the bleaching-fixing liquid therefor. Moreover, it is used in an amount of 0.03 to 0.3 moles/l, preferably 0.05 to 0.2 moles/l in the case of the bleaching and bleaching-fixing liquid for color photosensitive materials for print such as color paper.

To the bleaching liquid and the bleaching-fixing liquid, there may be added a bleaching accelerator according to need. Examples of useful bleaching accelerators are compounds having a mercapto group or a disulfide group such as those disclosed in U.S. Pat. No. 3,893,858; German Patent Nos. 1,290,812 and 2,059,988; Japanese Patent Un-examined Publication Nos. 53-32736, 53-57831, 53-37418, 53-65732, 53-72623, 53-95630, 53-95631, 53-104232, 53-124424, 53-141623 and 53-28426; and Research Disclosure No. 17129 (July, 1978); thiazoline derivatives such as these disclosed in Japanese Patent Un-examined Publication No. 50-140129; thiourea derivatives such as those disclosed in Japanese Patent Publication No. 45-8506; Japanese Patent Un-examined Publication Nos. 52-20832 and 53-32735; and U.S. Pat. No. 3,706,561; iodides such as those disclosed in German Patent No. 1,127,715 and Japanese Patent Un-examined Publication No. 58-16235; polyethylene oxides such as those disclosed in German Patent Nos. 966,410 and 2,748,430; polyamine compounds such as those disclosed in Japanese Patent Publication No. 45-8836; as well as compounds disclosed in Japanese Patent Unexamined Publicaiton Nos. 49-42434, 49-59644, 53-94927, 54-35727, 55-26506 and 58-163940; and iodine and bromine ions. From the viewpoint of a high acceleration effect, preferred are compounds having a mercapto or a disulfide group among others and in particular, those disclosed in U.S. Pat. No. 3,893,858, German Patent No. 1,290,812 and Japanese Patent Unexamined Publication No. 53-95630 are preferred.

In the bleaching or bleaching-fixing solution as used in the present invention, bromides such as potassium bromide, sodium bromide and ammonium bromide, chlorides such as potassium chloride, sodium chloride and ammonium chloride, or iodides such as ammonium iodide may be contained as a rehaloganating agent. If necessary, one or more inorganic or organic acids and alkali or ammonium salts thereof having a pH buffering ability, such as, boric acid, borax, sodium metaborate, acetic acid, sodium acetate, sodium carbonate, potassium carbonate, phosphorous acid, phosphoric acid, sodium phosphate, citric acid, sodium citrate and tartaric acid, anti-corrosives such as ammonium nitrate and guanidine may be added.

The fixing agent used in the fixing or bleaching-fixing liquid may be any conventional one, for instance, thiosulfates such as sodium thiosulfate and ammonium thiosulfate; thiocyanates such as sodium thiocyanate and ammonium thiocyanate; thioethers or thioureas such as ethylenebisthioglycollic acid, 3,6-dithia-1,8-octanediol, which are water-soluble, silver halide-solubilizing agents. These agents may be used alone or in combination. Further, the special bleaching-fixing solution consisting of a combination of a fixing agent and a large amount of halide such as potassium iodide described in Japanese Patent Unexamined Publication No. 51-155354 may be used in the bleaching-fixing process. In the present invention, preferred are thiosulfates, in particular, ammonium thiosulfate.

The concentration of the fixing agent in the fixing or bleaching-fixing treatment is preferably 0.3 to 2 moles/l. In particular, in the case of processing photographic color photosensitive materials, the amount thereof is in the range of 0.8 to 1.5 moles/l and in the case of color photosensitive materials for print, it ranges from 0.5 to 1 mole/l.

Generally, the pH value of the fixing or bleaching-fixing solution is preferably 3 to 10, more preferably 5 to 9. This is because, if pH value is less than the lower limit, the desilvering effect is enhanced, however, the liquids are impaired and the cyan dye tends to be converted to leuco dye, while if pH is more than the upper limit, the rate of desilvering is extremely lowered and there is a tendency to easily cause stains.

In order to adjust pH, there may be added to the liquids, for example, hydrochloric acid, sulfuric acid, nitric acid, acetic acid, bicarbonates, ammonia, caustic soda, caustic potash, sodium carbonate and potassium carbonate according to need. Further, various fluorescent brighteners, defoaming agents, surfactants, polyvinylpyrrolidone or organic solvents such as methanol may also be added to the bleaching-fixing liquid.

The bleaching liquid and bleaching-fixing liquid as used herein contain a sulfite ion releasing compound, as the preservative, such as sulfites, for instance, sodium sulfite, potassium sulfite and ammonium sulfite; bisulfites, for instance, ammonium bisulfite, sodium bisulfite and potassium bisulfite; and metabisulfites, for instance, potassium metabisulfite, sodium metabisulfite and ammonium metabisulfite. These compounds are preferably present in an amount of about 0.02 to 0.5 moles/l expressed as sulfite ions and more preferably 0.04 to 0.40 moles/l.

Furthermore, other preservatives such as ascorbic acid, carbonyl bisulfite adduct or carbonyl compounds may be used although the bisulfites are generally used as the preservative.

In addition to the foregoing compounds, it is also possible to add buffering agents, fluorescent brighteners, chelating agents and mold controlling agents according to need.

The photosensitive materials to which the foregoing processing is applied are, for instance, monochromatic paper, monochromataic negataive films, color paper or color negative films.

First of all, in the emulsion layer of the color paper, silver chlorobromide having a silver bromide content of 10 mole % or more is preferably used. Moreover, the silver bromide content is preferably 20 mole % or more in order to obtain an emulsion having a sufficient sensitivity without causing undesired increase in fogging and in particular when rapidity is required in color development processing the content of silver halide may be reduced to at most 10 mole % or at most 5 mole %. Particularly, the use of an emulsion having a silver bromide content of 1 mole % or less which is almost pure silver chloride is preferred since it makes the color developing process more rapid.

The photographic emulsion layer of the color negative films as used herein may contain any of the following silver halides: silver bromide, silver iodobromide, silver iodochlorobromide, silver chlorobromide and silver chloride. Preferred are silver iodobromide and silver iodochlorobromide having a silver iodide content of not more than 30 mole %. The most preferred are silver iodobromides having a silver iodide content of 2 to 25 mole %.

The silver halide grains in the photographic emulsions may be so-called regular grains having a regular crystal form such as cubic, octahedron or tetradecahedron. Alternatively, the grains may be of an irregular crystal structure such as spherical, or ones having crystal defects such as a twinning plane, or composite form thereof.

Regarding a grain size of silver halide, the grains may be fine grains having a size of 0.1 μ or less, or may be large size grains having a diameter of the projected area of up to 10 μ. The photogrpahic emulsion may be a monodisperse one containing silver halide grains having a narrow grain size distribution or a polydisperse one containing grains of a broad size distribution.

Photographic emulsions to be used in the present invention may be prepared according to, for instance, the methods described in P. Glafkides, Chimie et Physique Photographique, Paul Montel, 1967; G. F. Duffin, Photographic Emulsion Chemistry, Focal Press, 1966; and V. L. Zelikman et al, Making and Coating Photographic Emulsion, Focal Press, 1964. That is, any of an acid method, neutral method and ammoniacal method may be used. Further, a single-jet, simultaneous jet method or a combination thereof may be used for reacting a soluble silver salt with a soluble halogen salt. A method of forming grains in silver ion-excessive condition, i.e., so-called reverse jet method, may be used. As one of the simultaneous jet method, a method where pAg is maintained constant in a liquid phase in which silver halide is formed, i.e., controlled double jet method, may also be used. This method yields silver halide emulsion in which a crystal form is regular and a grain size is approximately uniform.

It is also possible to mix at least two silver halides which have separately been formed.

The aforesaid silver halide emulsion having regular grains is obtained by controlling pAg and pH during the formation of grains. Details are disclosed in, for instance, Photographic Science and Engineering, vol. 6, p 159 to 165 (1962), Journal of Photographic Science, vol. 12, p 242 to 251 (1964), U.S. Pat. No. 3,655,394 and U.K. Patent No. 1,413,748.

A typical monodisperse emulsion contains silver halide whose average grains size is larger than 0.1 μ and of which at least about 95% by weight has a grain size within the average grain size ±40%. An emulsion containing silver halide whose average grain size is about 0.25 to 2 μ and of which at least about 95% by weight or by number has a grain size within the average grain size ±20% may be used in the present invention. Methods for the preparation of such an emulsion are described in U.S. Pat. Nos. 3,574,628 and 3,655,394 and U.K. Patent No. 1,413,748. Further, monodisperse emulsions as described in Japanese Patent Un-examined Publication Nos. 48-8600, 51-39027, 51-83097, 53-137133, 54-48521, 54-99419, 58-37635 and 58-49938 may preferably be used in the present invention.

Use of flat grains in the silver halide photographic emulsion used in the invention may provide enhanced sensitivity including improvement in efficiency of color sensitization by sensitizing dyes, improved relation between sensitivity and graininess, improved sharpness, improvement in progress of development, improved covering power and improved cross-over.

The flat silver halide grain as used herein has a ratio of diameter to thickness of 5 or more, such as more than 8 or between 5 and 8.

The term "diameter of silver halide grain" herein used means a diameter of circle which has the same area as the projected area of grain. In the present invention, the diameter of the flat silver halide grains is 0.3 to 5.0 μ, preferably 0.5 to 3.0 μ.

The thickness thereof is 0.4 μ or less, preferably 0.3 μ or less, more preferably 0.2 μ or less.

Generally, a flat silver halide grain is a disk-like grain having two surfaces parallel to each other. Accordingly, the aforementioned "thickness" is expressed as the distance between the two parallel surfaces constituting a flat silver halide grain.

Flat silver halide grains in which the grain size and/or thickness thereof are made monodisperse may be used as described in Japanese Patent Publicaiton No. 11386.

Monodispersion of flat silver halide grains mentioned above means a dispersion system in which 95% of the grains dispersed therein has a grain size falling within the range of the number average grain size ±60%, preferably, ±40%. "Number average grain size" herein means the number average diameter of the projected area of silver halide grains.

The flat silver halide grains contained in the emulsion used in the invention preferably account for 50% or more of the total projected area, more preferably 70% or more, particularly 90% or more.

Preferred flat silver halide is comprised of silver bromide, silver iodobromide, silver chlorobromide, silver chloroiodobromide, silver chloride or silver iodochloride. Silver iodochloride is particularly preferred in high speed photosensitive materials. In the case of silver iodochloride, the content of silver iodide is usually 40 mol % or less, preferably 20 mol % or less, more preferably 15 mol % or less. In addition, silver chlorobromide and silver bromide are particularly preferred in the case of photosensitive materials for print.

The flat grains may have homogeneous composition or may be composed of two or more phases of different halogen compositions.

For instance, when silver iodobromide is used, flat silver iodobromide grains may have layered structure composed of plural phases having different iodide contents. For example; Japanese Patent Un-examined Publication Nos. 58-113928 and 59-99433 describe preferred examples of halide composition of flat silver halide grains and halide distribution in grains. Basically, relative contents of iodide included in flat silver halide grains in each phases are preferably chosen depending upon development conditions for the photosensitive materials containing these flat silver halide grains, (such as the amount of a solvent for silver halide in a developing solution) and so on.

The flat silver halide grains may be composite type silver halide crystals in which oxide crystal such as PbO and silver halide crystals such as silver chloride are connected and silver halide crystals formed by epitaxial growth (such as crystals in which silver chloride, silver iodobromide or silver iodide is epitaxially grown on silver bromide crystal, or crystals in which silver chloride, silver bromide, silver iodide or silver chloroiodobromide is epitaxially grown on hexagonal, or octahedral silver iodide). Examples of those are described in U.S. Pat. Nos. 4,435,501 and 4,463,087.

Regarding sites of silver halide crystals on which the formation of latent image takes place, grains which give a latent image mainly on the surface of grains or grains which give a latent image mainly in the inner part of the grains may be used. This may be properly selected depending upon, for instance, the use of the photosensitive materials which contain the aforesaid flat silver halide grains and the depth in the grain to which a developing solution to be used for processing the photosensitive materials can penetrate so as to develop a latent image.

A preferred method of using the flat silver halide grains according to the present technique is described in detail in Research Disclosure No. 22534 (January, 1983) and No. 25330 (May, 1985), wherein the method of use the same, for instance, on a basis of relation between the thickness and optical properties of flat silver halide grains is disclosed.

Grains may have homogeneous crystal structure or may have silver halide compositions different between the inner part and the outer part thereof or may have layered structure. Such grains for emulsion are disclosed in U.K. Patent No. 1,027,146, U.S. Pat. Nos. 3,505,068 and 4,444,877, and Japanese Patent Un-examined Publication No. 58-143331. More than 2 types of silver halides which have different compositions may be connected by epitaxial connection. Alternatively, silver halide may be connected with compounds other than silver halide, such as rhodan silver and lead oxide. Such grains for emulsion are disclosed in U.S. Pat. Nos. 4,094,684; 4,142,900; 4,459,353; 4,349,622; 4,395,478; 4,433,501; 4,463,087; 3,656,962; and 3,852,067; U.K. Patent No. 2,038,792; and Japanese Patent Un-examined Publication No. 59-162540.

It is also possible to use a mixture of grains having different crystal forms.

Solvents for silver halide are useful to facilitate ripening. For instance, it is known that an excess amount of halogen ion is placed in a reactor to facilitate ripening. Therefore, it is clear that it is possible to facilitate ripening merely by introducing a halide salt solution into a reactor. Other ripening agents may also be used. Those ripening agents may previously be added to a dispersion medium in a reactor before adding silver and halide salts, or may be introduced into a reactor simultaneously with the addition of one or more halide salts, silver salts and deflocculating agents. Alternatively, the ripening agents may be separately introduced in a step of addition of halide salts and silver salts.

As ripening agents other than halogen ion, there are named ammonia or amino compounds, thiocyanate salts such as alkali metal thiocyanates, particularly sodium or potassium thiocyanate, and ammonium thiocyanate. The use of thiocyanate ripening agents is disclosed in U.S. Pat. Nos. 2,222,264; 2,448,534; and 3,320,069. Thioether ripening agents currently used in this field and described in U.S. Pat. Nos. 3,271,157; 3,574,628 and 3,737,313 may also be used. Alternatively, thione compounds disclosed in Japanese Patent Un-examined Publication Nos. 53-82408 and 53-144319 may be used.

Properties of silver halide grains can be controlled by making various compounds present in a course of silver halide formation and precipitation. Such compounds may be introduced in a reactor in advance or, according to a conventional manner, may be added while adding one or more salts. As described in U.S. Pat. Nos. 2,448,060; 2,628,167; 3,737,313; and 3,772,031; and Research Disclosure, vol. 134 (June, 1975), 13452, properties of silver halide may be controlled by making such compounds present in a step of silver halide formation and precipitation as compounds of copper, iridium, lead, bismuth, cadmium, zinc, chalcogen such as sulfur, selenium and tellurium, gold and precious metals of the group VII. Silver halide emulsions may be sensitized by inner reduction of grains during the formation and precipitation thereof as described in Japanese Patent Publication No. 58-1410 and Moiser et al., Journal of Photographic Science, Vol. 25, 1977, 19-27.

Silver halide emulsions are usually chemically sensitized. The chemical sensitization may be conducted using active gelatin as described in T. H. James, The Theory of the Photogrpahic Process, 4th ed, Macmillan, 1977, p 67-76. Alternatively, the chemical sensitization may be carried out using sulfur, selenium, tellurium, gold, platinum palladium, iridium or a mixture of these sensitizing agents at a pAg of 5 to 10, a pH of 5 to 8 and a temperature of 30° to 80° C. as described in Research Disclosure, vol. 120, 12008 (April, 1974), and ibid, vol. 34, 13452 (June, 1975), U.S. Pat. Nos. 2,642,361; 3,297,446; 3,772,031; 3,857,711; 3,901,714; 4,266,018 and 3,904,415 and U.K. Patent No. 1,315,755. Preferably, the chemical sensitization is carried out in the presence of gold compounds and thiocyanate compounds, or sulfur containing compounds described in U.S. Pat. Nos. 3,857,711; 4,266,018; and 4,054,457, or other sulfur containing compounds such as hypo, thiourea compounds, rhodanine compounds. The chemical sensitization may be conducted in the presence of chemical sensitization aids. Useful chemical sensitization aids are, for instance, compounds which are known to inhibit fogging and enhacne sensitivity in the course of chemical sensitization, such as azaindene, azapyridazine and azapyrimidine. Examples of chemical sensitization modifying aids are described in U.S. Patent Nos. 2,131,038; 3,411,914; and 3,554,757; Japanese Patent Un-examined Publication No. 58-126526; and G. F. Duffin, Photographic Emulsion Chemistry (Focal Press, 1966), p 138-143. In addition to or instead of the chemical sensitization, it is possible to conduct reduction sensitization using, for example, hydrogen as described in U.S. Pat. Nos. 3,891,446 and 3,984,249. Reduction sensitization may be carried out by use of such reducing agents as stannous chloride, thiourea dioxide and polyamine or by low pAg (e.g., below 5) treatment and/or high pH (e.g., above 8) treatment as described in U.S. Pat. Nos. 2,518,698; 2,743,182; and 2,743,183. Further, it is possible to enhance color sensitization by the chemical sensitization described in U.S. Pat. Nos. 3,917,485 and 3,966,476.

Silver halide photographic emulsions used in the invention may spectrally be sensitized by methine dyes or others. Dyes to be used include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes, merocyanine dyes and complex merocyanine dyes. In those dyes, any nuclei usually used in cyanine dyes may be adopted as basically reactive heterocyclic nuclei. Namely, pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus etc.; nuclei composed by fusing an alicyclic hydrocarbon ring with the aforesaid nuclei; and nuclei composed by fusing an aromatic hydrocarbon ring with the aforesaid nuclei, such as indolenine nucleus, benzindolenine nucleus, indole nucleus, benzoxazole nucleus, naphthooxazole nucleus, benzthiazole nucleus, naphthothiazole nucleus, benzselenazole nucleus, benzimidazole nucleus, quinaline nucleus, may be used. Those nuclei may have substituents on their carbon atoms.

For merocyanine dyes or complex merocyanine dyes, 5 or 6 membered heterocyclic nuclei, such as pyrrazolin-5-one nucleus, thiohydantoin nucleus, 2-thiooxazolidin-2,4-dione nucleus, thiazolin-2,4-dione nucleus, rhodanine nucleus, thiobarbituric acid nucleus, may be used as a nucleus having a ketomethylene structure.

Those sensitizing dyes may be used alone or in combination. A combination of sensitizing dyes are often used, particularly, for the purpose of supersensitization.

Substances having no spectral sensitization effect per se or substances absorbing substantially no visual lights and showing supersensitization may be incorporated in the emulsions together with the sensitizing dyes. For instance, aminostilbene compounds substituted with a nitrogen-containing heterocyclic group, such as described in U.S. Pat. Nos. 2,933,390 and 3,635,721, aromatic organic acid-formaldehyde condensate, such as described in U.S. Pat. No. 3,743,510, cadmium salts and azaindene compounds may be incorported. The combinations described in U.S. Pat. Nos. 3,615,613; 3,615,641; 3,617,295; and 3,635,721, are particularly useful.

When the emulsion according to the invention is spectrally sensitized, it may be carried out at any stage of the preparation of the emulsion.

Generally, spectrally sensitizing dyes are added to a chemically sensitized emulsion before coating. Alternatively, for instance, U.S. Pat. No. 4,425,426 discloses a method in which the spectrally sensitizing dyes are added to the emulsion before or in the course of the chemical sensitization. In addition, a method in which the spectrally sensitizing agents are added to the emulsion prior to the complete formation of silver halide grains is disclosed in U.S. Pat. Nos. 2,735,766; 3,628,960; 4,183,756 and 4,225,666.

In particular, U.S. Pat. Nos. 4,183,756 and 4,225,666 disclose that a variety of advantages such as improvement in photographic sensitivity and enhancement in adsorptivity of silver halide grains to spectrally sensitizing dyes are accomplished by adding the spectrally sensitizing dyes to the emulsion after stable nucleus for forming silver halide grains are formed.

Known additives for photographs which may be incorporated in photographic photosensitive materials are used herein are likewise disclosed in Research Disclosure Nos. 17643 and 18716 and the related passages thereof are picked up and summarized in the following Table.

| Additive | RD17643 | RD18716 |
|---|---|---|
| 1. Chemical sensitizing agent | page 23 | page 648, right column |
| 2. Sensitivity enhancing agent | | page 648, right column |
| 3. Spectral sensitizing agent, Supersensitizing agent | pages 23 and 24 | page 648, right column to page 649, right column |
| 4. Antifoggant, Fogging stabilizing agent | pages 24 and 25 | page 649, right column |
| 5. Light absorbing agent, Filter dye, UV absorbing agent | pages 25 and 26 | page 649, right column to page 650, left column |
| 6. Antistain agent | page 25, right column | page 650, left to right column |
| 7. Hardening agent | page 26 | page 651, left column |
| 8. Binder | page 26 | page 651, left column |
| 9. Plasticizer, Lubricant | page 27 | page 650, right column |
| 10. Coating aid, Surface activator | pages 26 and 27 | page 650, right column |
| 11. Antistatic | page 27 | page 650, right column |

For the purpose of increase of sensitivity, strengthening of contrast or acceleration of development, photographic emulsion layers in the photographic materials employed in the invention may contain, for instance, polyalkyleneoxide or derivatives thereof such as ethers, esters and amine; thioether compounds, thiomorphorines, quaternary ammonium salts, urethane derivatives, urea derivatives, imidazole derivatives and 3-pyrazolidones. For instance, those described in U.S. Pat. Nos 2,400,532; 2,423,549; 2,716,062; 3,617,280; 3,772,021; and 3,808,003; and U.K. Patent No. 1,488,991 may be used.

For the purpose of prevention of fogging during preparation, storage or development of the photosensitive materials, or stabilization of the photographic performance, various compounds may be contained in the silver halide photographic emulsion used in the present technique. There are named antifoggants or stabilizers, for instance, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, particularly 1-phenyl-5-mercaptoterazole; mercaptopyrimidines; mercaptotriadines; thioketo compounds such as oxazolinethione; azaindenes such as triazaindenes, tetraazaindenes, particularly 4-hydroxy substituted (1, 3, 3*a*, 7) tetraazaindenes, and pentaazaindenes benzenethiosulfonic acid, benzenesulfinic acid, and benzenesulfonamide.

Various color couplers may be incorporated in the photosensitive materials used in the present invention. "Color coupler" herein means a compound capable of forming a dye through coupling reaction with an oxidized form of an aromatic primary amine developing agent. Typical examples of useful color couplers include naphthol or phenol type compounds, pyrazolone or pyrazoloazole type compounds, and linear or heterocyclic ketomethylene compounds. Cyan, magenta and yellow color couplers which may be used in the present invention are disclosed in the patents cited in Research Disclosure, 17643 (December, 1978) VII-D; and 18717 (November, 1979).

The color couplers incorporated in photosensitive materials are preferably made nondiffusible by imparting thereto ballast groups or polymerizing them. 2-Equivalent couplers which are substituted with coupling elimination groups are more preferable than 4-equivalent couplers in which a hydrogen atom is in a coupling active cite, because the amount of coated silver can be decreased. Furthermore, couplers in which a formed dye has a proper diffusibility, non-color couplers, DIR couplers which release a development inhibitor through coupling reaction or couplers which release a development accelerator may also be used.

A typical yellow coupler capable of being used in the present invention is an acylacetamide coupler of an oil protect type. Examples of such are disclosed in U.S. Pat. Nos. 2,407,210; 2,875,057; and 3,265,506. 2-Equivalent yellow couplers are preferably used in the present invention. Typical examples of such are the yellow couplers of an oxygen atom elimination type described in U.S. Pat. Nos. 3,408,194; 3,447,928; 3,933,501; and 4,022,620, or the yellow couplers of a nitrogen atom elimination type described in Japanese Patent Publication No. 58-10739, U.S. Pat. Nos. 4,401,752 and 4,326,024, Research Disclosure (RD) 18053 (April, 1979), U.K. Patent No. 1,425,020, DEOS Nos. 2,219,917; 2,261,361; 2,329,587; and 2,433,812. α-Pivaloyl acetanilide type couplers are excellent in fastness, particularly light fastness, of formed dye. α-Benzoyl acetanilide type couplers yield high color density.

Magenta couplers usable in the present invention include couplers of an oil protect type of indazolone, cyanoacetyl, or, preferably, pyrazoloazole such as 5-pyrazolone and pyrazolotriazole type ones. Among 5-pyrazolone type couplers, couplers whose 3-position is substituted with an arylamino or acylamino group is preferred from the viewpoint of color phase and color density of the formed dye. Typical examples of such are described in U.S. Pat. Nos. 2,311,082; 2,343,703; 2,600,788; 2,908,573; 3,062,653; 3,152,896; and 3,936,015. A elimination group of the 2-equivalent 5-pyrazolone type couplers is preferably a nitrogen atom eliminating group described in U.S. Pat. No. 4,310,619 and an arylthio group described in U.S. Pat. No. 4,351,897. The 5-pyrazolone type coupler having ballast groups described in European Patent No 73,636 provides high color density.

As examples of pyrazoloazole type couplers, there are named pyrazolobenzimidazoles described in U.S. Pat. No. 3,061,432, preferably pyrazole [5, 1-c] [1, 2, 4] triazoles described in U.S. Pat. No 3,725,067, pyrazolotetrazoles described in Research Disclosure 24220 (June, 1984) and Japanese Patent Un-examined Publication No. 50-33552, and pyrazolopyrazoles described in Research Disclosure 24230 (June, 1984) and Japanese Patent Un-examined Publication No. 60-43659. Imidazo [1, 2-b]pyrazoles described in U.S. Pat. No. 4,500,630 is preferred on account of small yellow minor absorption of formed dye and fastness Pyrazolo [1, 5-b] [1, 2, 4] triazole described in U.S. Pat. No. 4,540,654 is particularly preferred.

As the magenta coupler, it is preferred to use a combination of 2-equivalent magenta couplers of pyrazole elimination type such as those disclosed in U.S. Pat. No. 4,367,282 with arylthio group elimination type 2-equivalent magenta couplers such as those described in U.S. Pat. Nos. 4,366,237 and 4,522,915.

Cyan couplers which may be used in the present invention include naphthol or phenol couplers of an oil protect type. Typical naphthol type couplers are described in U.S. Pat. No. 2,474,293. Typical preferred 2-equivalent naphtholic couplers of oxygen atom elimination type are described in U.S. Pat. Nos. 4,052,212; 4,146,396; 4,228,233; and 4,296,200. Exemplary phenol type couplers are described in U.S. Pat. Nos. 2,369,929; 2,801,171; 2,772,162; and 2,895,826.

Cyan couplers which are resistant to humidity and heat are preferably used in the present invention. Examples of such are phenol type cyan couplers having an alkyl group higher than a methyl group at a metha-position of a phenolic nucleus as described in U.S. Pat. No. 3,772,002; 2,5-diacylaminosubstituted phenol type couplers as described in U.S. Pat. Nos. 2,772,162; 3,758,308; 4,126,396; 4,334,011; and 4,327,173; DEOS No. 3,329,729; and European Patent No. 121,365; and phenol type couplers having a phenylureido group at the 2-position and an acylamino gorup at the 5-position as described in U.S. Pat. Nos. 3,446,622; 4,333,999; 4,451,559; and 4,427,767. Cyan couplers in which 5-position of naphtol is substituted with a sulfonamide or amide group as described in Japanese Patent Un-examined Publication No. 60-237448, Japanese Patent Application Nos. 59-264277 and 59-268135 are excellent in fastness of formed image and may also be preferably used in the present invention.

In order to compensate unnecessary absorption in the short-wave region of dye formed from magenta and cyan couplers, it is preferred to use a colored coupler together in color photosensitive materials used for taking photographs. Examples of such are the yellow colored magenta coupler described in U.S. Pat. No. 4,163,670 and Japanese Patent Publication No. 57-39413, the magenta colored cyan coupler described in U.S. Pat. Nos. 4,004,929 and 4,138,258, and U.K. Patent No. 1,146,368.

Graininess may be improved by using together a coupler which can form a dye being moderately diffusible. As such blur couplers, some magenta couplers are specifically described in U.S. Pat. No. 4,366,237 and U.K. Patent No. 2,125,570 and some yellow, magenta and cyan couplers are specifically described in European Patent No. 96,570 and DEOS No. 3,234,533.

Dye-forming couplers and the aforesaid special couplers may be a dimer or higher polymers. Typical examples of polymerized dye-forming couplers are described in U.S. Pat. Nos. 3,451,820 and 4,080,211. Examples of polymerized magenta couplers are described in U.K. Patent No. 2,102,173, U.S. Pat. No. 4,367,282, Japanese Patent Application Nos. 60-75041 and 60-113596.

In order to meet properties required for photosensitive materials, two or more couplers may be used together in a single photosensitive layer, or the same coupler may be introduced in two or more different photosensitive layers.

The standard amount of the colored couplers to be used is 0.001 to 1 mole and preferred amount there of is 0.01 to 0.5 mole for yellow couplers, 0.003 to 0.3 mole for magenta couplers and 0.002 to 0.3 mole for cyan couplers per mole of photosensitive silver halide.

The photosensitive materials according to the invention may contain a coupler which releases a development inhibitor in the course of development, i.e., a so-called DIR coupler.

Examples of the DIR coupler are those which release a heterocyclic mercapto type development inhibitor as described in U.S. Pat. No. 3,227,554; those which release development inhibitors of benzotriazole derivatives as described in Japanese Patent Publication No. 58-9942; so-called colorless DIR couplers described in Japanese Patent Publication No. 51-16141; those which release a nitrogen-containing heterocyclic development inhibitor with decomposition of methylol after elimination as described in Japanese Patent Un-examined Publication (No. 52-90932; those which release a development inhibitor, accompanied with intramolecular nucleophilic reaction after elimination as described in U.S. Pat. No. 4,248,962 and Japanese Patent Un-examined Publication No. 57-6837; those which release a development inhibitor by causing electron transfer via conjugated system after elimination as described in Japanese Patent Un-examined Publication Nos. 56-14946, 57-154234, 57-188035, 58-98728, 58-209736, 58-209737, 58-209738, 58-209739 and 58-209740; those which release a diffusible development inhibitor whose development inhibiting ability is deactivated in a development bath as disclosed in Japanese Patent Un-examined Publication Nos. 57-151944 and 58-17932; and those which release reactive compounds to form a development inhibitor by reaction in membrane during development or to make a development inhibitor inactive as described in Japanese Patent Publication Nos. 59-182438 and 59-184248.

Among the aforesaid DIR couplers, couplers which are preferably used in combination with the coupler as used in the invention are developing solution deactivation type couplers as described in Japanese Patent Un-examined Publication No. 57-151944, timing type couplers as described in U.S. Pat. No. 4,248,962 and Japanese Patent Un-examined Publication No. 57-154234 and reaction type couplers as described in Japanese Patent Un-examined Publication No. 60-184248. Particularly preferred ones are the developing solution deactivation type DIR couplers described in Japanese Patent Un-examined Publication Nos. 57-151944, 58-217932, 50-218644, 60-225156, and 60-233650, and the reaction type DIR couplers described in Japanese Patent Un-examined Publication No. 60-184248.

The photosensitive materials which can be used in the present invention may contain a compound which releases a nucleus-forming agent or a development accelerator or precursors thereof (hereinafter referred to as a "development accelerator and others") in a form of images during development. Examples of such compounds are described in U.K. Patent Nos. 2,097,140 and 2,131,188 and are couplers which release a "development accelerator and others" by coupling reaction with an oxidized form of an aromatic primary amine development agent, i.e., DAR couplers.

The "development accelerator and others" released from the DAR coupler preferably has an adsorbing group for silver halide. Examples of such DAR couplers are described in Japanese Patent Un-examined Publication Nos. 59-157638 and 59-170840. Particularly preferred are DAR couplers which forms N-acyl substituted hydrazines having a monocyclic or fused cyclic hetro ring as an adsorbing group and eliminated at a sulfur or nitrogen atom from a coupling active site of a photographic coupler. Examples of such couplers are described in Japanese Patent Un-examined Publication No. 60-128446.

Compounds which have a development accelerating moiety in a coupler residue as described in Japanese Patent Unexamined Publication No. 60-37556 and compounds which release a development accelerator by oxidation reduction reaction with a development agent as described in Japanese Patent Unexamined Publication No. 60-107029 may also be incorporated in the photosensitive materials as used in the present invention.

The DAR couplers are preferably introduced into a photosensitive silver halide emulsion of the photosensitive materials used in the present invention. Preferably, at least one photosensitive layer contains substantially nonphotosensitive silver halide grains as described in Japanese Patent Un-examined Publication Nos. 59-172640 and 60-128429.

The photosensitive materials used in the present invention may contain hydroquinone derivatives, aminophenol derivatives, amines, gallic acid derivatives, catechol derivatives, ascorbic acid derivatives, colorless couplers and sulfonamide phenol derivatives as a anticolorfoggant or a color mixing inhibitor.

Known antidiscoloration agents may be used in the photosensitive materials as used in the present invention, such as hydroquinones, 6-hydroxycumarones, 5-hydroxycumarones, spirocumarones, p-alkoxyphenols, hindered phenols such as bisphenols, gallic acid derivatives, methylenedioxybenzenes, aminophenols, hindered amines, and ether or ester derivatives obtained by silylation or alkylation of the phenolic hydroxyl group of these compounds. Further, metal complexes such as (bissalicylaldoximato) nickel complex and (bis-N,N-dialkyldithiocarbamato) nickel complex may also be used.

UV absorbers may be added to a hydrophilic colloidal layer in the photosensitive materials which can be used in the present invention. For instance, benzotriazoles substituted with an aryl group described in U.S. Pat. Nos. 3,553,794 and 4,236,013, Japanese Patent Publication No. 51-6540 and Europe Patent No. 57,160; butadienes described in U.S. Pat. Nos. 4,450,229 and 4,195,999; cinnamates described in U.S. Pat. Nos. 3,705,805 and 3,707,375; benzophenones described in U.S. Pat. No. 3,215,530 and U.K. Patent No. 1,321,355; and polymeric compound having UV absorbing residues described in U.S. Pat. Nos. 3,761,272 and 4,431,726 may be used. Fluorescent whitners having a UV absorbing property described in U.S. Pat. Nos. 3,499,762 and 3,700,455. Typical UV absorbers are those described in Research Disclosure 24239 (June, 1984).

The photosensitive materials which can be used in the invention may include one or more surfactants for various purposes, for instance, as a coating assistant or an antistatic, for improvement of slipping, emulsifying dispersion, prevention of adhesion or improvement of photographic properties such as development acceleration, contrast develoment and sensitization.

The photosensitive materials which may be employed in the present invention may contain water-soluble dyes in hydrophilic colloidal layers, which serve as filter dyes and further serve to prevent irradiation, or halation and so on. As such dyes, oxonol dyes, hemioxonol dyes, styryl dyes, merocyanine dyes, anthraquinone dyes, azo dyes are preferably used. Besides, cyanine dyes, azomethine dyes, triarylmethane dyes and phthalocyanine dyes are also useful. It is possible to emulsify an oil-soluble dyes by oil-in-water dispersion method and add it to hydrophilic colloidal layers.

In order to introduce a lipophilic compound such as photographic couplers into a hydrophilic organic colloidal layer of the photosensitive materials which can be used in this invention, various methods such as oil-in-water dispersion method, latex dispersion method, solid dispersion method and alkali dispersion method may be adopted. A proper method may be selected depending on chemical structure and physicochemical properties of a compound to be introduced.

The photographic couplers used in the present invention may be added to, for instance, one or more silver halide emulsion layers preferably according to the latex dispersion method or, more preferably, the oil-in-water dispersion method. In the oil-in-water dispersion method, the couplers are dissolved in a high boiling organic solvent of a boiling point of 175° C. or higher in an atmospheric pressure (hereinafter referred to as oil) using, if necessary, a low boiling auxiliary solvent together, and are finely dispersed in water or an aqueous binder solution of, for instance, gelatin, preferably, in the presence of a surfactant.

Typical high boiling organic solvents are phthalates described in U.S. Pat. Nos. 2,272,191 and 2,322,027, Japanese Patent Un-examined Publication Nos. 54-31728 and 54-118246; phosphates and phosphonates described in U.S. Pat. Nos. 3,676,137, 4,217,410, 4,278,757, 4,326,022 and 4,353,979; benzoates described in U.S. Pat. No. 4,080,209; amides described in U.S. Pat. Nos. 2,533,514, 4,106,940 and 4,127,413; alcohols and phenols described in Japanese Patent Un-examined Pubication Nos. 51-27922, 53-13414 and 53-130028 and U.S. Pat. No. 2,835,579; aliphatic carboxylic esters described in Japanese Patent Un-examined Publication Nos. 51-26037, 51-27921, 51-149028, 52-34715, 53-1521, 53-15127, 54-58027, 56-64333 and 56-114940, U.S. Pat. Nos. 3,748,141, 3,779,765, 4,004,928, 4,430,421 and 4,430,422; anilines described in Japanese Patent Un-examined Publication No. 58-105147; hydrocarbons described in Japanese Patent Un-examined Publication Nos. 50-62632 and 54-99432 and U.S. Pat. No. 3,912,515; solvents described in Japanese Patent Un-examined Publication No. 53-146622, U.S. Pat. Nos. 3,689,271, 3,700,454, 3,764,336, 3,765,897, 4,075,022 and 4,239,851 and DEOS No. 2,410,914. Two or more high boiling organic solvents may be used in combination. For instance, a combination of phthalate and phosphate is described in U.S. Pat. No. 4,327,175.

A dispersion method by polymers described in Japanese Patent Un-examined Publication No. 51-59943, Japanese Patent Publication Nos. 51-39853 and 56-126830, U.S. Pat. Nos. 2,772,163 and 4,201,589 may also be used.

Gelatin is preferred as a binder or protective colloid which may be used in an emulsion layer or an intermediate layer of the photosensitive materials as used in the invention, although other hydrophilic colloid may also be used. For instance, proteins such as gelatin derivatives, graft polymers of gelatin and other polymers, albumin and casein; cellulose derivatives such as hydroxyethyl cellulose, carboxymethyl cellulose and cellulose sulfates; sodium alginate; sugar derivatives such as starch derivatives; various synthetic hydrophilic homopolymers or copolymers such as polyvinyl alcohol, polyvinyl alcohol partial acetal, poly-N-vinyl pyrrolidone, polyacrylic acid, polymethacrylic acid, polyacrylamide, polyvinylimidazole and polyvinylpyrazol.

For gelatin, lime-treated gelatin for general use, acid-treated gelatin, and enzyme-treated gelatin described in Bull. Soc. Sci. Phot. Japan, No. 16, p 30 (1966) may be used. Further, hydrolyzed gelatin may be used.

Inorganic or organic hardners may be included in a photographic photosensitive layer or any hydrophilic colloidal layers constituting a backing layer in the photosensitive materials which may be used in the invention. For instance, cromate, aldehydes such as formaldehyde, glyoxal and glutaraldehyde, N-methylol compounds such as dimethylol urea are named as examples. Active halogen compound such as 2,4-dichloro-6-hydroxy-1,3,5-triazine, and active vinyl compounds such as 1,3-bisvinylsulfonyl-2-propanol, 1,2-bisvinylsulfonylacetamide ethane and vinyl polymers having a vinyl sulfonyl group on side chains are preferred, because these compounds quickly harden hydrophilic colloid such as gelatin to provide stable photograhic properties. N-carbamoylpyridinium salts and haloamidinium salts are also excellent in hardening speed.

The methods according to the present invention can be adopted to process a multilayered multicolor photographic materials having at least two layers of different spectral sensitivities applied on a support. Multilayer natural color photographic materials processed according to this invention usually have at least one red-sensitive emulsion layer, at least one green-sensitive emulsion layer and at least one blue-sensitive emulsion layer on a substrate. The order of arrangement of these layers is not restricted to a specific one and may be selected according to need. Layer arrangement is preferably in an order of red-sensitive layers, green-sensitive layers and, then, blue-sensitive layers from the substrate. It is possible that an emulsion layer having a certain color-sensitivity is comprised of more than one emulsion layers having different sensitivities to enhance attainable sensitivity. It is also possible to use such layer made up by a three-layered constitution to improve graininess. Further, there may be a non-color-sensitive layer between two or more emulsion layers having the same color sensitivity. It is likewise possible that, between emulsion layers of the same color sensitivity, another emulsion layer of a different color sensitivity is inserted.

In multi-layered multi-color photographic materials, there may be provided filter layers for absorbing lights of specific wave lengths and/or layers for preventing halation. The aforesaid organic dyes as well as colloidal silver grains may be used in those light-absorbing layers.

For the purpose of enhancing sensitivity by reflection of light and trapping of development inhibiting substances, non-light-sensitive silver halide fine grain emulsion may be used in one or more non-light-sensitive layers of multi-layered multi-color photographic materials.

Generally, cyan-forming couplers are included in red-sensitive emulsion layers; magenta-forming couplers in green-sensitive emulsion layers; and yellow-forming couplers in blue-sensitive emulsion layers. However, other combinations are also permitted. For instance, an IR-sensitive layer is combined to yield quasicolorphotographs or materials to be exposed to semi-conductor laser. Further, it is possible to admix a coupler which forms a dye developing a color other than the complementary color of a sensitive light wave length of each layer so as to avoid unnatural hue as disclosed in Japanese Patent Publication No. 33-3481.

In the photographic materials to which the methods according to the invention are applied, photographic emulsion layers and other layers are coated on a conventional flexible substrate such as a plastic film, paper and cloth, or a rigid substrate such as glass, ceramics or metals. Examples of useful flexible substrate are films composed of a synthetic or semi-synthetic polymer such as cellulose nitrate, cellulose acetate, cellulose acetate butyrate, polystyrene, polyvinyl chloride, polyethylene terephthalate and polycarbonate, baryta paper and paper coated or laminated with α-olefine polymer such as polyethylene, polypropylene and ethylene-butene copolymer. The substrate may be colored with dyes or pigments. It may be made black for shielding light. The surface of the substrate is generally undercoated to give good adhesion with a photographic emulsion layer or the like. It is possible to subject the substrate surface to glow discharge, corona discharge, irradiation with UV light or flame treatment before or after undercoating.

For coating the surface of the substrate with photographic emulsion layers or hydrophilic colloid layers, various known coating methods may be used, such as a dip coating method, roller coating method, curtain coating method and extrusion coating method. When occasion demands, the coating methods described in U.S. Pat. Nos. 2,681,294; 2,761,791; 3,526,528; and 3,508,947 may be used for the simultaneous coating with plural layers.

Various exposure means may be adopted for the photosensitive materials which can be processed according to the present invention. Any sources of light which radiate radiant rays corresponding to the sensitive wave length of the photosensitive materials may be used as a lighting source or a writing source of light. Natural light (sun light), incandescents, halogen atom sealing lamps, mercury lamps, fluorescent lamps, flash light sources such as strobo lamps and metal burning flash lamps are usually used. Further, laser of gases, dye solutions or semi-conductors, luminescent diodes and plasma light sources may also be used. Fluorescent light emitted from a fluorescent body excited by electron beams or the like (CRT, etc.), or an exposure means of a combination of microshutter arrays using liquid crystal (LCD) or lead zirconate titanate (PLZT) doped with lanthanum and a source of light of a linear or plane form may also be used. The spectral distribution of light used for exposure may be controlled utilizing a color filter according to need.

The present invention is adopted to process photosensitive materials comprised of the foregoing components and having a variety of known constructions of layers. Preferred layer constructions are listed below, in which as the substrate, there may be mentioned, for instance, flexible substrates such as plastic films, paper and cloths; glass, porcelain and metals. Among them, preferred are baryta paper and paper laminated with polyethylene film in which a white pigment such as titanium oxide and/or a bluing dye such as Ultramarine Blue are incorporated. Examples thereof are those disclosed in Research Disclosure No. 17643, p 23–27 and ibid, No. 18716, p 648–650.

(i) substrate-BL-MC-GL-MC-RL-PC(2)-PC(1);
(ii) substrate-BL-MC-RL-MC-GL-PC(2)-PC(1);
(iii) substrate-RL-MC-GL-MC-BL-PC(2)-PC(1);
(iv) substrate-RL-MC-RL-MC-GL-PC(2)-PC(1);
(v) substate-BL(2)-BL(1)-MC-GL(2)-GL(1)-MC-RL(2)-RL(1)-PC(2)-PC(1).

Wherein PC(1) and PC(2) represent non-photosensitive layers, MC an intermediate layer, BL a blue-sensitive emulsion layer, GL green-sensitive emulsion layer and RL red-sensitive emulsion layer, respectively.

Heretofore, it has been known that the formation of precipitations such as calcium carbonate can be prevented by softening hard water. However, the effects of the present invention are surely achieved by softening hard water as well as by restricting the amount of replenishing water to a specific range and/or sterilizing washing water prior to supplying it to washing baths Therefore, these effects result from the synergistic action of these two or three factors and have never been expected from the aforesaid known fact.

The present invention can effectively be applied to the processing of any silver halide (color) photosensitive materials such as color paper, monochromatic paper, reversal color paper, color positive films, color negative films, monochromatic negative films, color reversal films, monochromatic reversal films, X-ray films, microfilms, copying films, direct positive films, printing films and gravure films.

The processing methods for silver halide photosensitive materials according to the present invention will hereunder be explained in more detail with reference to unlimitative working examples and the effects practically attained will also be discussed in comparison with comparative examples.

EXAMPLE 1

A multilayered color photographic paper having a layer structure as disclosed in the following Table 1 was prepared on a paper substrate, both surfaces of which were laminated with polyethylene films. Each coating liquid was prepared according to the following procedures

Preparation of Coating Liquid for 1st Layer

To 19.1 g of an yellow coupler (a) and 4.4 g of a dye image stabilizer (b) there were added 27.2 ml of ethyl acetate and 7.9 ml of solvent (c) and the resultant solution was dispersed in 185 ml of 10% aqueous gelatin solution containing 8 ml of 10% sodium dodecylbenzenesulfonate solution to form an emulsion. On the other hand, 90 g of a blue-sensitive emulsion was prepared by adding the following blue-sensitive sensitizing dye to a silver chlorobromide emulsion (silver bromide content = 1 mole %; amount of silver = 70 g/kg) in an amount of $5.0\times10^{-4}$ moles per mole of the silver chlorobromide. The emulsified dispersion and the blue-sensitive emulsion prepared above were mixed and the concentration of gelatin was adjusted so as to obtain the composition described in Table 1 and thus the coating liquid for 1st layer was prepared.

Coating liquids for second to seventh layers were also prepared according to procedures similar to those for preparing the first liquid. In each of these layers, sodium salt of 1-oxy-3,5-dichloro-s-triazine was used as a hardening agent for gelatin.

The following spectral sensitizers were used in each of the emulsions:

Blue-sensitive emulsion layer

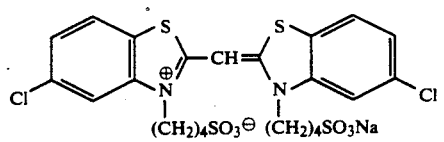

(Amount added = $5.0\times10^{-4}$ moles per mole of silver halide)

Green-sensitive emulsion layer

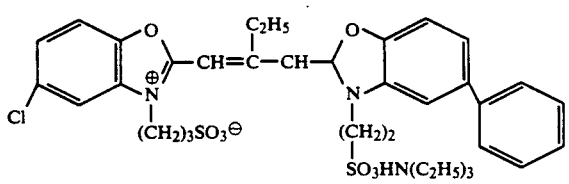

(Amount added = $4.0\times10^{-4}$ moles per mole of silver halide)

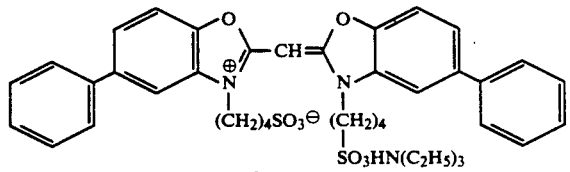

(Amount added = $7.0\times10^{-5}$ moles per mole of silver halide)

Red-sensitive emulsion layer

-continued

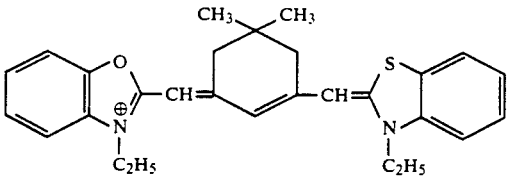

(Amount added = $1.0 \times 10^{-4}$ mole per mole of silver halide)

The following dyes were used in each of the emulsions as an irradiation resistant dye:

Green-sensitive emulsion layer

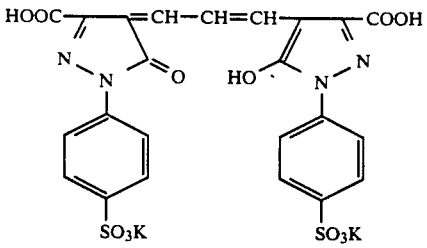

Red-sensitive emulsion layer

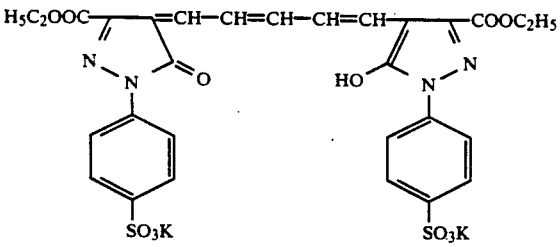

The structural formula of the compounds such as couplers used in this Example were as follows:

(a) Yellow coupler

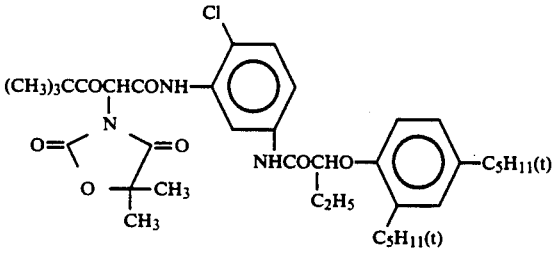

(b) Dye image stabilizer

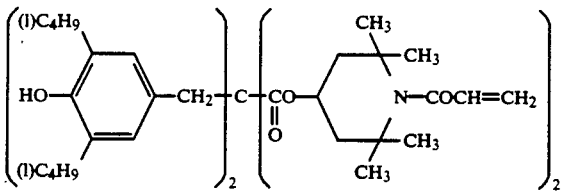

(c) Solvent

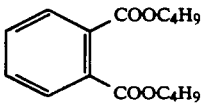

-continued (d)

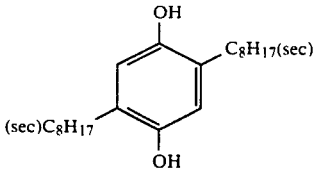

(e) Magenta coupler

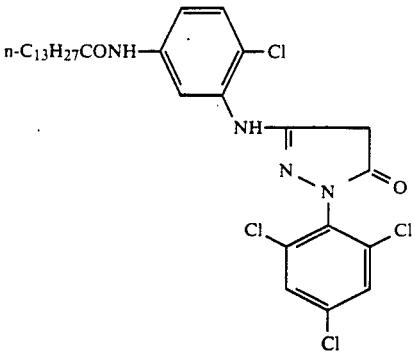

(f) Dye image stabilizer

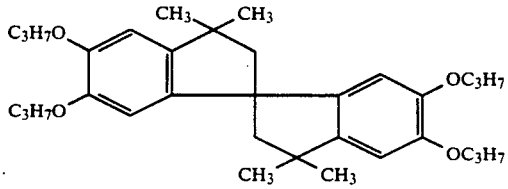

(g) Solvent

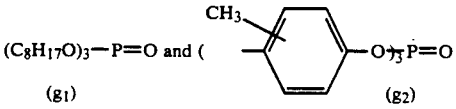

(2:1 (weight ratio) mixture)

(h) Ultraviolet absorber

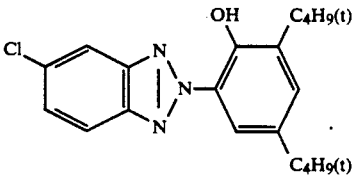

(h1)

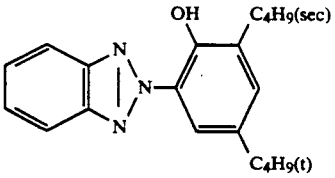

(h2)

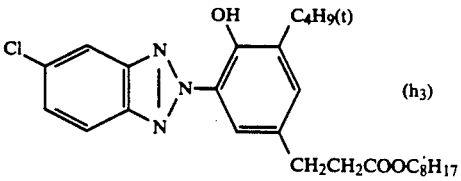

(h3)

(1:5:3 mixture (molar ratio))

(i) Color mixing inhibitor

-continued

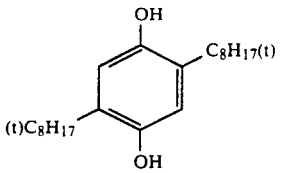

(j) Solvent $(isoC_9H_{18}O)_3P{=}O$ (k) Cyan coupler

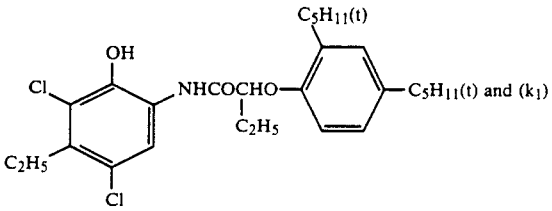

(1:1 mixture (molar ratio))

(l) Dye image stabilizer

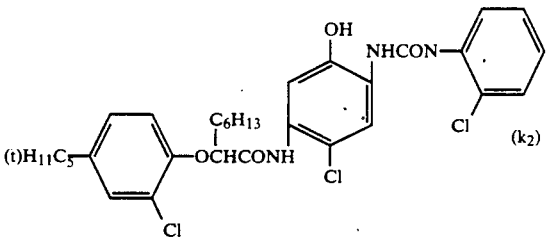

(k2)

-continued

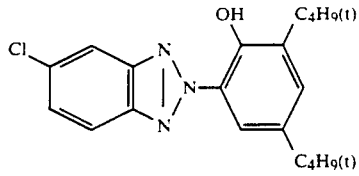

(l1)

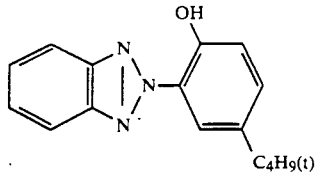

(l2)

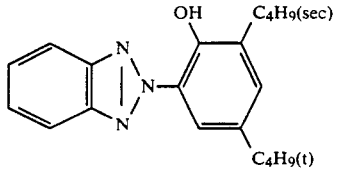

(l3)

(1:3:3 mixture (molar ratio))

(m) Solvent

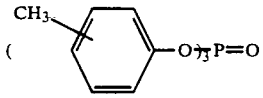

TABLE 1

| Layers | Principal composition | Amount used |
|---|---|---|
| 7th layer (Protective layer) | gelatin | 1.50 g/m$^2$ |
| 6th layer (UV absorbing layer) | gelatin | 0.54 g/m$^2$ |
| | UV absorber (h) | 0.21 g/m$^2$ |
| | solvent (j) | 0.09 cc/m$^2$ |
| 5th layer (Red-sensitive layer) | silver chlorobromide (AgBr: 1 mole %) Ag: | 0.26 g/m$^2$ |
| | gelatin | 0.98 g/m$^2$ |
| | cyan coupler (k) | 0.38 g/m$^2$ |
| | dye image stabilizer (l) | 0.17 g/m$^2$ |
| | solvent (m) | 0.23 cc/m$^2$ |
| 4th layer (UV absorbing layer) | gelatin | 1.60 g/m$^2$ |
| | UV absorber (h) | 0.62 g/m$^2$ |
| | color mixing inhibitor (i) | 0.05 g/m$^2$ |
| | solvent (j) | 0.26 cc/m$^2$ |
| 3rd layer (Green-sensitive layer) | silver chlorobromide (AgBr: 1 mole %) Ag: | 0.30 g/m$^2$ |
| | gelatin | 1.80 g/m$^2$ |
| | magenta coupler (e) | 0.34 g/m$^2$ |
| | dye image stabilizer (f) | 0.20 g/m$^2$ |
| | solvent (g) | 0.68 cc/m$^2$ |
| 2nd layer (Color mixing inhibiting layer) | gelatin | 0.99 g/m$^2$ |
| | color mixing inhibitor (d) | 0.08 g/m$^2$ |
| 1st layer (Blue-sensitive layer) | silver chlorobromide (AgBr: 1 mole %) Ag: | 0.30 g/m$^2$ |
| | gelatin | 1.86 g/m$^2$ |
| | yellow coupler (a) | 0.82 g/m$^2$ |
| | dye image stabilizer (b) | 0.19 g/m$^2$ |
| | solvent (c) | 0.34 cc/m$^2$ |
| Substrate | paper laminated with polyethylene (polyethylene situated at the side of 1st layer contains a white pigment ($TiO_2$) and a bluing dye (Ultramarine Blue)) | |

The photographic paper thus prepared was cut into long band-like paper of 82.5 mm in width, they were exposed to light by an autoprinter and then processed by an autodeveloping machine according to each of the following processing steps shown in Table 2.

TABLE 2

| Step | Temp. °C. | Processing time (sec.) | Volume of tank (l) | Amount replenished (per 1 m of paper having a width of 82.5 mm) |
|---|---|---|---|---|
| Color Development | 35 | 45 | 16 | 13 ml |
| Bleaching-Fixing | 35 | 45 | 10 | 8 ml |
| Water Washing (1) | 35 | 20 | 4 | Multistage and Countercurrent System |
| Water Washing (2) | 35 | 20 | 4 | |
| Water Washing (3) | 35 | 20 | 4 | 15 ml |
| Water Washing (4) | 35 | 20 | 4 | |

Each of the processing liquids used in these steps had the following composition:

(Color Development Liquid)

| Component | Mother Liquor | Replenishing Liquid |
|---|---|---|
| Water | 800 ml | 800 ml |
| 1-Hydroxyethylidene-1,1-diphosphonic acid (60% solution) | 1.5 ml | 1.5 ml |
| Lithium chloride | 1.0 g | 1.0 g |
| Diethylenetriaminepenta-acetic acid | 1 g | 1 g |
| 4,5-Dihydroxy-m-benzenediphosphonic acid | 1.0 g | 1.5 g |
| Sodium sulfite | 0.5 g | 1.0 g |
| Potassium bromide | 0.1 g | — |
| Sodium chloride | 1.5 g | — |
| Adenine | 30 mg | 60 mg |
| Potassium carbonate | 40 g | 40 g |
| N-Ethyl-N-(β-methane-sulfonamideethyl)-3-methyl-4-aminoaniline sulfate | 4.5 g | 11.0 g |
| Hydroxylamine sulfate | 3.0 g | 4.0 g |
| Fluorescent Whitener (Whitex 4: manufactured and sold by Sumitomo Chemical Company, Ltd.) | 1.0 g | 2.0 g |
| Polyethyleneimine (50% aqueous solution) | 3.0 g | 3.0 g |
| Water | (Amount sufficient to obtain 1 liter of each solutions) | |
| pH (KOH) | 10.25 | 10.80 |

(Bleaching-Fixing Liquid)

| Component | Mother Liquor | Replenishing liquid |
|---|---|---|
| Water | 700 ml | 700 ml |
| Ammonium thiosulfate (70%) | 150 ml | 150 ml |
| Sodium sulfite | 18 g | 25 g |
| Ferric ammonium ethylenediamine-tetraacetate | 55 g | 65 g |
| Ethylenediaminetetra-acetic acid | 5 g | 10 g |
| pH (adjusted by the addition of aqueous ammonia or acetic acid) | 6.75 | 6.50 |
| Water | (Amount required to obtain 1 liter of the intended solutions) | |

Washing Water

Well water having the following properties was passed through a column packed with H-type strong acidic cation exchange resin (manufactured and sold under the trade name of Diaion SK-1B by MITSUBISHI CHEMICAL INDUSTRIES LTD.) and OH-type strong basic anion exchange resin (manufactured and sold under the trade name of Diaion SA-10A by MITSUBISHI CHEMICAL INDUSTRIES LTD.) and the resulting soft water was used as washing water.

TABLE 3

Properties of Washing Water

| | Before ion exchange | After ion exchange |
|---|---|---|
| pH | 6.8 | 6.6 |
| Calcium ions | 38 mg/l | 0.4 mg/l |
| Magnesium ions | 11 mg/l | 0.1 mg/l |
| Chlorine ions | 32 mg/l | 3.3 mg/l |
| Residue after evaporation | 185 mg/l | 20.4 mg/l |

The processing was carried out at a rate of 180 m/day an such processing was repeated for 6 days. After processing for 6 days, water in the final water washing bath was took to charge it in test tubes of 100 ml volume and then calcium chloride ($CaCl_2.2H_2O$) and magnesium chloride ($MgCl_2.6H_2O$) were added to each test tube so as to obtain calcium and magnesium concentrations listed in Table 4. Thereafter, these tubes were maintained in an air thermostat chamber held at 25° C. for 10 days and then the samples were examined on turbidity of washing water and proliferation of mold at this time.

The degree of turbidity was determined from absorbance at 700 nm (optical path = 10 mm) and visual observation, while the proliferation of mold was estimated according to visual observation.

TABLE 4

Estimation of Turbidity and Mold

| | No. | Ca Concn. (mg/l) | Mg Concn. (mg/l) | Turbidity Absorbance | Turbidity Visual Observation | Mold (Visual Observation) |
|---|---|---|---|---|---|---|
| Invention | 1 | 0.9 | 0.4 | 0.002 | (−) | (−) |
| Invention | 2 | 2 | " | " | (−) | (−) |
| Invention | 3 | 3 | " | " | (−) | (−) |
| Invention | 4 | 5 | " | 0.004 | (−) | (−) |
| Comparative Example | 5 | 7 | " | 0.010 | (+) | (−) |
| Comparative Example | 6 | 10 | " | 0.018 | (++) | (−) |
| Comparative Example | 7 | 20 | " | 0.023 | (++) | (−) |

TABLE 4-continued

| | | | | | | |
|---|---|---|---|---|---|---|
| Invention | 8 | 0.9 | 2 | 0.002 | (−) | (−) |
| Invention | 9 | " | 3 | " | (−) | (−) |
| Invention | 10 | " | 5 | 0.004 | (−) | (−) |
| Comparative Example | 11 | " | 7 | 0.005 | (−) | (+) |
| Comparative Example | 12 | " | 10 | 0.010 | (+) | (+++) |
| Comparative Example | 13 | " | 20 | 0.019 | (++) | (++) |
| Invention | 14 | 2 | 2 | 0.002 | (−) | (−) |
| Invention | 15 | 3 | 3 | " | (−) | (−) |
| Invention | 16 | 5 | 5 | 0.004 | (−) | (−) |
| Comparative Example | 17 | 7 | 7 | 0.011 | (+) | (+) |
| Comparative Example | 18 | 10 | 10 | 0.024 | (++) | (+++) |
| Comparative Example | 19 | 20 | 20 | 0.031 | (+++) | (++) |

| Explanation of Ideograms | Turbidity | Mold |
|---|---|---|
| (−) | not observed | not observed |
| (+) | observed (in small degree) | observed (in small extent) |
| (++) | observed (in some degree) | observed (in some extent) |
| (+++) | observed (in great degree) | observed (in great extent) |

As seen from the results shown in Table 4, it is clear that the increase in turbidity and the proliferation of mold can surely be prohibited for a long period of time by lowering the concentrations of both calcium and magnesium in the washing water to not more than 5 mg/l.

The basic molecular structure of Diaion SK-1B available from MITSUBISHI CHEMICAL INDUSTRIES LTD. is as follows:

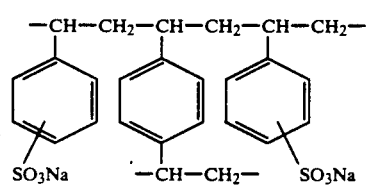

EXAMPLE 2

The following four kinds of color photographic paper $P_1$ to $P_4$ were prepared:

| | |
|---|---|
| Color photographic paper $P_1$: | Color photographic paper described in Table 1 of Example 1. |
| Color photographic paper $P_2$: | Similar to the color photographic paper $P_1$ except that the 7th layer had the following composition: |
| Gelatin | 1.33 g/m$^2$ |
| Acrylic acid modified polyvinyl alcohol copolymer (degree of modification = 17%) | 0.17 g/m$^2$ |
| Color photographic paper $P_3$: | Color photographic paper having a layer structure and composition of each layer shown in Table 5. |
| Color photographic paper $P_4$: | Similar to the color photographic paper $P_3$ except that the 7th layer had the following composition: |
| Gelatin | 1.46 g/m$^2$ |

-continued

| | |
|---|---|
| Acrylic acid modified polyvinyl alcohol copolymer (degree of modification = 17%) | 0.16 g/m$^2$ |

TABLE 5

| Layer | Principal Composition | Amount used (g/m$^2$) |
|---|---|---|
| 7th layer (protective layer) | Gelatin | 1.62 |
| 6th layer (UV absorbing layer) | Gelatin | 1.06 |
| | UV absorber (h) | 0.35 |
| | UV absorbing solvent (c) | 0.12 |
| 5th layer (Red-sensitive layer) | Silver chlorobromide (AgBr content = 50 mole %) | 0.25 (silver) |
| | Gelatin | 1.26 |
| | Cyan coupler (k) | 0.50 |
| | Coupler solvent (c) | 0.25 |
| 4th layer (UV absorbing layer) | Gelatin | 1.60 |
| | UV absorber (h) | 0.70 |
| | Color mixing inhibitor (i) | 0.20 |
| | Solvent for color mixing inhibitor (c) | 0.30 |
| 3rd layer (Green-sensitive layer) | Silver chlorobromide (AgBr content = 70 mole %) | 0.17 (silver) |
| | Gelatin | 1.40 |
| | Magenta coupler (n) | 0.40 |
| | Coupler solvent (g) | 0.20 |
| 2nd layer (Intermediate layer) | Gelatin | 1.10 |
| | Color mixing inhibitor (i) | 0.20 |
| | Solvent for color mixing inhibitor (c) | 0.10 |
| 1st layer (Blue-sensitive layer) | Silver chlorobromide (AgBr content = 80 mole %) | 0.35 (silver) |
| | Gelatin | 1.54 |
| | Yellow coupler (a) | 0.50 |
| | Coupler solvent (c) | 0.50 |
| Substrate | Paper laminated with polyethylene films in which the polyethylene situated at the side of 1st layer contains a white pigment (such as $TiO_2$) and a bluing dye such as | |

TABLE 5-continued

Ultramarine Blue.

Magenta coupler (n)

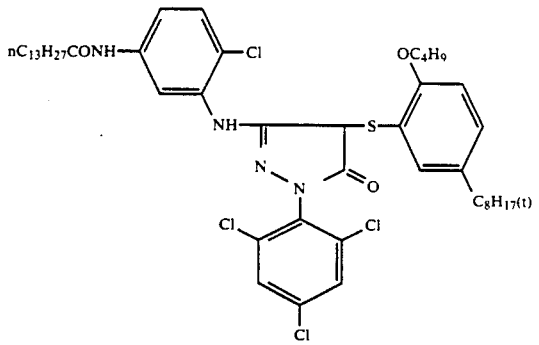

In addition to the foregoing compounds, the same spectral sensitizers as in Example 1 were used.

After exposing the color photographic paper $P_1$ (82.5 mm in width) to light utilizing an autoprinter, it was processed by an autodeveloping machine according to processing (I) shown in Table 6. In the processing (I), five kinds of water washing procedures inclusive of the present invention were conducted and results obtained were compared with each other.

TABLE 6

| Steps of the Processing (I) | | | | |
|---|---|---|---|---|
| Step | Temp. °C. | Processing time (sec.) | Volume of tank (l) | Amount replenished |
| Color Development | 35 | 45 | 16 | 13 ml |
| Bleaching-Fixing | 35 | 45 | 10 | 8 ml |
| Water Washing (1) | 35 | 20 | 3.5 | Multistage Countercurrent System The amount replenished was hereunder described. |
| Water Washing (2) | 35 | 20 | 3.5 | |
| Water Washing (3) | 35 | 20 | 3.5 | |

Figure 6:
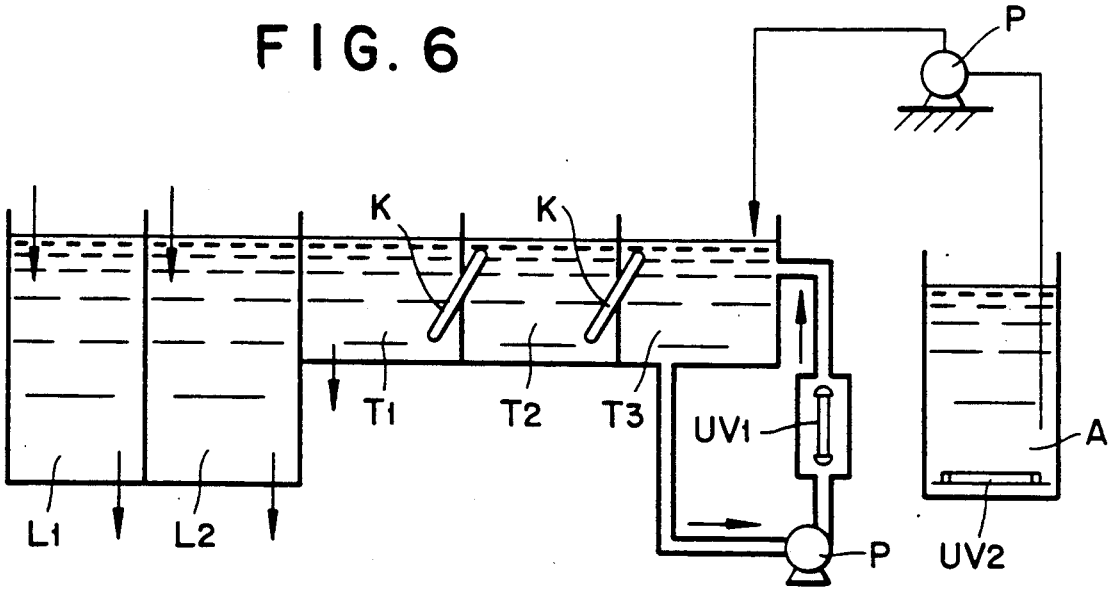

| | |
|---|---|
| Water washing process A: (Comparative Example) | Tap water having the following properties was replenished in an amount 30 ml per unit length (1 m) of the color photographic paper. |
| pH | 7.1 |
| Calcium ions | 21 mg/l |
| Magnesium ions | 9 mg/l |
| Water washing process B: (Comparative Example) | Washing water comprises the same tap water as in the water washing process A and 5-chloro-2-methyl-4-isothiazilin-3-one disclosed in Japanese Patent Un-examined Publication No. 57-8542 as a mold control agent and suspending agent in an amount of 0.5 g per liter of tap water and the resultant washing water was replenished at a rate of 30 ml per unit length (1 m) of the color photographic paper. |
| Water washing process C: (Comparative Example) | As shown in FIG. 6, low pressure mercury UV lamps of quartz glass having a rated consumed power of 4W (main wave length = 2537Å) were disposed to a washing water storage tank for replenishing and a final water washing bath. Tap water similar to that in the water washing process A was introduced in the washing water storage tank and the tap water was replenished in an amount of 30 ml per unit length (1 m) of the color photographic paper while continuously irradiating water in the storage tank and the final water washing bath with UV light during operating the autodeveloping machine. |
| Water washing process D: (Present Invention) | Tap water similar to that in the water washing process A was treated with Na-type strong acidic cation exchange resin (manufactured and sold under the trade name of Diaion SK-1B by MITSUBISHI CHEMICAL INDUSTRIES LTD.) to obtain washing water having the following properties and the water was replenished in an amount of 30 ml per 1 m of the color photographic paper. |
| pH | 6.9 |
| Calcium ions | 1.6 mg/l |
| Magnesium ions | 0.5 mg/l |
| Water washing process E: (Present Invention) | The water treated with ion exchange resin as in the water washing process D was replenished in an amount of 30 ml per 1 m of the color photographic paper while irradiating the water with UV light as in the case of the water washing process C. |

In the processing methods including the water washing processes A to E, the color photographic paper $P_1$ of 82.5 mm in width was processed in a rate of 180 m per day for 6 days and then the processing was interrupted for 4 days. Thereafter, the conditions (turbidity and presence of mold) of each of the water washing bath and calcium and magnesium concentration of the washing water contained in the final water washing bath were determined. Then, the color photographic paper $P_1$ as well as $P_2$ were further processed in the same procedures and baths to determine the degree of contamination (stains and deposition of mold or the like on the processed photographic paper) as well as adhesion properties thereof when two sheets of the processed photographic paper were superposed. The concentrations of calcium and magnesium were determined according to atomic-absorption spectroscopy.

Furthermore, in a processing (II) as shown in Table 7 in which the color photographic paper $P_3$ was employed, results obtained were compaired between the water washing processes A to E. The processing (II) was identical to the processing (I) except for utilizing the following processing steps and color developing liquid having the following composition.

TABLE 7

| Steps in the Processing (II) | | | | |
|---|---|---|---|---|
| Step | Temp. (°C.) | Processing time | Volume of tank (l) | Amount replenished |
| Color Development | 38 | 1 min. 40 sec. | 16 | 24 ml |
| Bleaching-Fixing | 33 | 1 min. | 10 | 13 ml |

TABLE 7-continued

| Steps in the Processing (II) | | | | |
|---|---|---|---|---|
| Step | Temp. (°C.) | Processing time | Volume of tank (l) | Amount replenished |
| Water Washing (1) | 33 | 20 sec. | 3.5 | Multistage Countercurrent System (The amount replenished was hereunder described.) |
| Water Washing (2) | 33 | 20 sec. | 3.5 | |
| Water Washing (3) | 33 | 20 sec. | 3.5 | |

(Color Developing Liquid for the Processing (II))

| Component | Mother Liquor | Replenishing liquid |
|---|---|---|
| Water | 800 ml | 800 ml |
| 1-Hydroxyethylidene-1,1-diphosphonic acid (60% solution) | 1.5 ml | 1.5 ml |
| Diethylenetriaminepenta-acetic acid | 1.0 g | 1.0 g |
| Benzyl alcohol | 16 ml | 20 ml |
| Diethylene glycol | 10 ml | 10 ml |
| Sodium sulfite | 2.0 g | 2.5 g |
| Hydroxylamino sulfate | 3.0 g | 3.5 g |
| Potassium bromide | 1.0 g | — |
| Sodium carbonate | 30 g | 35 g |
| N-ethyl-N-(β-methane-sulfonamideethyl)-3-methyl-4-aminoamiline sulfate | 6.0 g | 8.0 g |
| Water | (Amount required to form 1000 ml of the intended liquids) | |
| pH | 10.25 | 10.60 |

The color photographic paper $P_3$ was processed for 6 days followed by interrupting the processing over 4 days and then the processing was continued with the color photographic paper $P_3$ and $P_4$ to effect estimation of the same properties as before. Results obtained are listed in the following Table 8.

TABLE 8

| No. | Processing | Water Washing Process | Concn. in the Final Water Washing Bath: Ca (mg/l) | Concn. in the Final Water Washing Bath: Mg (mg/l) | Conditions of Liquid in each Water Washing Bath: Turbidity. Color of Liquid | Conditions of Liquid in each Water Washing Bath: Proliferation of Mold | Color Photographic Paper | Contaminant | Adhesion Properties | Remarks |
|---|---|---|---|---|---|---|---|---|---|---|
| 1 | (I) | A | 16 | 7 | (++) | (+++) | $P_1$ | (++) | (+) | Comparative |
| | | | | | | | $P_2$ | (+) | (+) | Example |
| 2 | (I) | B | 15 | 7 | (++) | (−) | $P_1$ | (++) | (+++) | Comparative |
| | | | | | The liquid was colored black | | $P_2$ | (+) | (+++) | Example |
| 3 | (I) | C | 15 | 8 | (++) | (+++) | $P_1$ | (++) | (+) | Comparative |
| | | | | | | | $P_2$ | (+) | (+) | Example |
| 4 | (I) | D | 1.9 | 0.6 | (−) | (+) | $P_1$ | (−) | (+) | Present |
| | | | | | | | $P_2$ | (+) | (−) | Invention |
| 5 | (I) | E | 1.9 | 0.5 | (−) | (−) | $P_1$ | (−) | (+) | Present |
| | | | | | | | $P_2$ | (+) | (+) | Invention |
| 6 | (II) | A | 14 | 7 | (+++) | (+++) | $P_3$ | (+++) | (++) | Comparative |
| | | | | | | | $P_4$ | (++) | (++) | Example |
| 7 | (II) | B | 15 | 8 | (++) | (−) | $P_3$ | (++) | (+++) | Comparative |
| | | | | | The liquid was colored black | | $P_4$ | (+) | (+++) | Example |
| 8 | (II) | C | 16 | 8 | (+++) | (+++) | $P_3$ | (+++) | (++) | Comparative |
| | | | | | | | $P_4$ | (+) | (+) | Example |
| 9 | (II) | D | 1.8 | 0.6 | (−) | (+) | $P_3$ | (+) | (++) | Present |
| | | | | | | | $P_4$ | (−) | (+) | Invention |
| 10 | (II) | E | 2.0 | 0.6 | (−) | (−) | $P_3$ | (−) | (++) | Present |
| | | | | | | | $P_4$ | (−) | (+) | Invention |

TABLE 9

| Explanation of Ideograms Appeared in Table 8 | | | | |
|---|---|---|---|---|
| | Turbidity·Color of Liquid | Proliferation of Mold | Contaminant (Stains·Deposit) | Adhesion Properties |
| (−) | not observed | not observed | not observed | no adhesion |
| (+) | observed (in small degree) | observed (in small degree) | observed (in small degree) | observed (in small extent) |
| (++) | observed (in some degree) | observed (in some degree) | observed (in some degree) | observed (in some extent) |
| (+++) | observed (in great degree) | observed (in great degree) | observed (in great degree) | observed (in great extent) |

Estimation of Adhesion Properties

The adhesion properties listed in Table 8 were determined according to the following method: After exposing whole the surface of a photographic paper, it was cut into pieces of 3.5 cm×6 cm in size followed by maintaining them in a controlled chamber held at 25° C. and a relative humidity (RH) of 80% for 2 days. Then, parts (3.5 cm×3.5 cm) of the two of them were superposed to one another, applied a load of 500 g and further maintained in a controlled chamber held at 35° C. and RH of 80% for 3 days. Thereafter, they were peeled off and the surfaces superposed were observed with respect to adhesion.

As seen from the results listed in Table 8, it was found that all of the turbidity, coloration of liquids and contaminants were observed in every water washing processes A, B and C in which the concentrations of calcium and magnesium were beyond the range defined in the present invention, while in the process of this invention, they were not observed at all. This means that the processing method of this invention is quite effective to eliminate the foregoing disadvantages. In the water washing process B in which 5-chloro-2-methyl-4-isothiazolin-3-one was used, the proliferation of mold was positively prohibited. However, the liquid turned very black and the photographic paper caused stains, while the adhesion properties were also extremely high. On the contrary, in the present invention, the adhesion properties were low enough and the proliferation of mold was effectively suppressed. In particular, as seen from the results observed on the water washing process E, it is found that the proliferation of mold is very effectively prohibited.

Moreover, it was also found that the use of a color photographic paper in which the 7th layer contains an acrylic acid modified polyvinyl alcohol copolymer provides an improved adhesion property in the processing method of the present invention.

EXAMPLE 3

The instant Example was carried out to explain the relationship between the effects of the present invention and the amount of the washing water used.

Color photographic paper as used in this example was the same as that used in Example 2 i.e., the color photographic paper $P_2$. Furthermore, the processing steps used herein were also the same as those in Example 2 (Table 6) and the processing liquids were those used in the processing (I).

As washing water, tap water and desalted water treated with an apparatus for reverse osmosis, those having the following properties were used in this Example.

| | | |
|---|---|---|
| Properties of the Tap Water used: | pH | 6.6 |
| | Ca ions | 26 mg/l |
| | Mg ions | 8 mg/l |
| Properties of the Desalted Water used: | pH | 6.8 |
| | Ca ions | 1.6 mg/l |
| | Mg ions | 0.3 mg/l |

The apparatus for reverse osmosis used herein was provided with a spiral type membrane for reverse osmosis of polysulfone having an area of 1.3 $m^2$ and the treatment of desalting was carried out under a pressure of 13 $kg/m^2$.

The details of the processing in this Example were shown in Table 10.

TABLE 10

| | Detail of the Processing | | | | |
|---|---|---|---|---|---|
| Running | Amount carried over from preceding bath (A) *1 | Amount of water replenished (B) *2 | Ratio (B/A) | Kind of the washing water | Amount processed |
| 1 | 2.5 ml | 400 ml | 160 | Tap water | 90 m/day × 6 days |
| 2 | 2.5 ml | 400 ml | 160 | Desalted water | 90 m/day × 6 days |
| 3 | 2.5 ml | 125 ml | 50 | Tap water | 90 m/day × 6 days |
| 4 | 2.5 ml | 125 ml | 50 | Desalted water | 90 m/day × 6 days |
| 5 | 2.5 ml | 25 ml | 10 | Tap water | 90 m/day × 6 days |
| 6 | 2.5 ml | 25 ml | 10 | Desalted water | 90 m/day × 6 days |
| 7 | 2.5 ml | 5 ml | 2 | Tap water | 90 m/day × 6 days |
| 8 | 2.5 ml | 5 ml | 2 | Desalted water | 90 m/day × 6 days |

As seen from the above, after processing 6 days, the calcium and magnesium concentrations were determined on the washing water in the final bath (3rd bath) according to atomic-absorption spectroscopy as well as it was also examined on turbidity of water, presence or absence of deposits on the processed color photographic paper and on whether mold proliferated on the processed color photographic paper when it was maintained under high temperature and humidity conditions.

In Table 10, "amount of liquid carried over by the treated paper from the preceding bath (A)" was determined according to the following manner: A sample of 1 m in length was collected just before the color photographic paper during treating entered into water washing bath and immadiately thereafter the sample was immersed in 1 l of distilled water followed by maintaining it at 30° C. while stirring with a magnetic stirrer. Then, a volume of the liquid was took therefrom, quantitatively analized on the concentration of thiosulfate ions $C_1$ (g/l ) contained therein, at the same time the concentration of thiosulfate ions $C_2$ (g/l ) of the fixing liquid in the preceding was also quantitatively determined and thus the amount of liquid (A (ml)) carried over from the preceding bath was estimated according to the following equation:

$$C_1 \times \frac{(1000 + A)}{A} = C_2$$

In this connection, the quantitative determination of thiosulfate ions was carried out by acidic iodine titration after adding formaldehyde to the sample to mask the coexisting sulfite ions.

Moreover, the "amount of water replenished (B)" in Table 10 means that per unit length (1 m) of the sample (color photographic paper).

Test on the proliferation of mold on the processed photographic paper was effected as follows: a piece of absorbent cotton wetted with water was placed in a plastic schale (a laboratory disk) and a piece (2 cm×2 cm) of the color photographic paper was sticked on the inner surface of a cover of the schale and then the schale was closed by placing the cover thereon without coming the piece into contact with the absorbent wadding. All implements used in this test, such as schale, absorbent wadding and so on were previously sterilized prior to the practical use.

The piece of the color photographic paper was thus maintained at 25° C. for 2 weeks and then observed whether mold grew or not.

Results thus obtained are listed in Table 11.

TABLE 11

| | Kind of washing | Concentration in the final bath | Ratio | Turbidity of washing | Degree of | Proliferation on the photo- |
|---|---|---|---|---|---|---|

TABLE 11-continued

| | Running | water | Calcium | Magnesium | B/A | water | deposition | graphic paper |
|---|---|---|---|---|---|---|---|---|
| Comparative Example | 1 | Tap water | 24 mg/l | 8 mg/l | 160 | (−) | (−) | (+) |
| Comparative Example | 2 | Desalted water | 1.8 mg/l | 0.5 mg/l | 160 | (−) | (−) | (+) |
| Comparative Example | 3 | Tap water | 2.1 mg/l | 7.2 mg/l | 50 | (+) | (+) | (++) |
| Present Invention | 4 | Desalted water | 2.0 mg/l | 0.7 mg/l | 50 | (−) | (−) | (+) |
| Comparative Example | 5 | Tap water | 17 mg/l | 7 mg/l | 10 | (+++) | (+++) | (+++) |
| Present Invention | 6 | Desalted water | 2.4 mg/l | 1.1 mg/l | 10 | (−) | (−) | (−) |
| Comparative Example | 7 | Tap water | 16 mg/l | 8 mg/l | 2 | (++) | (++) | (++) |
| Present Invention | 8 | Desalted water | 2.5 mg/l | 1.3 mg/l | 2 | (−) | (−) | (−) |

| Explanation of Ideograms | (Turbidity of Washing Water) | (Degree of Deposition) | (Proliferation of Mold on the Paper) |
|---|---|---|---|
| (−) | not observed | no deposit | no proliferation |
| (+) | observed (in small degree) | observed (in small degree) | observed (in small degree) |
| (++) | observed (in some degree) | observed (in some degree) | observed (in some degree) |
| (+++) | observed (in great degree) | observed (in great degree) | observed (in great degree) |

EXAMPLE 4

There was prepared a multilayered color photosensitive material (hereunder referred to as Sample N1) by applying, in order, the following layers, each of which had the composition given below, on a substrate of cellulose triacetate film provided with an underlying coating.

Composition of the Photosensitive Layer

In the following composition, each component was represented by coated amount expressed as g/m$^2$, while as to silver halide, the amount was represented by coated amount expressed as a reduced amount of elemental silver, provided that the amounts of sensitizing dyes and couplers were represented by coated amount expressed as molar amount per unit mole of silver halide included in the same layer.

Sample N1

1st Layer: Halation Inhibiting Layer

| | |
|---|---|
| Black colloidal silver | 0.18 (silver) |
| Gelatin | 1.40 |

2nd Layer: Intermediate Layer

| | |
|---|---|
| 2,5-Di-tert-pentadecylhydroquinone | 0.18 |
| C-1 | 0.07 |
| C3 | 0.02 |
| U-1 | 0.08 |
| U-2 | 0.08 |
| HBS-1 | 0.10 |
| HBS-2 | 0.02 |
| Gelatin | 1.04 |

3rd Layer: First Red-sensitive Emulsion Layer

| | |
|---|---|
| Silver iodobromide emulsion (AgI content = 6 mole %; average particle size = 0.8μ) | 0.50 (silver) |
| Sensitizing dye IX | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| C-2 | 0.146 |

-continued

| | |
|---|---|
| HBS-1 | 0.005 |
| C-10 | 0.0050 |
| Gelatin | 1.20 |

4th Layer: Second Red-sensitive Emulsion Layer

| | |
|---|---|
| Silver iodobromide emulsion (AgI content = 5 mole %; average grain size = 0.85μ) | 1.15 (silver) |
| Sensitizing dye IX | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| C-2 | 0.060 |
| C-3 | 0.008 |
| C-10 | 0.004 |
| HBS-1 | 0.005 |
| Gelatin | 1.50 |

5th Layer: Third Red-sensitive Emulsion Layer

| | |
|---|---|
| Silver iodobromide emulsion (AgI content = 10 mole %; average grain size = 1.5μ) | 1.50 (silver) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| C-5 | 0.012 |
| C-3 | 0.003 |
| C-4 | 0.004 |
| HBS-1 | 0.32 |
| Gelatin | 1.63 |

6th Layer: Intermediate Layer

| | |
|---|---|
| Gelatin | 1.06 |

7th Layer: First Green-sensitive Emulsion Layer

| | |
|---|---|
| Silver iodobromide emulsion (AgI content = 6 mole %; average grain size = 0.8μ) | 0.35 (silver) |
| Sensitizing dye V | $3.0 \times 10^{-5}$ |
| Sensitizing dye VI | $1.0 \times 10^{-4}$ |

-continued

| | |
|---|---|
| Sensitizing dye VII | $3.8 \times 10^{-4}$ |
| C-6 | 0.120 |
| C-1 | 0.021 |
| C-7 | 0.030 |
| C-8 | 0.025 |
| HBS-1 | 0.20 |
| Gelatin | 0.70 |

8th Layer: Second Green-sensitive Emulsion Layer

| | |
|---|---|
| Silver iodobromide emulsion (AgI content = 5 mole %; average grain size = 0.85μ) | 0.75 (silver) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| C-6 | 0.021 |
| C-8 | 0.004 |
| C-1 | 0.002 |
| C-7 | 0.003 |
| HBS-1 | 0.15 |
| Gelatin | 0.80 |

9th Layer: Third Green-sensitive Emulsion Layer

| | |
|---|---|
| Silver iodobromide emulsion (AgI content = 10 mole %; average grain size = 1.5μ) | 1.80 (silver) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| C-16 | 0.012 |
| C-1 | 0.001 |
| HBS-2 | 0.69 |
| Gelatin | 1.74 |

10th Layer: Yellow Filter Layer

| | |
|---|---|
| Yellow colloidal silver | 0.05 (silver) |
| 2,5-Di-tert-pentadecylhydroquinone | 0.03 |
| Gelatin | 0.95 |

11th Layer: First Blue-sensitive Emulsion Layer

| | |
|---|---|
| Silver iodobromide emulsion (AgI content = 6 mole %; average grain size = 0.6μ) | 0.24 (silver) |
| Sensitizing dye VIII | $3.5 \times 10^{-4}$ |
| C-9 | 0.27 |
| C-8 | 0.005 |
| HBS-1 | 0.28 |

-continued

| | |
|---|---|
| Gelatin | 1.28 |

12th Layer: Second Blue-sensitive Emulsion Layer

| | |
|---|---|
| Silver iodobromide emulsion (AgI content = 10 mole %; average grain size = 1.0μ) | 0.45 (silver) |
| Sensitizing dye VIII | $2.1 \times 10^{-4}$ |
| C-9 | 0.098 |
| HBS-1 | 0.03 |
| Gelatin | 0.46 |

13th Layer: Third Blue-sensitive Emulsion Layer

| | |
|---|---|
| Silver iodobromide emulsion (AgI content = 10 mole %; average grain size = 1.8μ) | 0.77 (silver) |
| Sensitizing dye VIII | $2.2 \times 10^{-4}$ |
| C-9 | 0.036 |
| HBS-1 | 0.07 |
| Gelatin | 0.69 |

14th Layer: First Protective Layer

| | |
|---|---|
| Silver iodobromide emulsion (AgI content = 1 mole %; average grain size = 0.07μ) | 0.5 (silver) |
| U-1 | 0.11 |
| U-2 | 0.17 |
| Butyl p-hydroxybenzoate | 0.012 |
| HBS-1 | 0.90 |

15th Layer: Second Protective Layer

| | |
|---|---|
| Particles of polymethylmethacrylate (diameter = about 1.5 μm) | 0.54 |
| S-1 | 0.15 |
| S-2 | 0.10 |
| Gelatin | 0.72 |

To each layers, there are added a gelatin hardening agent H-1 and a surfactant in addition to the aforementioned components.

Samples N2 and N3

These Samples N2 and N3 were prepared according to the same procedures as those for preparing Sample N1 except that C-10 used in the compositions of the third and fourth layers was replaced with C-11 and C-12 respectively.

U-1

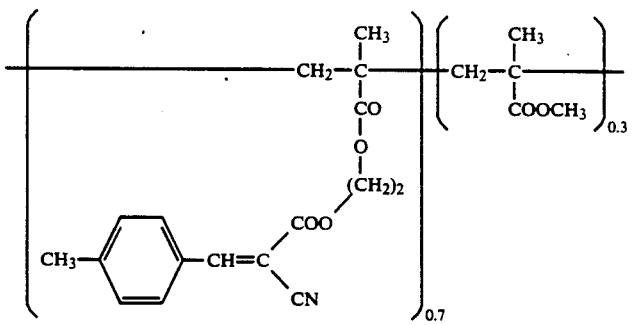

-continued
U-2
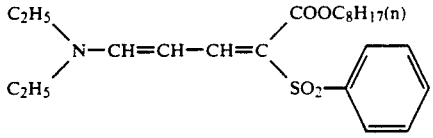
C-1
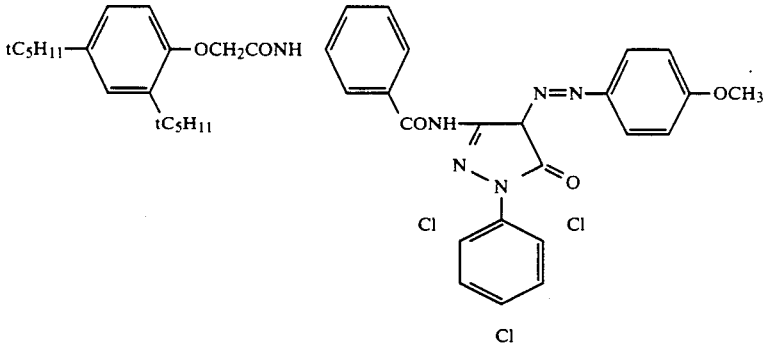
C-2
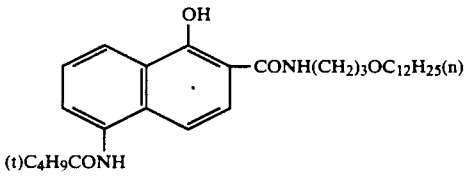
C-3
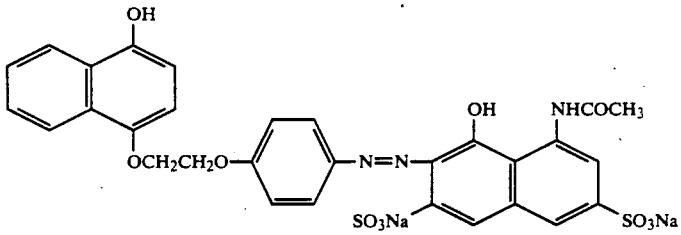
C-4
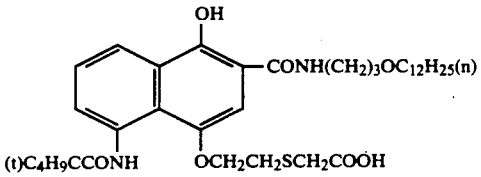
C-5
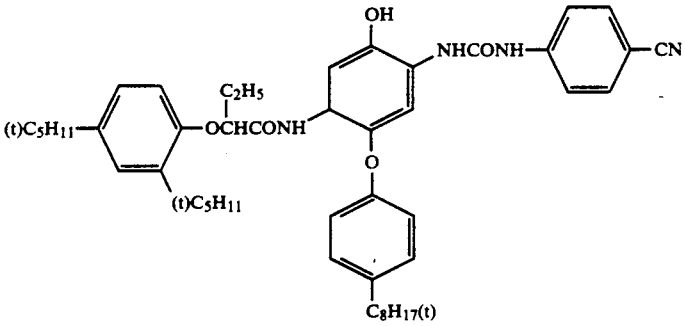

-continued
C-6
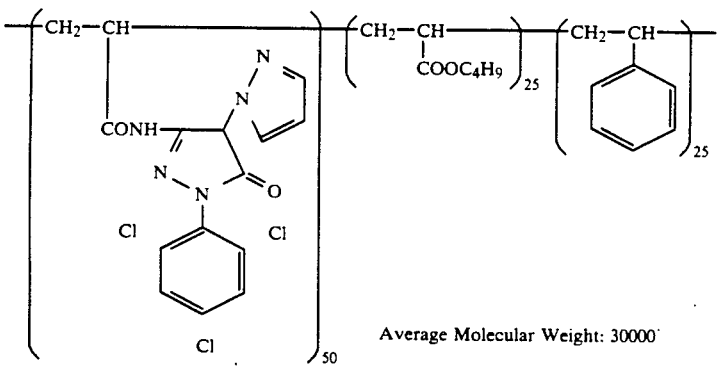
Average Molecular Weight: 30000
C-7
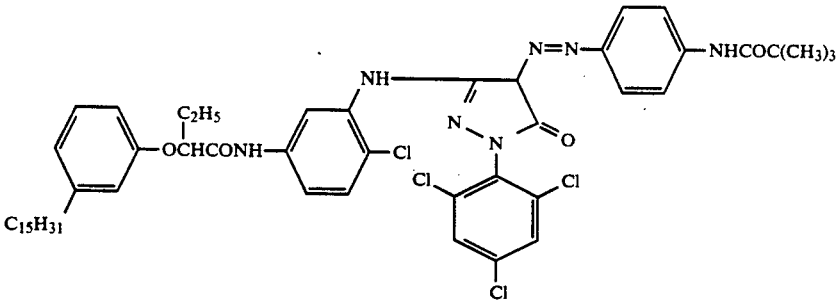
(The coupler disclosed in U.S. Pat. No. 4,477,563)
C-8
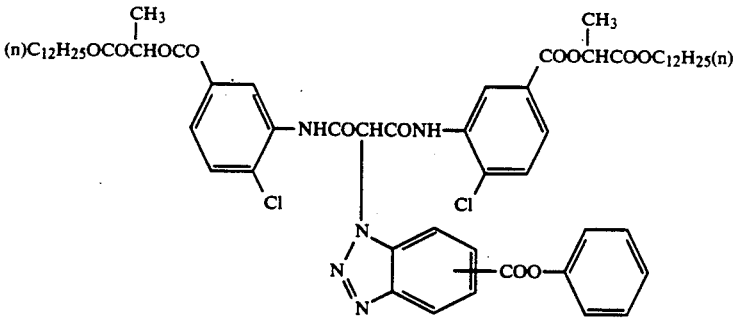
C-9
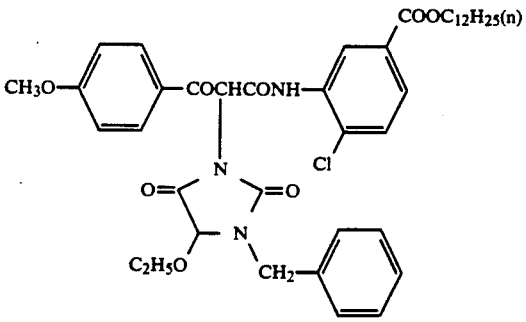

-continued
C-10
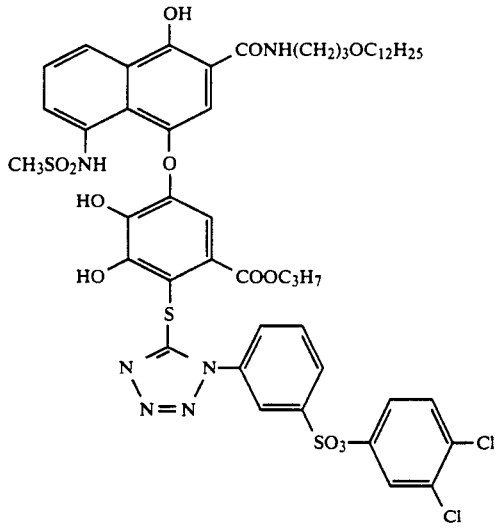
C-11
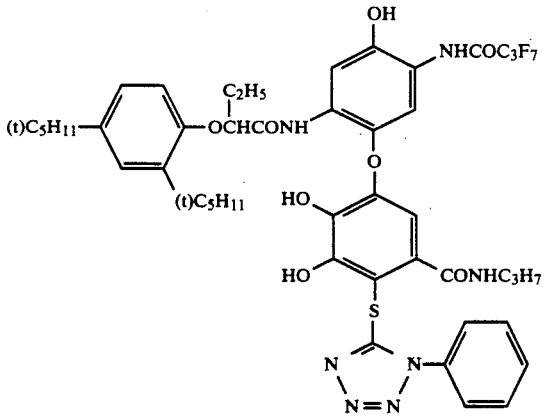
(The coupler disclosed in U.S. Pat. No. 3,227,554)
C-12
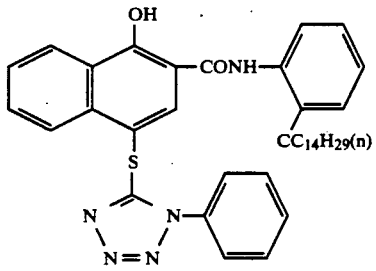
C-13
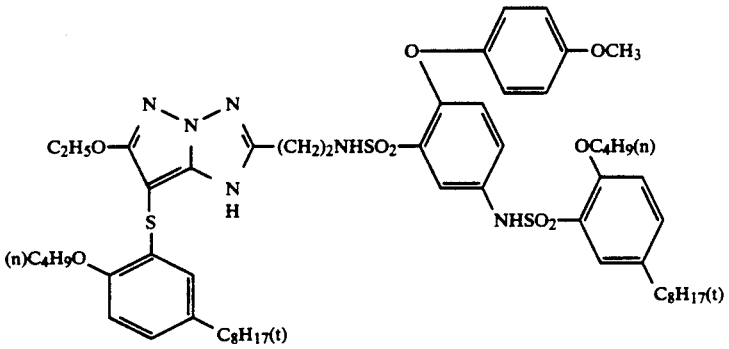

-continued
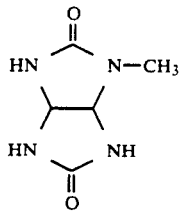
S-1
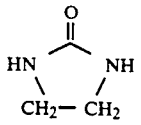
S-2
Tricredyl Phosphate HBS-1
Dibutylphthalate HBS-2
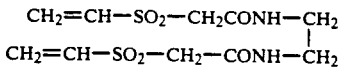
H-1
Sensitizing Dye
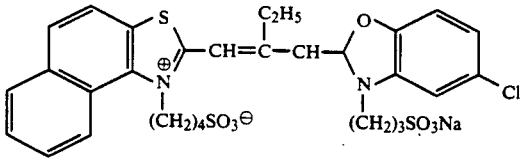
I
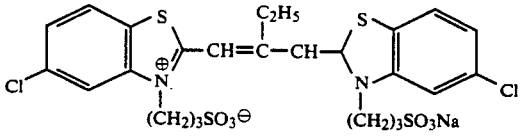
II
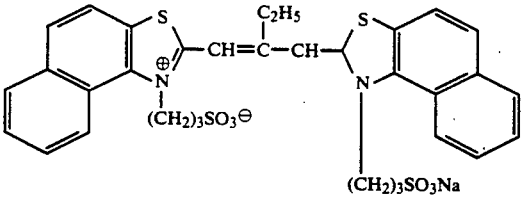
III
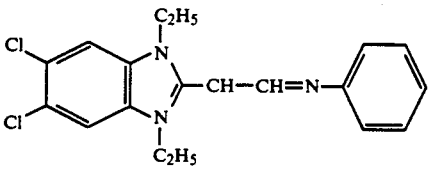
IV
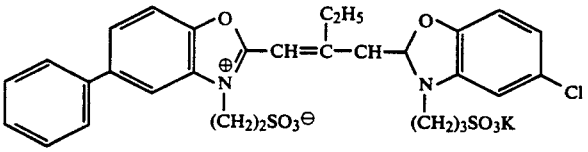
V
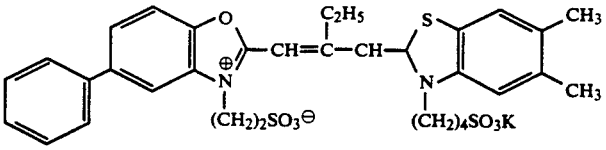
VI -continued

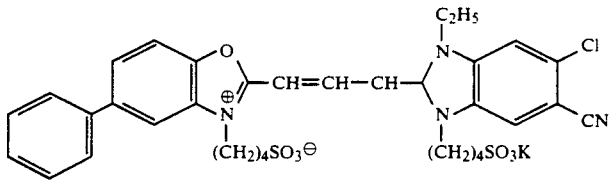

VII

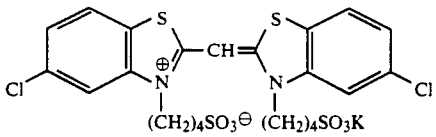

VIII

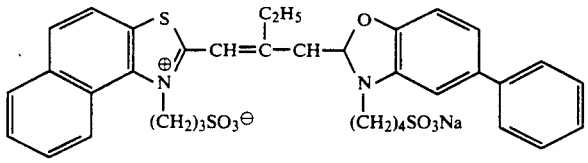

IX

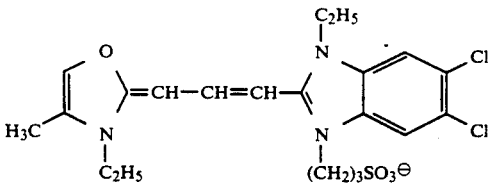

X

Color negative films thus prepared (Samples N1, N2 and N3) were cut in long band-like films of 35 mm in width. Then, a standard object was photographed in the open air using the color negative film (Sample N1). Thereafter, the color negative film was processed, by an autodeveloping machine, according to the processing steps shown in Table 12 and utilizing processing liquids given below.

TABLE 12

| Steps | Processing Steps: Processing Time | Processing Temp. (°C.) | Tank Volume (l) | Amount Replenished* (ml) |
|---|---|---|---|---|
| Color Development | 2 min. 30 sec. | 38 | 8 | 15 |
| Bleaching-Fixing | 3 min. | 38 | 8 | 25 |
| Water Washing (1) | 30 sec. | 35 | 4 | (see Table 13) |
| Water Washing (2) | 30 sec. | 35 | 4 | |
| Water Washing (3) | 30 sec. | 35 | 4 | |
| Stabilization | 30 sec. | 35 | 4 | 5 |

*This was expressed as the amount per unit length (1 m) of the photosensitive material (width: 35 mm).

In the foregoing processing steps, water washing steps (1) to (3) were carried out according to counter-current water washing system from (3) to (1). Each processing liquid had the following composition:

| Component | Mother Liquor (g) | Replenishing Liquid (g) |
|---|---|---|
| (Color Developing Liquid) | | |
| Diethylenetriamine-pentaacetic acid | 1.0 | 1.1 |

-continued

| Component | Mother Liquor (g) | Replenishing Liquid (g) |
|---|---|---|
| 1-hydroxyethylidene-1,1-diphosphonic acid | 2.0 | 2.2 |
| Sodium sulfite | 4.0 | 4.9 |
| Potassium carbonate | 30.0 | 42.0 |
| Potassium bromide | 1.6 | — |
| Potassium iodide | 2.0 (mg) | — |
| Hydroxylamine | 2.4 | 3.6 |
| 4-(N-ethyl-N-β-hydroxyethylamino)-2-methylaniline, sulfate | 5.0 | 7.3 |
| Water (Amount required to obtain 1 liter of the intended solutions) | | |
| pH | 10.00 | 10.05 |
| (Bleaching-Fixing Liquid) | | |
| Ferric ammonium ethylenediamine-tetraacetate | 60.0 | 66.0 |
| Disodium ethylenediaminetetraacetate | — | — |
| Sodium sulfite | 12.0 | 20.0 |
| Ammonium thiosulfate (70% (w/v) aqueous solution) | 220 (ml) | 250 (ml) |
| Ammonium nitrate | 10.0 | 12.0 |
| Bleaching agent | 0.5 | 0.7 |

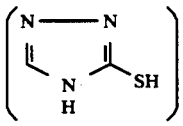

| | | |
|---|---|---|
| Aqueous ammonia | 13.0 (ml) | 12.0 (ml) |
| Water (Amount required to form 1 liter of these solutions) | | |
| pH | 6.7 | 6.5 |
| (Stabilization Solution) | | |
| Formalin (37% w/v) | 2.0 ml | |
| Polyoxyethylene-p-monononyl phenyl ether (average degree of polymerization = 10) | | 0.3 g |
| EDTA.2Na | | 0.05 g |
| Water | | to 1 |

-continued

| Component | Mother Liquor (g) | Replenishing Liquid (g) |
|---|---|---|
| pH | | 5.0–8.0 |

Water washing processes and other conditions of processing were shown in Table 13 below.

TABLE 13

| Running | Conditions of Processing: Amount carried over from the Preceding Bath (A) *3 | Amount of Water Replenishing (B) *4 | Ratio (B/A) | Properties of Washing Water and Replenishing Washing Water | Amount Processed |
|---|---|---|---|---|---|
| 1 | 2 ml | 1000 ml | 500 | tap water *5 | 30 m/day × 10 days |
| 2 | 2 ml | 1000 ml | 500 | ion exchange water *6 | 30 m/day × 10 days |
| 3 | 2 ml | 100 ml | 50 | tap water *5 | 30 m/day × 10 days |
| 4 | 2 ml | 100 ml | 50 | ion exchange water *6 | 30 m/day × 10 days |
| 5 | 2 ml | 20 ml | 10 | tap water *5 | 30 m/day × 10 days |
| 6 | 2 ml | 20 ml | 10 | ion exchange water *6 | 30 m/day × 10 days |

*3 This is the same as that disclosed in Example 3.
*4 This is the value on the basis of the unit length (1 m) of the processed photosensitive material (width = 35 mm).
*5 The properties of tap water were as follows:
pH 7.4
Ca ions 35 mg/l
Mg ions 6 mg/l
*6 This ion exchange water was obtained by treating the foregoing tap water with an Na-type strong acidic cation exchange resin (manufactured and sold under the trade name of Diaion SE-1B by MITSUBISHI CHEMICAL INDUSTRIES LTD.) and had the following properties:
pH 6.9
Ca ions 2.5 mg/l
Mg ions 0.8 mg/l After continuing the processing as shown in Table 13 for 10 days, the concentrations of calcium and magnesium in the final water washing bath (third bath) were determined according to atomic-absorption spectroscopy as well as the turbidity of water in each of the water washing baths was also inspected.

Thereafter, the color negative films N1, N2 and N3 were processed and then these films were examined on whether the proliferation of mold on the processed color negative films was observed or not when they were maintained under high temperature and humidity conditions. Results obtained are shown in the following Table 14.

TABLE 14

| | Running | Concn. in the Final Water Washing Bath: Calcium | Magnesium | Ratio (B/A) | Turbidity of the Washing Water | Kind of Color Negative Film | Proliferation of Mold |
|---|---|---|---|---|---|---|---|
| Comparative Example | 1 | 34 mg/l | 7 mg/l | 160 | (−) | N1 | (+) |
| | | | | | | N2 | (+) |
| | | | | | | N3 | (+) |
| Comparative Example | 2 | 2.5 mg/l | 0.8 mg/l | 160 | (−) | N1 | (+) |
| | | | | | | N2 | (+) |
| | | | | | | N3 | (+) |
| Comparative Example | 3 | 27 mg/l | 8 mg/l | 50 | (+) | N1 | (+) |
| | | | | | | N2 | (+) |
| | | | | | | N3 | (++) |
| Present Invention | 4 | 2.7 mg/l | 0.9 mg/l | 50 | (−) | N1 | (−) |
| | | | | | | N2 | (−) |
| | | | | | | N3 | (+) |
| Comparative Example | 5 | 24 mg/l | 7 mg/l | 10 | (++) | N1 | (++) |
| | | | | | | N2 | (++) |
| | | | | | | N3 | (+++) |
| Present Invention | 6 | 2.9 mg/l | 1.1 mg/l | 10 | (−) | N1 | (−) |
| | | | | | | N2 | (−) |
| | | | | | | N3 | (−) |

The meanings of the ideograms (−), (+), (++) and (+++) appearing in this Table have already been given above in connection with Table 11.

As seen from the results given in Table 14, it is clear that the invention makes it possible to substantially suppress the turbidity of the washing water and the proliferation of mold on the color negative films tested by limiting the amount of calcium and magnesium coexisting in the washing water if the ratio (B/A) is 50 and 10 which are within the range defined in the present invention.

EXAMPLE 5

Color paper and color negative films were prepared according to the same procedures as those in Example 1 or Example 4 except that the yellow couplers, cyan couplers and magenta couplers as used therein were partially or completely replaced with those listed below and the resulting color paper and color negative films were developed in accordance with those described in Example 1 or 4 except for using a desalted water which fulfilled the requirements defined in the present invention to wash the processed paper or films. The same excellent results as in Examples 1 and 4 were obtained.
Yellow Coupler
(Y-1)
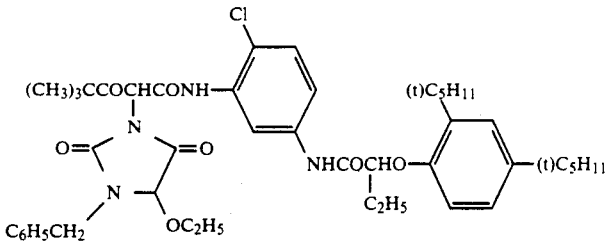
(Y-2)
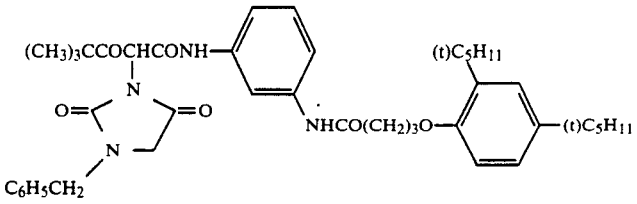
(Y-3)
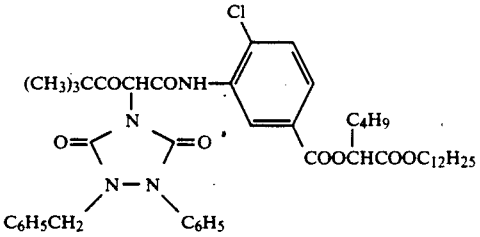
Magenta Coupler
(M-1)
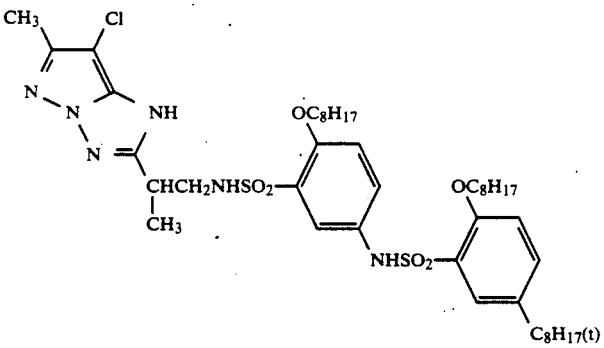
(M-2)
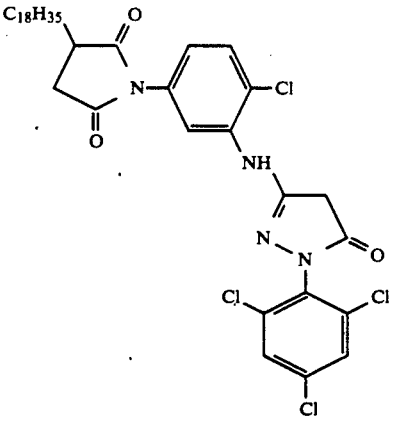

-continued
(M-3)
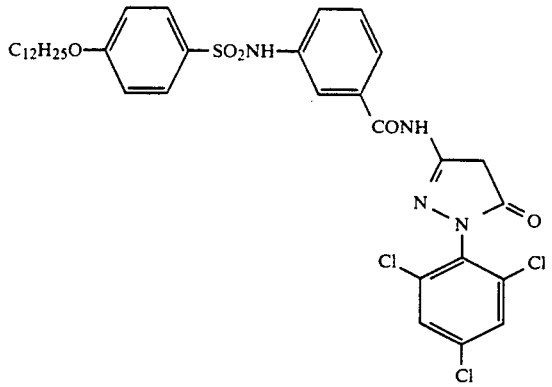
(M-4)
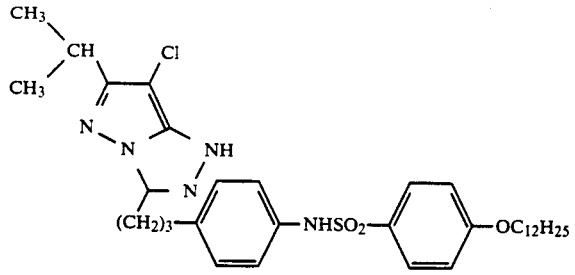
Cyan Coupler
(C-1)
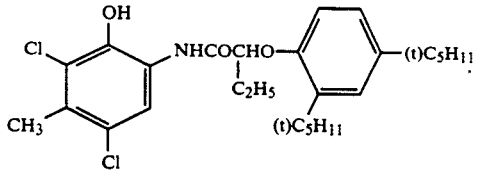
(C-2)
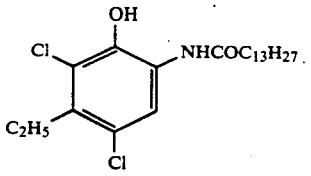
(C-3)
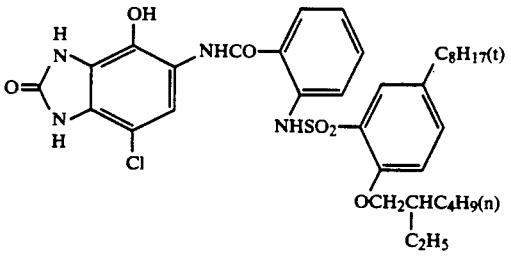
(C-4)
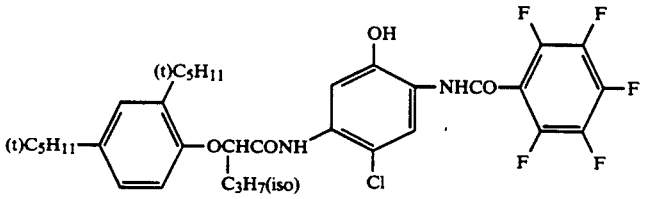

-continued

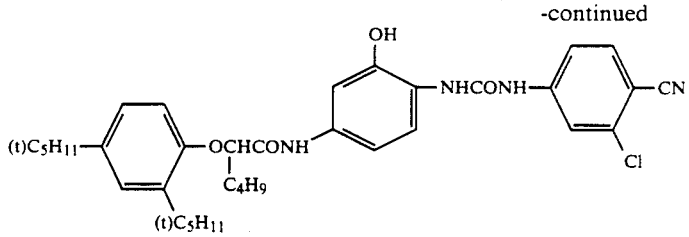

(C-5)

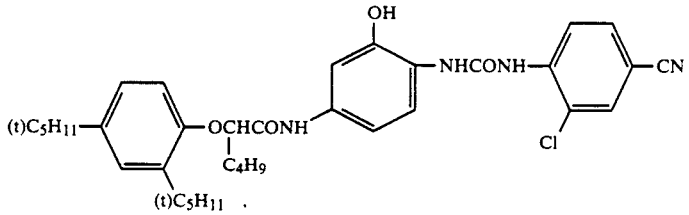

(C-6)

EXAMPLE 6

The procedures as described in Example 4 were repeated except that the following processing steps and a developer, a bleaching liquid and a bleaching-fixing liquid having compositions described below were employed. Accordingly, the water washing process of the present invention provided excellent results as in the case of Example 4.

TABLE 15

| Processing Steps (Temp. = 38° C.) | | | |
|---|---|---|---|
| Step | Processing Time | Tank Volume (l) | Amount Replenished* (ml) |
| Color Development | 3 min. 15 sec. | 10 | 38 |
| Bleaching | 1 min. | 4 | 18 |

TABLE 15-continued

| Processing Steps (Temp. = 38° C.) | | | |
|---|---|---|---|
| Step | Processing Time | Tank Volume (l) | Amount Replenished* (ml) |
| Bleaching-Fixing | 3 min. 15 sec. | 10 | 27 |
| Water Washing (1) | 40 sec. | 4 | — |
| Water Washing (2) | 1 min. | 4 | 27 |
| Stabilization | 40 sec. | 4 | 18 |

*This value is expressed as that per unit length (1 m) of the color photographic paper (35 mm in width).

In the foregoing processing steps, the water washing steps (1) and (2) were carried out according to countercurrent washing system from (2) to (1). Moreover, overflow liquid associated with the replenishment of the bleaching liquid was introduced into the bleaching-fixing bath.

| (Color Developing Liquid) | | |
|---|---|---|
| Component | Mother Liquor (g) | Replenishing Liquid (g) |
| Diethylenetriamine-pentaacetic acid | 1.0 | 1.1 |
| 1-Hydroxyethylidene-1,1-diphosphonic acid | 2.0 | 2.2 |
| Sodium sulfite | 4.0 | 4.9 |
| Potassium Carbonate | 30.0 | 36.0 |
| Potassium bromide | 1.6 | 0.7 |
| Potassium iodide | 2.0 (mg) | — |
| Hydroxylamine | 2.4 | 3.6 |
| 4-(N-Ethyl-N-β-hydroxy-ethylamino)-2-methylaniline. sulfate | 5.0 | 5.5 |
| Water | (Amount required to form 1 liter of the intended solutions) | |
| pH | 10.0 | 10.05 |

| (Bleaching Liquid) | |
|---|---|
| Component | Mother Liquor and Replenishing Liquid (g) |
| Ammonium bromide | 100 |
| Ferric ammonium ethylenediamine-tetraacetate | 120 |
| Disodium ethylenediaminetetraacetate | 10.0 |
| Ammonium nitrate | 10.0 |
| Bleaching accelerator $(N(CH_3)_2—(CH_2)_2—S—S—(CH_2)_2—N(CH_3)_2)$ | 2.0 |
| Aqueous ammonia | 17.0 (ml) |
| Water | (Amount required to form 1 liter of the intended solution) |
| pH | 6.5 |

(Bleaching-Fixing Liquid)

-continued

| Component | Mother Liquor (g) | Replenishing Liquid (g) |
|---|---|---|
| Ammonium bromide | 50.0 | — |
| Ferric ammonium ethylenediaminetetraacetate | 50.0 | — |
| Disodium ethylenediaminetetraacetate | 5.0 | 1.0 |
| Ammonium nitrate | 5.0 | — |
| Sodium sulfite | 12.0 | 20.0 |
| Aqueous ammonium thiosulfate solution (70%) | 240 (ml) | 400 (ml) |
| Aqueous ammonia | 10.0 (ml) | — |
| Water | (Amount required to obtain 1 liter of the intended solution) | |
| pH | 7.3 | 8.0 |

EXAMPLE 7

A multilayered color photographic paper (hereunder referred to as Sample $P_5$) having a layer structure as described in the following Table 15 was prepared on a paper substrate, both surfaces of which were laminated with polyethylene films. Each of coating liquids used in this Example was prepared according to the following procedures:

Sample $P_5$

Preparation of Coating Liquid for 1st Layer

As yellow coupler (a) (19.1 g) and a dye image stabilizer (b) (4.4 g) were added to and dissolved in 27.2 ml of ethyl acetate and 7.9 ml of solvent (c) and the resultant solution was dispersed in 185 ml of 10% aqueous gelatin solution containing 8 ml of 10% sodium dodecylbenzenesulfonate solution to form an emulsion. On the other hand, 90 g of a blue-sensitive emulsion was prepared by adding the blue-sensitive sensitizing dye as used in Example 1 to a silver chlorobromide emulsion (AgBr content=80 mole %; Ag content=70 g/kg emulsion) in an amount of $7.0\times10^{-4}$ moles per one mole of the silver chlorobromide. The emulsified dispersion and the blue-sensitive emulsion prepared above were admixed with each other and the concentration of gelatin was controlled so as to consist with the composition listed in Table 16 to obtain a coating liquid for first layer.

Coating liquids for second to seventh layers were also prepared in accordance with procedures similar to those for preparing the first coating liquid. In each of these layers, sodium salt of 1-oxy-3,5-dichloro-s-triazine was used as a hardening agent for gelatin.

In this Example 7, spectral sensitizing agents, dyes as an irradiation resistant dyes used for each emulsion were the same as those used in Example 1 provided that in the blue-sensitive emulsion layer the corresponding compound was used in an amount of $7.0\times10^{-4}$ moles per unit mole of silver halide.

The structures of the compounds such as couplers or the like have already been described with respect to Example 1 except for the following compounds:

Red-sensitive Emulsion Layer

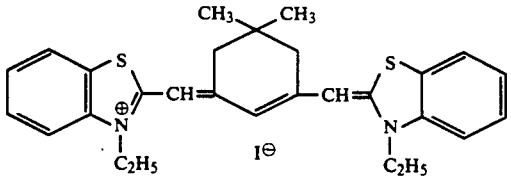

Yellow Coupler (a)

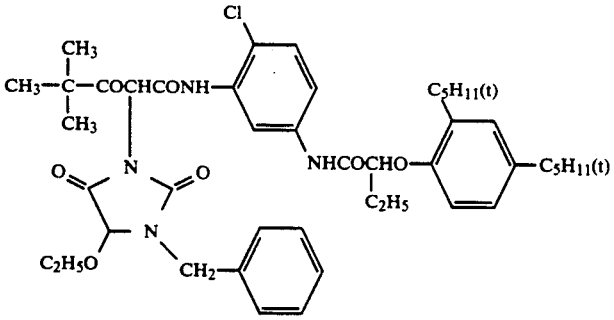

Magenta Coupler (e)

-continued

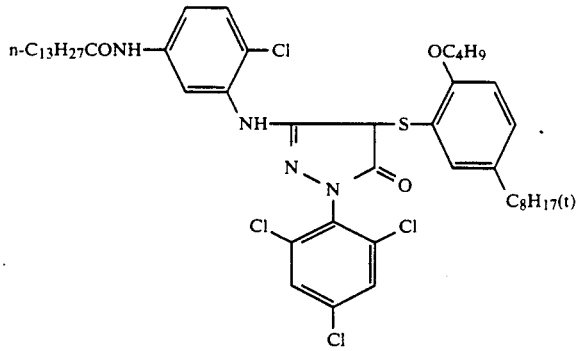

TABLE 16

| Layer | Principal Composition | Amount Used |
|---|---|---|
| 7th layer (Protective layer) | Gelatin | 1.33 g/m$^2$ |
| | Acrylic acid modified polyvinyl alcohol copolymer (degree of modification = 17%) | 0.17 g/m$^2$ |
| 6th layer (UV absorbing layer) | Gelatin | 0.54 g/m$^2$ |
| | UV absorber (h) | 0.21 g/m$^2$ |
| | Solvent (j) | 0.09 g/m$^2$ |
| 5th layer (Red-sensitive layer) | Silver chlorobromide emulsion (AgBr content = 70 mole %) | 0.26 g/m$^2$ (Ag) |
| | Gelatin | 0.98 g/m$^2$ |
| | Cyan coupler (k) | 0.38 g/m$^2$ |
| | Dye image stabilizer (l) | 0.17 g/m$^2$ |
| | Solvent (m) | 0.23 cc/m$^2$ |
| 4th layer (UV absorbing layer) | Gelatin | 1.60 g/m$^2$ |
| | UV absorber (h) | 0.62 g/m$^2$ |
| | Color mixing inhibitor (i) | 0.05 g/m$^2$ |
| | Solvent (j) | 0.26 cc/m$^2$ |
| 3rd layer (Green-sensitive layer) | Silver chlorobromide emulsion (AgBr content = 75 mole %) | 0.16 g/m$^2$ (Ag) |
| | Gelatin | 1.80 g/m$^2$ |
| | Magenta coupler (e) | 0.34 g/m$^2$ |
| | Dye image stabilizer (f) | 0.20 g/m$^2$ |
| | Solvent (g) | 0.68 cc/m$^2$ |
| 2nd layer (Color mixing inhibiting layer) | Gelatin | 0.99 g/m$^2$ |
| | Color mixing inhibitor (d) | 0.08 g/m$^2$ |
| 1st layer | Silver chlorobromide emulsion (AgBr content = 80 mole %) | 0.30 g/m$^2$ (Ag) |
| (Blue-sensitive layer) | Gelatin | 1.86 g/m$^2$ |
| | Yellow coupler (a) | 0.82 g/m$^2$ |
| | Dye image stabilizer (b) | 0.19 g/m$^2$ |
| | Solvent (c) | 0.34 cc/m$^2$ |
| Substrate | Paper laminated with polyethylene films (the polyethylene film situated at the side of 1st layer contains a white pigment ($TiO_2$) and a bluing dye (Ultramarine Blue)) | |

The multilayered color photographic paper thus prepared was cut into long band-like paper of 82.5 mm in width, they were then exposed to light using an autoprinter and thereafter processed by an autodeveloping machine according to the following processing steps shown in Table 17 below.

TABLE 17

| Step | Processing Steps: Temp. (°C.) | Pro-cessing Time | Tank Volume (l) | Amount Replenished* (ml) |
|---|---|---|---|---|
| Color Development | 38 | 1 min. 40 sec. | 16 | 24 |
| Bleaching-Fixing | 33 | 1 min. | 10 | 13 |

TABLE 17-continued

| Step | Processing Steps: Temp. (°C.) | Pro-cessing Time | Tank Volume (l) | Amount Replenished* (ml) |
|---|---|---|---|---|
| Water Washing (1) | 33 | 20 sec. | 3.5 | three-stage countercurrent water washing system |
| Water Washing (2) | 33 | 20 sec. | 3.5 | |
| Water Washing (3) | 33 | 20 sec. | 3.5 | 30 |

*The amount is expressed as that per unit length (1 m) of the processed color photographic paper (82.5 mm in width).

In the above processing, the amount of the bleaching-fixing liquid carried over in the washing bath (1) by the processed color photographic paper from the bleaching-fixing bath was 2.5 ml per unit length (1 m) of the photographic paper (82.5 mm in width) and the amount of washing water replenished was 12 times of the amount of bleaching-fixing liquid carried over.

Each of the processing liquids used in these steps had the following composition.

| Component | Mother Liquor | Replenishing Liquid |
|---|---|---|
| (Color Developing Liquid) | | |
| Water | 800 ml | 800 ml |
| 1-Hydroxyethylidene-1,1-diphosphonic acid (60% solution) | 1.5 ml | 1.5 ml |
| Diethylenetriaminepenta-acetic acid | 1.0 g | 1.0 g |
| Benzyl alcohol | 16 ml | 20 ml |
| Ethylene glycol | 10 ml | 10 ml |
| Sodium sulfite | 2.0 g | 2.5 g |
| Hydroxylamine sulfate | 3.0 g | 3.5 g |
| Potassium bromide | 1.0 g | — |
| Sodium carbonate | 30 g | 35 g |
| Disodium 4,5-dihydroxy-m-benzenedisulfonate | 1.0 g | 1.1 g |
| Fluorescent whitener (stilbene type) | 1.0 g | 1.5 g |
| N-Ethyl-N-(β-methane-sulfonamidethyl)-3-methyl-4-aminoamiline.sulfate | 6.0 g | 8.0 g |
| Water (Amount required to obtain 1 liter of the intended liquids) | | |
| pH | 10.25 | 10.60 |
| (Bleaching-Fixing Liquid) | | |
| Water | 400 ml | 400 ml |
| Ammonium thiosulfate (70% solution) | 150 ml | 200 ml |
| Sodium sulfate | 18 g | 25 g |
| Ferric ammonium ethylenediaminetetra acetic acid | 55 g | 65 g |
| Ethylenediaminetetraacetic acid | 5 g | 10 g |

-continued

| Component | Mother Liquor | Replenishing Liquid |
|---|---|---|
| Water (Amount required to obtain one liter of the intended liquids) | | |
| pH (Aqueous ammonia or acetic acid) | 6.75 | 6.50 |

Washing Water (A) Well water having the following properties was passed through a column packed with H-type strong acidic cation exchange resin (manufactured and sold under the trade name of Diaion SA-1B by MITSUBISHI CHEMICAL INDUSTRIES LTD.) and OH-type strong basic anion exchange resin (manufactured and sold under the trade name of Diaion SA-10A by MITSUBISHI CHEMICAL INDUSTRIES LTD.) to soften the well water and the resultant soft water was used as the washing water (hereunder referred to as washing water (A)).

TABLE 18

| | Properties of the Washing Water | |
|---|---|---|
| | Before Ion Exchange | After Ion Exchange |
| pH | 6.8 | 6.6 |
| Calcium ions | 31 mg/l | 0.4 mg/l |
| Magnesium ions | 11 mg/l | 0.1 mg/l |
| Chlorine ions | 30 mg/l | 0.6 mg/l |
| Residue after evaporation | 150 mg/l | 8.7 mg/l |

(B) Washing water (B) was prepared by adding sodium dichloroisocyanurate to the foregoing ion exchange water (washing water (A)) in an amount of 10 mg per liter of the latter.

(C) Washing water (c) was prepared by adding silver nitrate to the washing water (A) in an amount of 0.3 mg/l.

(D) Washing water (D) was obtained by adding sodium dichloroisocyanurate to the well water prior to subjecting it to ion exchange treatment in an amount of 10 mg/l.

The color photographic paper described above was processed at a rate of 180 m/day for 6 days using each of the foregoing washing water (A) to (D) and those to which calcium chloride ($CaCl_2.2H_2O$) and magnesium chloride ($MgCl_2.6H_2O$) were added so that the concentrations thereof were consistent with those listed in the following Table 19.

Thereafter, each washing water was collected in a test tube, followed by maintaining at room temperature (about 25° C.) and term (days) which elapsed until the formation of a bacterial floating matter on the surface of the collected water was observed were determined.

TABLE 19

| | No. | Washing Water | Ca Concn. (Mg/l) | Mg Concn. (mg/l) | Term (days) elapsed till the Formation of Bacterial floating matter was observed |
|---|---|---|---|---|---|
| Present Invention | 1 | A | 1.1 | 0.3 | 5 days |
| Present Invention | 2 | A | 3 | 3 | 5 days |
| Present Invention | 3 | A | 5 | 5 | 4 days |
| Comparative | 4 | A | 10 | 10 | 2 days |

TABLE 19-continued

| | No. | Washing Water | Ca Concn. (Mg/l) | Mg Concn. (mg/l) | Term (days) elapsed till the Formation of Bacterial floating matter was observed |
|---|---|---|---|---|---|
| Example | | | | | |
| Present Invention | 5 | B | 0.9 | 0.4 | at least 10 days |
| Present Invention | 6 | B | 2 | 2 | at least 10 days |
| Present Invention | 7 | B | 3 | 3 | at least 10 days |
| Present Invention | 8 | B | 5 | 5 | 7 days |
| Comparative Example | 9 | B | 10 | 10 | 2 days |
| Present Invention | 10 | C | 1.2 | 0.5 | at least 10 days |
| Present Invention | 11 | C | 3 | 3 | at least 10 days |
| Present Invention | 12 | C | 5 | 5 | 6 days |
| Comparative Example | 13 | C | 10 | 10 | 2 days |
| Comparative Example | 14 | D | 31 | 9 | 1 day |

As shown in Table 19, it is clear that the formation of bacterial floating matter is substantially suppressed by reducing the concentrations of calcium and magnesium to not more than 5 mg/l respectively and simultaneously sterilizing the washing water.

EXAMPLE 8

The procedures similar to those in Example 6 were repeated except that a photographic paper (hereunder referred to as Sample $P_6$) prepared according to a manner given below was used instead of the color photographic paper $P_5$ and that the mother liquor and the replenishing liquid for color development from which benzyl alcohol and ethylene glycol were removed were used and the same test as in Example 7 was carried out. Results obtained are summarized in the following Table 20-2.

Sample $P_6$

On a paper substrate, both surface of which were laminated with polyethylene films, a multilayered color photographic paper having a layer structure shown in Table 20-1 was prepared. The coating liquids used were prepared according to the following procedures:

Preparation of Coating Liquid for 1st Layer

An yellow coupler (a) (19.1 g) and a dye image stabilizer (b) (4.4 g) were added to and dissolved in 27.2 cc of ethyl acetate and 7.7 cc of solvent (c) and the resultant solution was dispersed in 185 cc of 10% aqueous gelatin solution containing 8 cc of 10% sodium dodecylbenzenesulfonate solution to form an emulsion. On the other hand, another emulsion was prepared by adding the following blue-sensitive sensitizing dye to a silver chlorobromide emulsion (AgBr content=90.0 mole %; Ag content=70 g/kg emulsion) in an amount of $5\times10^{-4}$ moles per mole of silver halide. These two emulsions prepared above were mixed with one another and adjusting the composition so as to be coinsident with that in Table 20-1 to obtain a coating liquid for 1st layer. Other coating liquids for second to seventh layers were also prepared in the same manner as described above. As the hardening agent for gelatin in each layer, sodium salt of 1-oxy-3,5-dichloro-s-triazine was used.

As the spectral sensitizing dye in each layer, the following compounds were used.

Blue-sensitive Emulsion Layer

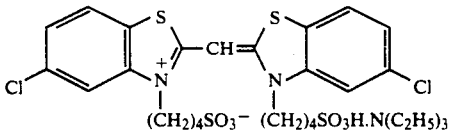

(Added amount = $5.0 \times 10^{-4}$ moles per mole of silver halide)

Green-sensitive Emulsion Layer

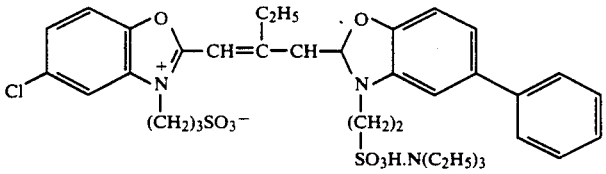

(Added amount = $4.0 \times 10^{-4}$ moles per mole of silver halide)

and

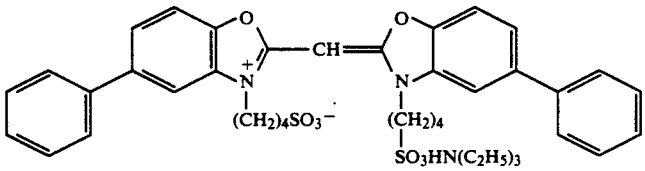

(Added amount = $7.0 \times 10^{-5}$ moles per mole of silver halide)

Red-sensitive Emulsion Layer

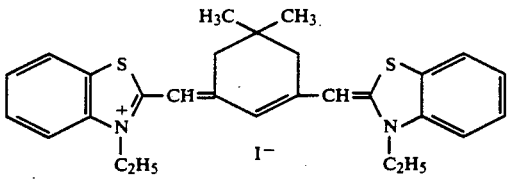

(Added amount = $0.9 \times 10^{-4}$ moles per mole of silver halide)

The following compound was added to the red-sensitive emulsion layer in an amount of $2.6 \times 10^{-3}$ moles per mole of silver halide:

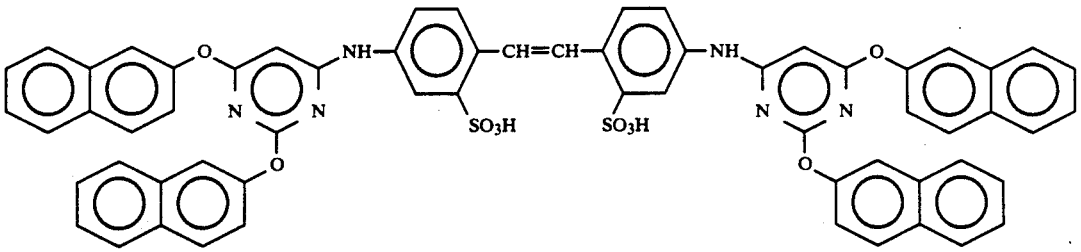

Moreover, to each of the blue-sensitive emulsion layer, the green-sensitive emulsion layer and the red-sensitive emulsion layer, there was added 1-(5-methylareidophenyl)-5-mercaptotetrazole in an amount of $8.5 \times 10^{-5}$, $7.7 \times 10^{-4}$ or $2.5 \times 10^{-4}$ moles per mole of silver halide tetrazaindene was added to the blue-sensitive emulsion layer and the green-sensitive emulsion layer in an amount of $1.2 \times 10^{-2}$ and $1.2 \times 10^{-2}$ moles per mole of silver halide respectively.

For the purpose of preventing irradiation, the following dyes were added to the emulsion layers:

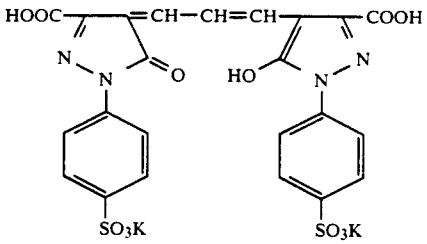

and

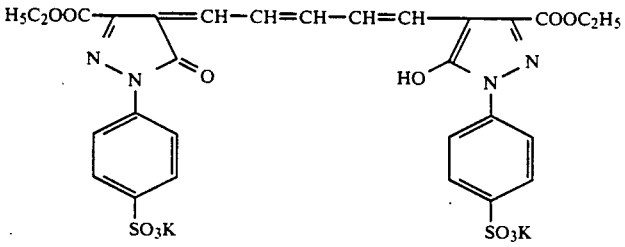

TABLE 20-1

| Layer | Principal Composition | Amount Used |
|---|---|---|
| 7th layer (Protective layer) | Gelatin | 1.33 g/m$^2$ |
| | Acrylic acid modified polyvinyl alcohol copolymer (degree of modification = 17%) | 0.17 g/m$^2$ |
| | Liquid paraffin | 0.03 g/m$^2$ |
| 6th layer (UV absorbing layer) | Gelatin | 0.53 g/m$^2$ |
| | UV absorber (i) | 0.21 g/m$^2$ |
| | Solvent (k) | 0.08 g/m$^2$ |
| 5th layer (Red-sensitive layer) | Silver halide emulsion | 0.23 g/m$^2$ (Ag) |
| | Gelatin | 1.34 g/m$^2$ |
| | Cyan coupler (l) | 0.34 g/m$^2$ |
| | Dye image stabilizer (m) | 0.17 g/m$^2$ |
| | Polymer (n) | 0.40 g/m$^2$ |
| | Solvent (o) | 0.23 g/m$^2$ |
| 4th layer (UV absorbing layer) | Gelatin | 1.58 g/m$^2$ |
| | UV absorber (i) | 0.62 g/m$^2$ |
| | Color mixing inhibitor (j) | 0.05 g/m$^2$ |
| | Solvent (k) | 0.24 g/m$^2$ |

TABLE 20-1-continued

| Layer | Principal Composition | Amount Used |
|---|---|---|
| 3rd layer (Green-sensitive layer) | Silver halide emulsion | 0.16 g/m$^2$ (Ag) |
| | Gelatin | 1.79 g/m$^2$ |
| | Magenta coupler (e) | 0.32 g/m$^2$ |
| | Dye image stabilizer (f) | 0.20 g/m$^2$ |
| | Dye image stabilizer (g) | 0.01 g/m$^2$ |
| | Solvent (h) | 0.65 g/m$^2$ |
| 2nd layer (Color mixing inhibiting layer) | Gelatin | 0.99 g/m$^2$ |
| | Color mixing inhibitor (d) | 0.08 g/m$^2$ |
| 1st layer (Blue-sensitive layer) | Silver halide emulsion | 0.26 g/m$^2$ (Ag) |
| | Gelatin | 1.83 g/m$^2$ |
| | Yellow coupler (a) | 0.83 g/m$^2$ |
| | Dye image stabilizer (b) | 0.19 g/m$^2$ |
| | Solvent (c) | 0.35 g/m$^2$ |
| Substrate | Paper laminated with polyethylene films (the polyethylene film situated at the side of 1st layer contains a white pigment ($TiO_2$) and a bluing dye (Ultramarine Blue)) | |

(a) Yellow Coupler

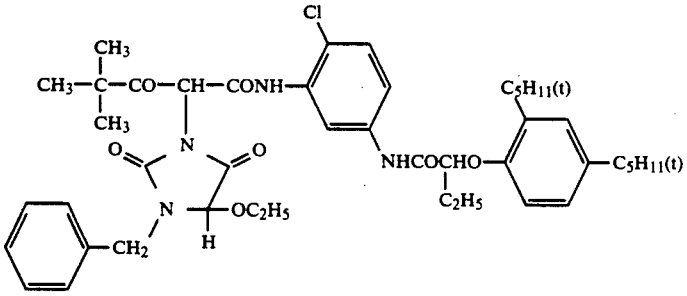

(b) Dye Image Stabilizer

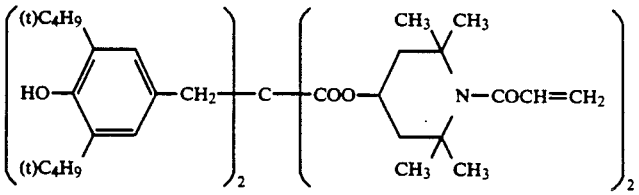

(c) Solvent

-continued
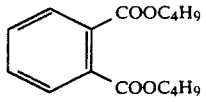
(d) Color Mixing Inhibitor
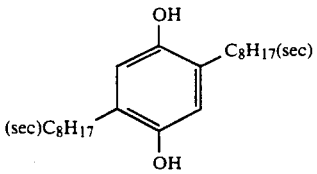
(e) Magenta Coupler
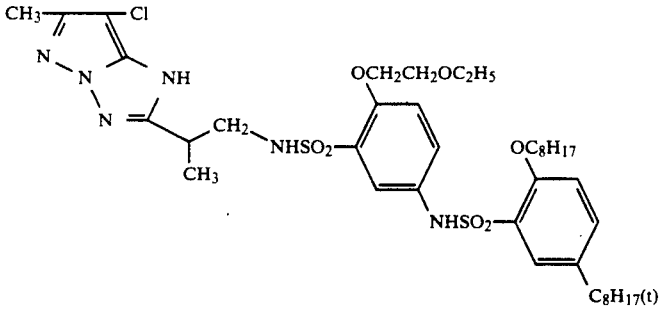
(f) Dye Image Stabilizer
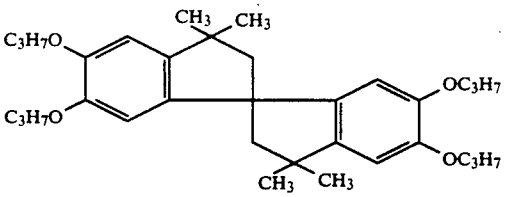
(g) Dye Image Stabilizer
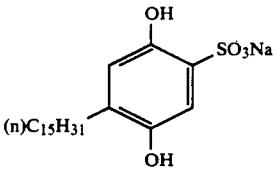
(h) Solvent
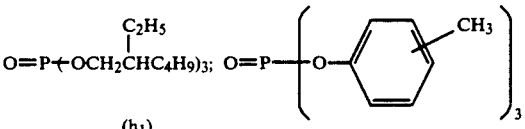
(h1) (h2)
2:1 (volume ratio) mixture of (h1) and (h2)
(i) UV Absorber
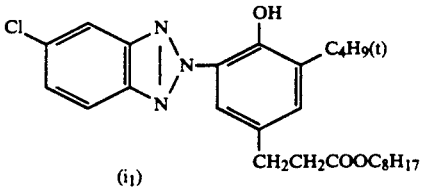
(i1)

-continued
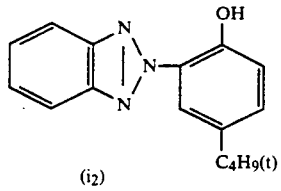
(i2)
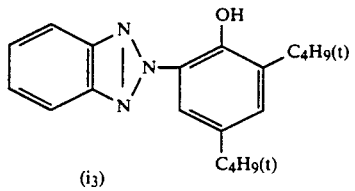
(i3)
2:9:8 (weight ratio) mixture of (i1), (i2) and (i3)
(j) Color Mixing Inhibitor
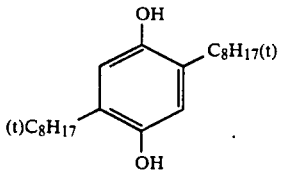
(k) Solvent
$O{=}P{\leftarrow}O{-}C_9H_{19}(iso))_3$
(l) Cyan Coupler
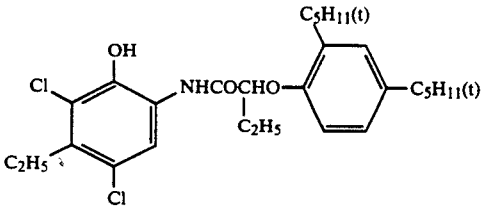
(m) Dye Image Stabilizer
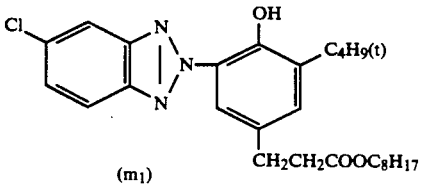
(m1)
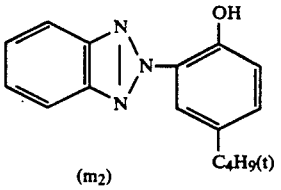
(m2)
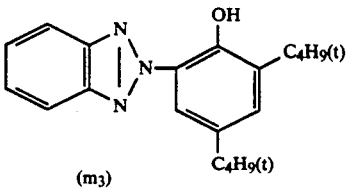
(m3)
5:8:9 (weight ratio) mixture of (m1), (m2) and (m3)
(n) Polymer
$\leftarrow CH_2{-}CH\rightarrow_n$ CONHC4H9(t) Average Molecular Weight: 35,000
(o) Solvent
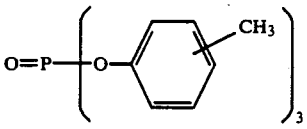

TABLE 20-2

| | No. | Washing Water | Ca Concn. (Mg/l) | Mg Concn. (mg/l) | Term (days) Elapsed Till Bacterial floating matter was Formed |
|---|---|---|---|---|---|
| Present Invention | 1 | A | 0.9 | 0.4 | 7 days |
| Present Invention | 2 | A | 3 | 3 | 7 days |
| Present Invention | 3 | A | 5 | 5 | 6 days |
| Comparative Example | 4 | A | 10 | 10 | 3 days |
| Present Invention | 5 | B | 1 | 0.5 | at least 10 days |
| Present Invention | 6 | B | 3 | 3 | at least 10 days |
| Present Invention | 7 | B | 5 | 5 | at least 10 days |
| Comparative Example | 8 | B | 10 | 10 | 3 days |
| Present Invention | 9 | C | 1.3 | 0.5 | at least 10 days |
| Present Invention | 10 | C | 3 | 3 | at least 10 days |
| Present Invention | 11 | C | 5 | 5 | 9 days |
| Comparative Example | 12 | C | 10 | 10 | 3 days |
| Comparative Example | 13 | D | 30 | 9 | 2 days |

As seen from Table 20-2, according to the processing method of this invention in which the concentration of both calcium and magnesium was not more than 5 mg/l in the washing water replenished and the latter was also sterilized, the formation of bacterial floating matter can substantially be suppressed.

EXAMPLE 9

A multilayered color photographic paper (hereunder referred to as "Sample $P_7$") having a layer structure shown in Table 21 was prepared on a paper substrate, the both surface of which were laminated with polyethylene films. Coating liquids used for preparing Sample $P_7$ were formulated as follows:

Sample $P_7$

Preparation of Coating Liquid for First Layer:

An yellow coupler (a) (19.1 g) and a dye image stabilizer (b) (4.4 g) were dissolved in 27.2 ml of ethyl acetate and 7.9 ml of solvent (c) and the resulting solution was then dispersed in 185 ml of 10% aqueous gelatin solution containing 8 ml of 10% sodium dodecylbenzenesulfonate solution to form an emulsion. On the other hand, a blue-sensitive sensitizing dye as will be shown below was added to a silver chlorobromide emulsion (AgBr content = 1 mole %; Ag content = 70 g/kg emulsion) in an amount of $5.0 \times 10^{-4}$ moles per mole of silver chlorobromide to obtain 90 g of blue-sensitive emulsion. The emulsion and the blue-sensitive emulsion separately prepared above were admixed with one another and then the gelatin concentration of the resultant mixture was adjusted so as to be in accord with that in Table 21 to form an intended coating liquid for first layer. Other coating liquids for the second to seventh layers were also prepared according to the procedures similar to those described above in connection with the coating liquid for the first layer. As the hardening agent for gelatin in each of the layers, sodium salt of 1-oxy-3,5-dichloro-s-triazine was used.

The following spectral sensitizers were used in each corresponding emulsion:

Blue-sensitive Emulsion Layer

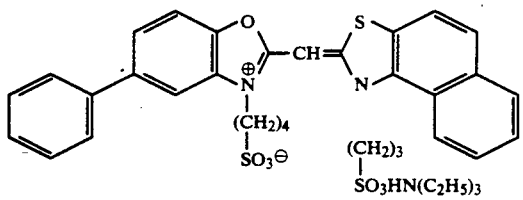

(Added amount = $7 \times 10^{-4}$ moles per mole of silver halide)

Green-sensitive Emulsion Layer

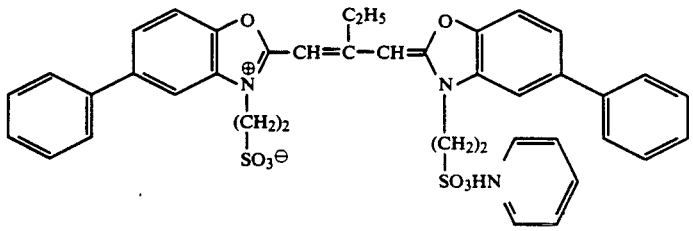

(Added amount = $4 \times 10^{-4}$ moles per mole of silver halide)

Red-sensitive Emulsion Layer

-continued

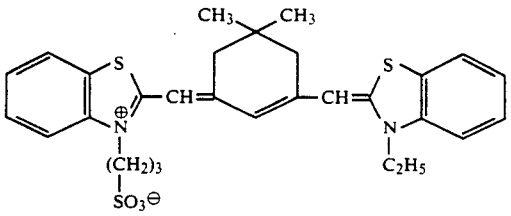

(Added amount = $2 \times 10^{-4}$ moles per mole of silver halide)

In each emulsion layer, the following dyes were used as irradiation resistant dyes respectively:

Green-sensitive Emulsion Layer

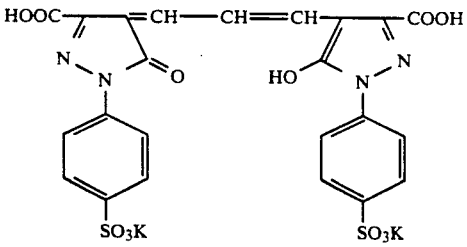

Red-sensitive Emulsion Layer

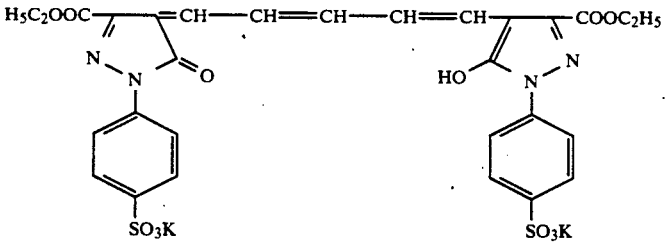

The compounds such as couplers used in the present Example had the following structural formula:

(a) Yellow Coupler

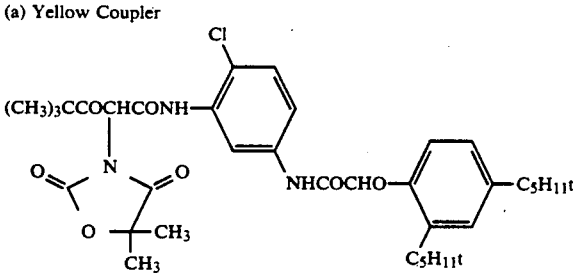

(b) Dye Image Stabilizer

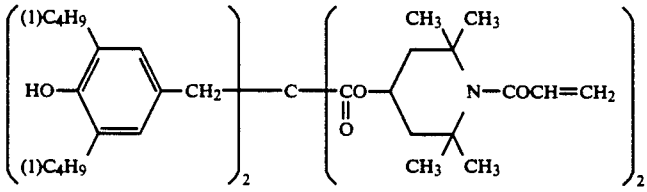

(c) Solvent

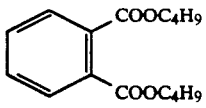

(d) Color Mixing Inhibitor

-continued
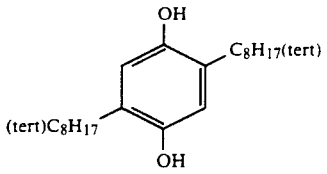
(e) Magenta Coupler
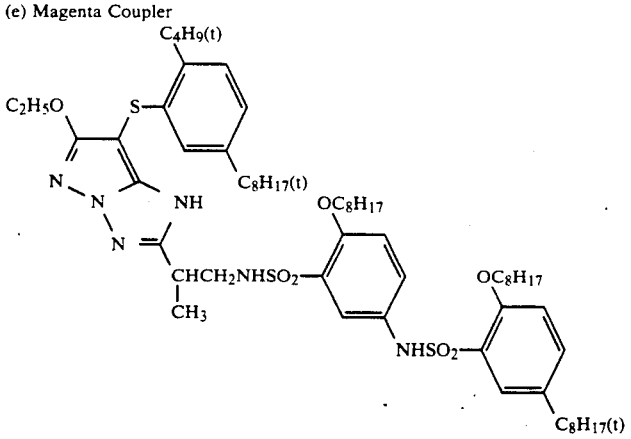
(f) Dye Image Stabilizer
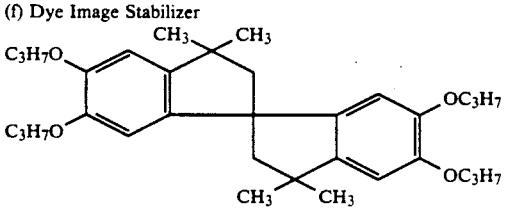
(g) Solvent
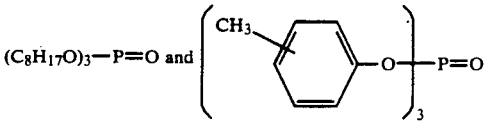
($g_1$) ($g_2$)
2:1 mixture (weight ratio) of ($g_1$) and ($g_2$)
(h) UV Absorber
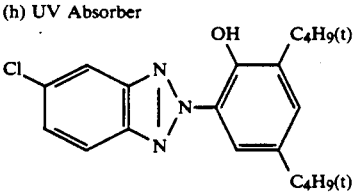
($h_1$)
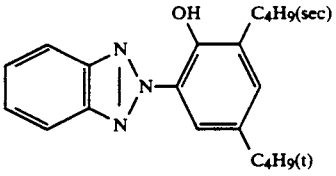
($h_2$)
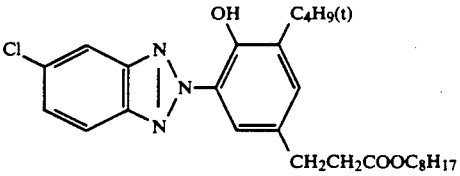
($h_3$)
1:5:3 mixture (molar ratio) of ($h_1$), ($h_2$) and ($h_3$)

-continued
(i) Color Mixing Inhibitor
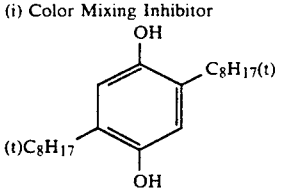
(j) Solvent
(iso $C_9H_{18}O)_3P{=}O$
(k) Cyan Coupler
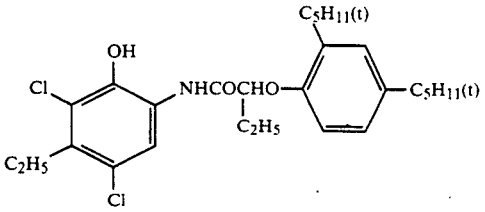
(k1)
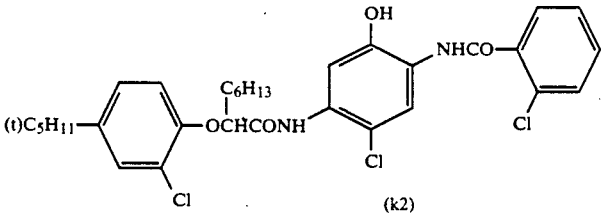
(k2)
1:1 mixture (molar ratio) of ($k_1$) and ($k_2$)
(l) Dye Image Stabilizer
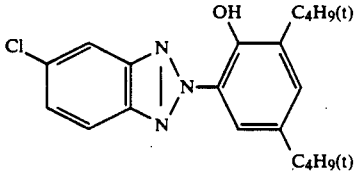
($l_1$)
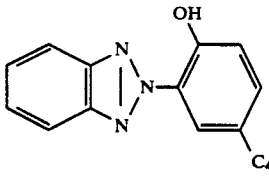
($l_2$)
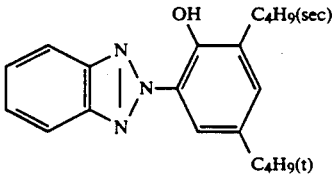
($l_3$)
1:3:3 (molar ratio) mixture of ($l_1$), ($l_2$) and ($l_3$)
(m) Solvent
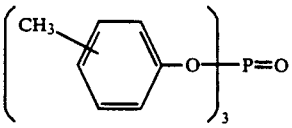

TABLE 21

| Layer | Principal Composition | Amount Used |
|---|---|---|
| 7th layer (Protective layer) | Gelatin | 1.33 g/m$^2$ |
| | Acrylic acid modified polyvinyl alcohol copolymer (degree of modification = 17%) | 0.17 g/m$^2$ |
| 6th layer (UV absorbing layer) | Gelatin | 0.54 g/m$^2$ |
| | UV absorber (h) | 0.21 g/m$^2$ |
| | Solvent (j) | 0.09 g/m$^2$ |
| 5th layer (Red-sensitive layer) | Silver chlorobromide emulsion (AgBr content = 1 mole %) | 0.26 g/m$^2$ (Ag) |
| | Gelatin | 0.98 g/m$^2$ |
| | Cyan coupler (k) | 0.38 g/m$^2$ |
| | Dye image stabilizer (l) | 0.17 g/m$^2$ |
| | Solvent (m) | 0.23 cc/m$^2$ |
| 4th layer (UV absorbing layer) | Gelatin | 1.60 g/m$^2$ |
| | UV absorber (h) | 0.62 g/m$^2$ |
| | Color mixing inhibitor (i) | 0.05 g/m$^2$ |
| | Solvent (j) | 0.26 cc/m$^2$ |
| 3rd layer (Green-sensitive layer) | Silver chlorobromide emulsion (AgBr content = 0.5 mole %) | 0.16 g/m$^2$ (Ag) |
| | Gelatin | 1.80 g/m$^2$ |
| | Magenta coupler (e) | 0.48 g/m$^2$ |
| | Dye image stabilizer (f) | 0.20 g/m$^2$ |
| | Solvent (g) | 0.68 cc/m$^2$ |
| 2nd layer (Color mixing inhibiting layer) | Gelatin | 0.99 g/m$^2$ |
| | Color mixing inhibitor (d) | 0.08 g/m$^2$ |
| 1st layer (Blue-sensitive layer) | Silver chlorobromide emulsion (AgBr content = 1 mole %) | 0.30 g/m$^2$ (Ag) |
| | Gelatin | 1.86 g/m$^2$ |
| | yellow coupler (a) | 0.82 g/m$^2$ |
| | Dye image stabilizer (b) | 0.19 g/m$^2$ |
| | Solvent (c) | 0.34 cc/m$^2$ |
| Substrate | Paper laminated with polyethylene films (the polyethylene film situated at the side of 1st layer contains a white pigment ($TiO_2$) and a bluing dye (Ultramarine Blue)) | |

The color photographic paper thus prepared was cut into continuous band-like ones having a width of 82.5 mm followed by exposing them to light with an autoprinter and then the exposed paper was processed with an autodeveloping machine according to the following processing steps given in Table 22.

TABLE 22

| Processing Steps | | | | |
|---|---|---|---|---|
| Step | Temp. (°C.) | Processing Time (sec) | Tank Volume (l) | Amount Replenished* (ml) |
| Color Development | 35 | 45 | 16 | 13 |
| Bleaching-Fixing | 35 | 45 | 10 | 8 |
| Water Washing (1) | 35 | 20 | 4 | Multi-stage Counter-current System |
| Water Washing (2) | 35 | 20 | 4 | |
| Water Washing (3) | 35 | 20 | 4 | |
| Water Washing (4) | 35 | 30 | 4 | |
| Drying | 80 | 60 | | |

*The value is expressed as that per unit length (1 m) of the processed color photographic paper (82.5 mm in width).

In the foregoing processing steps, the amount of the bleaching-fixing liquid carried over, by the color photographic paper during processing, to the water washing bath (1) was 2.5 ml per unit length (1 m) of the paper and thus the amount of washing water replenished was 6 times of that of the bleaching-fixing liquid carried over.

The formulation of each processing liquid employed was as follows:

(Color Developing Liquid)

| Component | Mother Liquor (g) | Replenishing Liquid (g) |
|---|---|---|
| Triethanolamine | 8.0 | 10.0 |
| N,N-Diethylhydroxylamine | 4.2 | 6.0 |
| Fluorescent Whitener (4,4'-diaminostilbene type) | 3.0 | 4.0 |
| Ethylenediaminetetraacetic acid | 1.0 | 1.5 |
| Potassium carbonate | 30.0 | 30.0 |
| Sodium chloride | 1.4 | 0.1 |
| 4-amino-3-methyl-N-ethyl-N-{β-(methanesulfonamide)ethyl}-p-phenylenediamine.sulfate | 5.0 | 7.0 |
| Water (Amount required to obtain 1 liter of the intended solutions) | | |
| pH | 10.10 | 10.50 |

(Bleaching-Fixing Liquid (Mother Liquor and Replenishing Liquid))

| Component | Amount |
|---|---|
| EDTA.Fe(III).$NH_4$.2$H_2O$ | 60 g |
| EDTA.2Na.2$H_2O$ | 4 g |
| Ammonium thiosulfate (70%) | 120 ml |
| Sodium sulfite | 16 g |
| Glacial acetic acid | 7 g |
| Water (Amount required to form 1 liter of the intended solutions) | |
| pH | 5.5 |

Washing Water A (Comparative Example): Tap water having the following properties:
pH: 7.1
Ca ions: 23 mg/l
Mg ions: 8 mg/l;

Washing Water B (Comparative Example): Washing water B comprised the washing water A and 20 mg of sodium dichloroisocyanurate per 1 liter of the former;

Washing Water C (Present Invention): Washing water C was prepared by passing the washing water A through a column packed with H-type strong acidic cation exchange resin (manufactuared and sold under the trade name of Diaion SK-1B by MITSUBISHI CHEMICAL INDUSTRIES LTD.) and OH-type strong basic anion exchange resin (manufactured and sold under the trade name of Diaion SA-10A by MITSUBISHI CHEMICAL INDUSTRIES LTD.) to form washing water having the following properties:
pH: 6.9
Ca ion: 1.5 mg/l
Mg ion: 0.5 mg/l;

Washing Water D (Present Invention): This comprised the washing water C and 20 mg of sodium dichlorocyanurate per 1 liter of the former;

Washing Water E (Present Invention): This was prepared by filtering the ion exchange water (the aforementioned washing water C) through a sterilizing filter having a pore size of 0.45 μ (manufactured and sold under the trade name of Microfilter FCE-45W by Fuji Photo Film Co., Ltd.)

In the processing in which the washing water A to E were used, the color photographic paper (Sample $P_7$) of 82.5 mm in width was processed at a rate of 180 m/day for 6 days followed by the out of operation for 7 days and it was observed whether there was the formation of bacterial floating matter or not during the term of the out of operation in each of the water washing baths. Alternatively, the concentrations of calcium and magnesium in the final water washing bath at the time of 6 days after the processing were determined by atomic-absorption spectroscopy. Thereafter, the Sample $P_7$ was again processed in the same processing liquids to compare the degree of contamination of the color photographic papers with each other.

TABLE 23

| | No. | Washing water | Concn. in the Final Water Washing Bath Ca (mg/l) | Mg (mg/l) | Formation of Bacterial Membrane | Degree of Contamination of Photographic Paper |
|---|---|---|---|---|---|---|
| Comparative Example | 1 | A | 20 | 9 | Observed after 2 days | (++) |
| Comparative Example | 2 | B | 21 | 8 | Observed after 2 days | (++) |
| Present Invention | 3 | C | 1.3 | 0.7 | Observed after 4 days | (+) |
| Present Invention | 4 | D | 1.5 | 0.6 | not observed even after 7 days | (−) |
| Present Invention | 5 | E | 1.5 | 0.7 | not observed even after 7 days | (−) |

As seen from the results in Table 23, it is clear that the formation of bacterial membrane and the contamination of the color photographic paper are substantially suppressed or prevented by restricting the amount of calcium and magnesium in the washing water replenished and sterilizing the latter.

In addition, the concentrations of calcium and magnesium in the final washing water were approximately equal to those in the replenishing liquid respectively.

In Table 23, ideograms (−) to ( ) have the following meanings:

(−) contamination of the color photographic paper is not observed;

(+) contamination thereof is observed in small extent;

( ) contamination thereof is observed in some extent;

( ) contamination thereof is observed in great extent.

EXAMPLE 10

The same test as in Example 9 was carried out except that the following color photographic paper (hereunder referred to as Sample $P_8$) was used instead of Sample $P_7$. Consequently, results similar to those in Example 9 were obtained.

Sample $P_8$

A multilayered color photographic paper having a layer structure shown in Table 24 was prepared on a paper substrate, both surfaces of which were laminated with polyethylene films. Coating liquids for preparing the photographic paper were obtained according to the following procedures:

Preparation of Coating Liquid for First Layer

An yellow coupler (a) (19.1 g) and a dye image stabilizer (b) (4.4 g) were dissolved in 27.2 cc of ethyl acetate and 7.7 cc of solvent (c) and the resultant solution was dispersed in 185 cc of 10% aqueous gelatin solution containing 8 cc of 10% sodium dodecylbenzenesulfonate solution to form an emulsion. On the other hand, the following blue-sensitive sensitizing dye was added to a silver chlorobromide emulsion (AgBr content = 1.0 mole %; Ag content × 70 g/kg emulsion) in an amount of $5.0 \times 10^{-4}$ moles per mole of silver chlorobromide to form a blue-sensitive silver halide emulsion. Then, the emulsion and the blue-sensitive emulsion separately prepared above were admixed with each other followed by adjusting the concentration of the components so as to be consistent with those listed in Table 24 to form a coating liquid for first layer.

Other coating liquids for second to seventh layers were likewise prepared according to the same manner as described above.

In each layer, sodium salt of 1-oxy-3,5-dichloro-striazine was used as the hardening agent for gelatin.

The following spectral sensitizing dyes were used in each corresponding layers:

Blue-sensitive Emulsion Layer

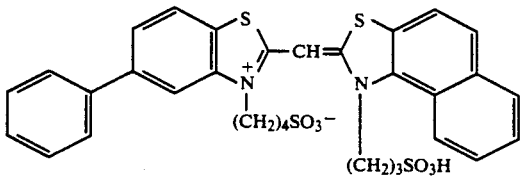

(Added amount = $5.0 \times 10^{-4}$ moles per mole of silver halide)

Green-sensitive Emulsion Layer

-continued

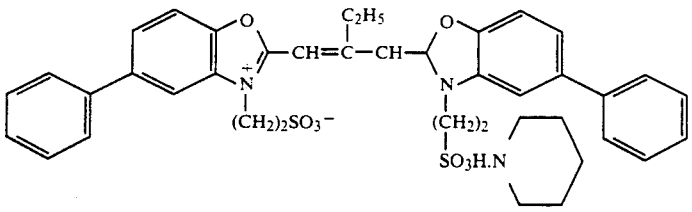

(Added amount = $4.0 \times 10^{-4}$ moles per mole of silver halide)

and

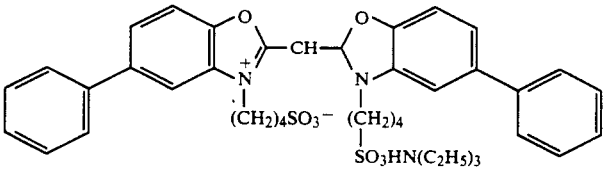

(Added amount = $7.0 \times 10^{-5}$ moles per mole of silver halide)

Red-sensitive Emulsion Layer

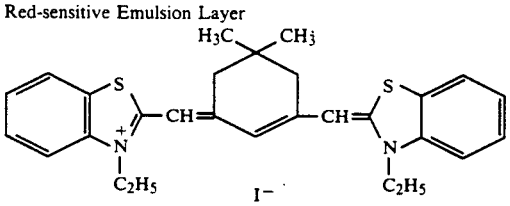

(Added amount = $0.9 \times 10^{-4}$ moles per mole of silver halide)

The following compound was added to the red-sensitive emulsion layer in an amount of $2.6 \times 10^{-3}$ moles per mole of silver halide.

-continued and

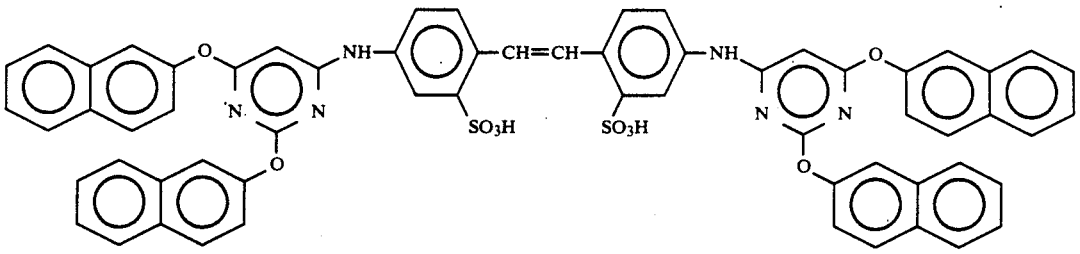

Moreover, 1-(5-methylureidophenyl)-5-mercaptotetrazole was added to each of the blue-sensitive emulsion layer, green-sensitive emulsion layer and red-sensitive emulsion layer in an amount of $8.5 \times 10^{-5}$, $7.7 \times 10^{-4}$ and $7.5 \times 10^{-4}$ moles per mole of solver halide respective.

For the purpose of preventing irradiation, the following dyes were added to the emulsion layers:

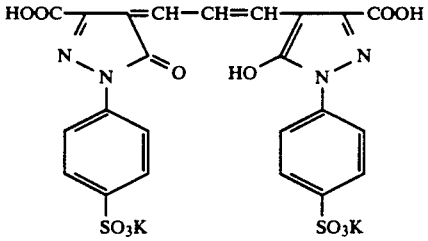

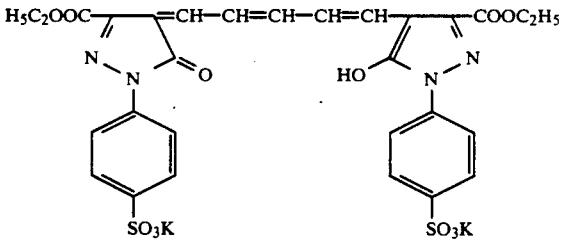

TABLE 24

| Layer | Principal Composition | Amount Used ($g/m^2$) |
|---|---|---|
| 7th layer (Protective layer) | Gelatin | 1.33 |
| | Acrylic acid modified polyvinyl alcohol copolymer (degree of modification = 17%) | 0.17 |
| | Liquid paraffin | 0.03 |
| 6th layer | Gelatin | 0.53 |

TABLE 24-continued

| Layer | Principal Composition | Amount Used ($g/m^2$) |
|---|---|---|
| (UV absorbing layer) | UV absorber (i) | 0.21 |
| | Solvent (k) | 0.08 |
| 5th layer (Red-sensitive layer) | Silver halide emulsion | 0.23 (Ag) |
| | Gelatin | 1.34 |
| | Cyan coupler (l) | 0.34 |
| | Dye image stabilizer (m) | 0.17 |
| | Polymer (n) | 0.40 |
| | Solvent (o) | 0.23 |
| 4th layer (UV absorbing layer) | Gelatin | 1.58 |
| | UV absorber (i) | 0.62 |
| | Color mixing inhibitor (j) | 0.05 |
| | Solvent (k) | 0.24 |
| 3rd layer (Green-sensitive layer) | Silver halide emulsion | 0.36 (Ag) |
| | Gelatin | 1.24 |
| | Magenta coupler (e) | 0.31 |
| | Dye image stabilizer (f) | 0.25 |
| | Dye image stabilizer (g) | 0.12 |

TABLE 24-continued

| Layer | Principal Composition | Amount Used ($g/m^2$) |
|---|---|---|
| | Solvent (h) | 0.42 |
| 2nd layer (Color mixing inhibiting layer) | Gelatin | 0.99 |
| | Color mixing inhibitor (d) | 0.08 |
| 1st layer (Blue-sensitive layer) | Silver halide emulsion layer | 0.30 (Ag) |
| | Gelatin | 1.86 |
| | Yellow coupler (a) | 0.82 |
| | Dye image stabilizer (b) | 0.19 |
| | Solvent (c) | 0.35 |
| Substrate | Paper laminated with polyethylene films (the polyethylene film situated at the side of 1st layer contains a white pigment ($TiO_2$) and a bluing dye (Ultramarine Blue)) | |

The structural formula of each compound used in the Example is as follows:

(a) Yellow Coupler

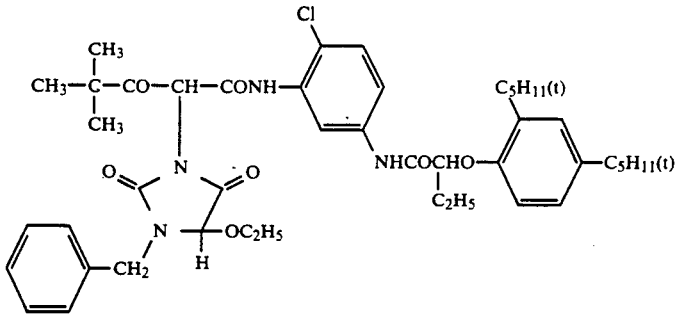

(b) Dye Image Stabilizer

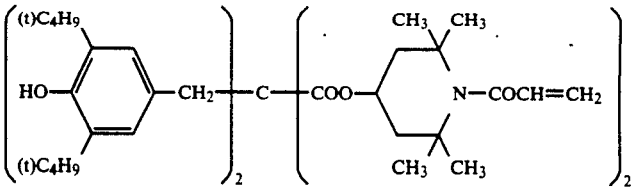

(c) Solvent

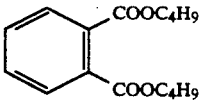

(d) Color Mixing Inhibitor

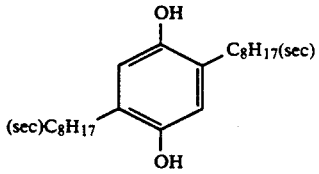

(e) Magenta Coupler

-continued
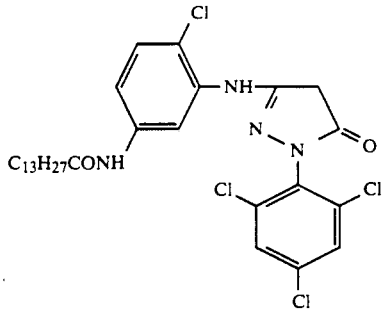
(f) Dye Image Stabilizier
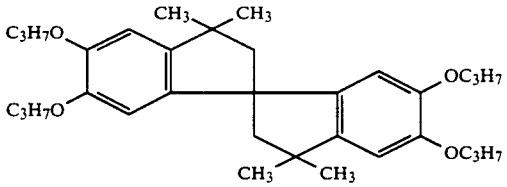
(g) Dye Image Stabilizer
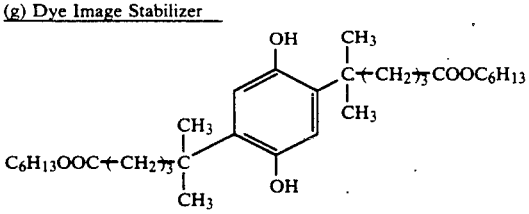
(h) Solvent
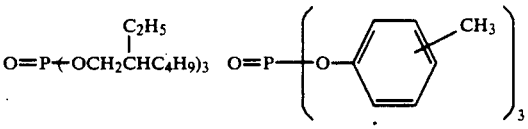
($h_1$) ($h_2$)
1:1 (volume ratio) mixture of ($h_1$) and ($h_2$)
(i) UV Absorber
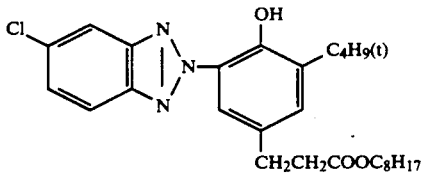
($i_1$)
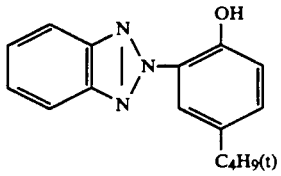
($i_2$)
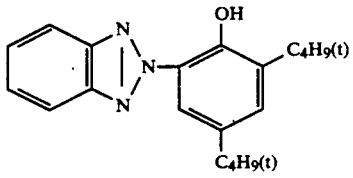
($i_3$)
2:9:8 mixture (weight ratio) of ($i_1$), ($i_2$) and ($i_3$)

-continued (j) Color Mixing Inhibitor

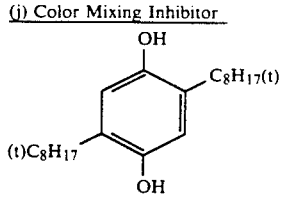

(k) Solvent $O{=}P{+}O{-}C_9H_{19}(iso))_3$ (l) Cyan Coupler

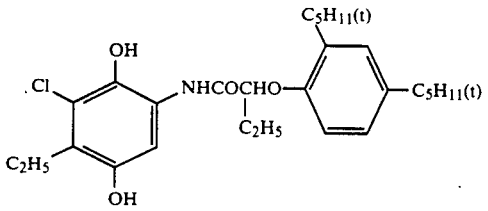

(m) Dye Image Stabilizer

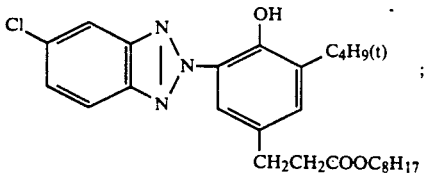

(m1)

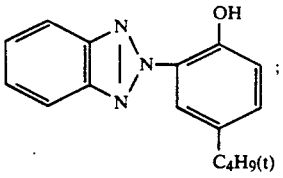

(m2)

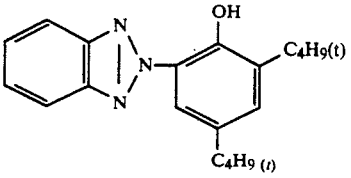

(m3)

5:8:9 (weight ratio) mixture of (m1), (m2) and (m3)

(n) Polymer $\text{+}CH_2{-}CH\text{+}_n$ Average Molecular Weight = 35,000
$\quad\quad\quad\quad | \quad\quad\quad\quad$
$\quad\quad\quad CONHC_4H_9(t)$ (o) Solvent

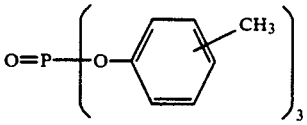

EXAMPLE 11

A multilayered color photosensitive material having the following layers of the compositions given below was formed on a substrate of a cellulose triacetate film provided with an underlying coating.

Composition of the Photosensitive Material

In the following formulations, the coated amount of silver halide and colloidal silver is expressed as the weight of silver per unit area (1 $m^2$) of the photosensitive material, that of couplers, additives and gelatin is expressed as the weight thereof per unit area (1 $m^2$) of the photosensitive material and that of sensitizing dyes is expressed as molar number thereof per mole of the silver halide in the same layer.

First Layer (Antihalation Layer)

| Component | Amount |
|---|---|
| Black colloidal silver | 0.4 |
| Gelatin | 1.3 |
| Coupler C-1 | 0.06 |
| UV absorber UV-1 | 0.1 |
| UV absorber UV-2 | 0.2 |
| Dispersion oil Oil-1 | 0.01 |
| Dispersion oil Oil-2 | 0.01 |

2nd Layer (Intermediate Layer)

| Component | Amount |
|---|---|
| Silver bromide of fine grain (average grain size = 0.07μ) | 0.15 |
| Gelatin | 1.0 |
| Coupler C-2 | 0.02 |
| Dispersion oil Oil-1 | 0.1 |

3rd Layer (First Red-sensitive Emulsion Layer)

| Component | Amount |
|---|---|
| Silver iodobromide emulsion (AgI content = 6 mole %; ratio of diameter to thickness = 2.5; average grain size = 0.3μ) | 1.5 (Ag) |
| Gelatin | 0.6 |
| Sensitizing dye I | $1.0 \times 10^{-4}$ |
| Sensitizing dye II | $3.0 \times 10^{-4}$ |
| Sensitizing dye III | $1 \times 10^{-5}$ |
| Coupler C-3 | 0.06 |
| Coupler C-4 | 0.06 |
| Coupler C-8 | 0.04 |
| Coupler C-2 | 0.03 |
| Dispersion oil Oil-1 | 0.03 |
| Dispersion oil Oil-3 | 0.012 |

4th Layer (Second Red-sensitive Emulsion Layer)

| Component | Amount |
|---|---|
| Silver iodobromide emulsion (AgI content = 6 mole %; ratio of diameter to thickness = 3.5; average grain size = 0.5μ) | 1.5 (Ag) |
| Sensitizing dye I | $1 \times 10^{-4}$ |
| Sensitizing dye II | $3 \times 10^{-4}$ |
| Sensitizing dye III | $1 \times 10^{-5}$ |
| Coupler C-3 | 0.24 |
| Coupler C-4 | 0.24 |
| Coupler C-8 | 0.04 |
| Coupler C-2 | 0.04 |
| Dispersion oil Oil-1 | 0.15 |
| Dispersion oil Oil-3 | 0.02 |

5th Layer (Third Red-sensitive Emulsion Layer)

| Component | Amount |
|---|---|
| Silver iodobromide emulsion (AgI content = 10 mole %; ratio of diameter to thickness = 1.5; average grain size = 0.7μ) | 2.0 (Ag) |
| Gelatin | 1.0 |
| Sensitizing dye I | $1 \times 10^{-4}$ |
| Sensitizing dye II | $3 \times 10^{-4}$ |
| Sensitizing dye III | $1 \times 10^{-5}$ |

-continued

| Component | Amount |
|---|---|
| Coupler C-6 | 0.05 |
| Coupler C-7 | 0.1 |
| Dispersion oil Oil-1 | 0.01 |
| Dispersion oil Oil-2 | 0.05 |

6th Layer (Intermediate Layer)

| Component | Amount |
|---|---|
| Gelatin | 1.0 |
| Compound Cpd-A | 0.03 |
| Dispersion oil Oil-1 | 0.05 |

7th Layer (First Green-sensitive Emulsion Layer)

| Component | Amount |
|---|---|
| Silver iodobromide emulsion (AgI content = 6 mole %; ratio of diameter to thickness = 2.5; average grain size = 0.3μ) | 0.7 (Ag) |
| Sensitizing dye IV | $5 \times 10^{-4}$ |
| Sensitizing dye VI | $0.3 \times 10^{-4}$ |
| Sensitizing dye V | $2 \times 10^{-4}$ |
| Gelatin | 1.0 |
| Coupler C-9 | 0.2 |
| Coupler C-5 | 0.03 |
| Coupler C-1 | 0.03 |
| Compound Cpd-C | 0.012 |
| Dispersion oil Oil-1 | 0.5 |

8th Layer (Second Green-sensitive Emulsion Layer)

| Component | Amount |
|---|---|
| Silver iodobromide emulsion (AgI content = 5 mole %; ratio of diameter to thickness = 3.5; average grain size = 0.5μ) | 1.4 (Ag) |
| Sensitizing dye IV | $5 \times 10^{-4}$ |
| Sensitizing dye V | $2 \times 10^{-4}$ |
| Sensitizing dye VI | $0.3 \times 10^{-4}$ |
| Coupler C-9 | 0.25 |
| Coupler C-1 | 0.03 |
| Coupler C-10 | 0.015 |
| Coupler C-5 | 0.01 |
| Compound Cpd-C | 0.012 |
| Dispersion oil Oil-1 | 0.2 |

9th Layer (Third Green-sensitive Emulsion Layer)

| Component | Amount |
|---|---|
| Silver iodobromide emulsion (AgI content = 10 mole %; ratio of diameter to thickness = 1.5; average grain size = 0.7μ) | 1.9 (Ag) |
| Gelatin | 1.0 |
| Sensitizing dye VII | $3.5 \times 10^{-4}$ |
| Sensitizing dye VIII | $1.4 \times 10^{-4}$ |
| Coupler C-11 | 0.01 |
| Coupler C-12 | 0.03 |
| Coupler C-13 | 0.20 |
| Coupler C-1 | 0.02 |
| Coupler C-15 | 0.02 |
| Dispersion oil Oil-1 | 0.20 |
| Dispersion oil Oil-2 | 0.05 |

10th Layer (Yellow Filter Layer)

| Component | Amount |
|---|---|
| Gelatin | 1.2 |
| Yellow colloidal silver | 0.16 |
| Compound Cpd-B | 0.1 |
| Dispersion oil Oil-1 | 0.3 |

11th Layer (First Blue-sensitive Emulsion Layer)

| Component | Amount |
|---|---|
| Monodispersed silver iodobromide emulsion (AgI content = 6 mole %; ratio of diameter to thickness = 1.5; average grain size = 0.3μ) | 1.0 (Ag) |
| Gelatin | 1.0 |
| Sensitizing dye IX | $2 \times 10^{-4}$ |
| Coupler C-14 | 0.9 |
| Coupler C-5 | 0.07 |
| Dispersion oil Oil-1 | 0.2 |

12th Layer (Second Blue-sensitive Emulsion Layer)

| Component | Amount |
|---|---|
| Silver iodobromide emulsion (AgI content = 10 mole %; ratio of diameter to thickness = 1.5; average grain size = 1.5μ) | 0.9 (Ag) |
| Gelatin | 0.6 |
| Sensitizing dye IX | $1 \times 10^{-4}$ |
| Coupler C-14 | 0.25 |
| Dispersion oil Oil-1 | 0.07 |

13th Layer (First Protective Layer)

| Component | Amount |
|---|---|
| Gelatin | 0.8 |
| UV absorber UV-1 | 0.1 |
| UV absorber UV-2 | 0.2 |
| Dispersion oil Oil-1 | 0.01 |
| Dispersion oil Oil-2 | 0.01 |

14th Layer (Second Protective Layer)

| Component | Amount |
|---|---|
| Silver bromide of fine grain (average grain size = 0.07μ) | 0.5 |
| Gelatin | 0.45 |
| Polymethylmethacrylate particles (diameter = 1.5μ) | 0.2 |
| Hardening agent H-1 | 0.4 |
| n-Butyl p-hydroxybenzoate | 0.012 |
| Formaldehyde scavenger S-1 | 0.5 |
| Formaldehyde scavenger S-2 | 0.5 |

In each of these layers, a surfactant was incorporated as a coating additive in addition to the aforementioned components. The sample thus prepared will hereunder be referred to as "Sample N4".

Nomenclature or the structural formula of the compounds used in this Example will be given below:

UV-1

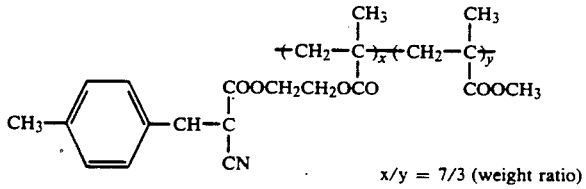

x/y = 7/3 (weight ratio)

UV-2

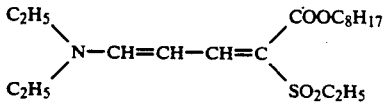

Oil-1 Tricresyl Phosphate
Oil-2 Dibutyl Phthalate
Oil-3 Bis(2-ethylhexyl) Phthalate

C-1

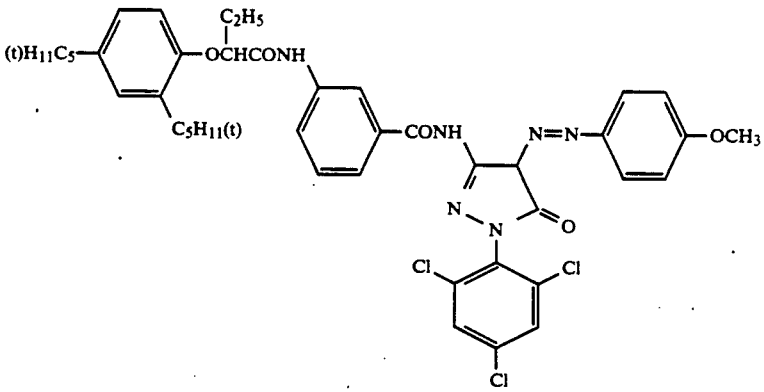

C-2

-continued
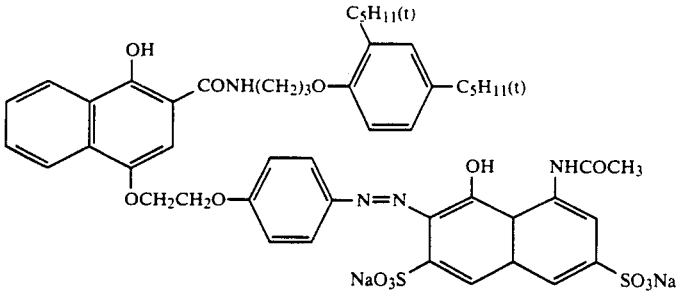
C-3
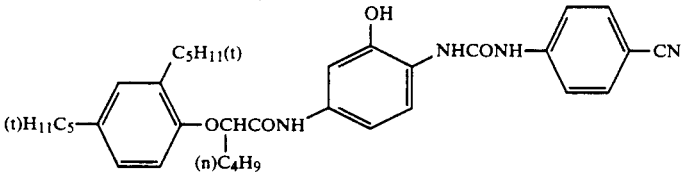
C-4
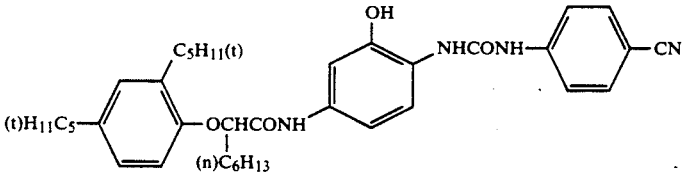
C-5
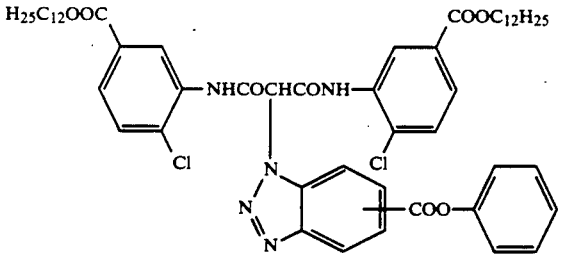
C-15
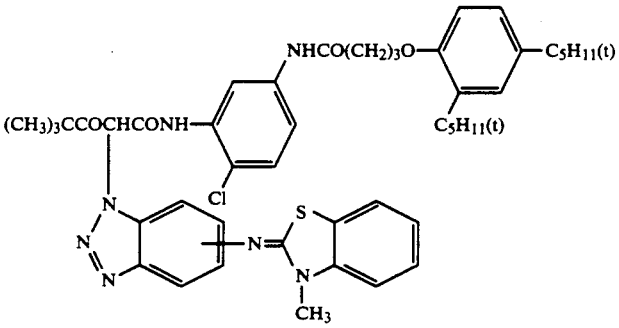
C-6

-continued
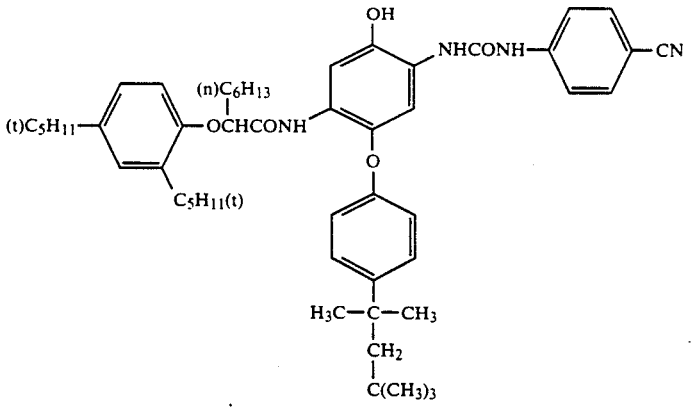
C-7
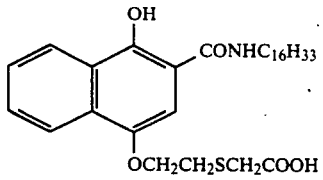
C-8
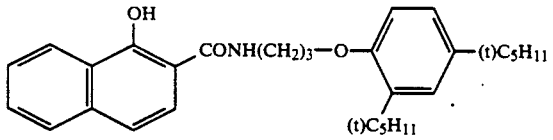
C-9
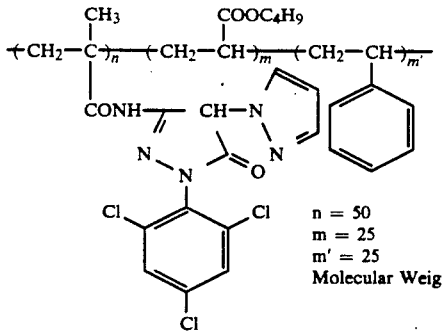
n = 50
m = 25
m' = 25
Molecular Weight = about 20,000
C-10
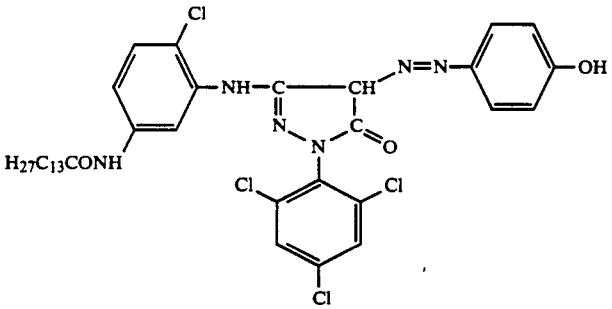
C-11

-continued
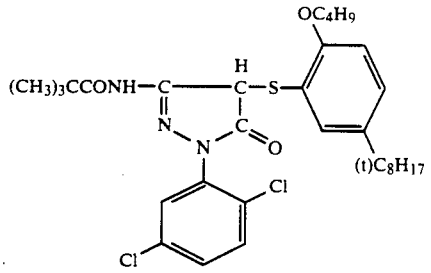
C-12
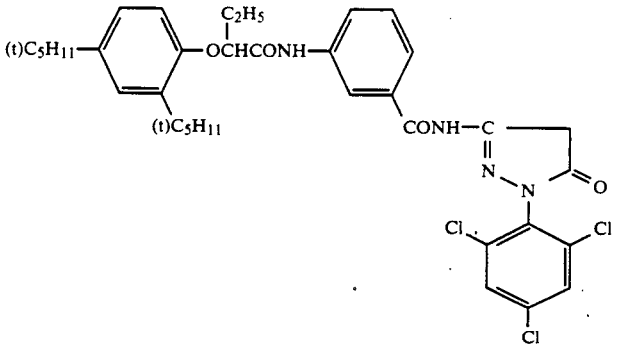
C-13
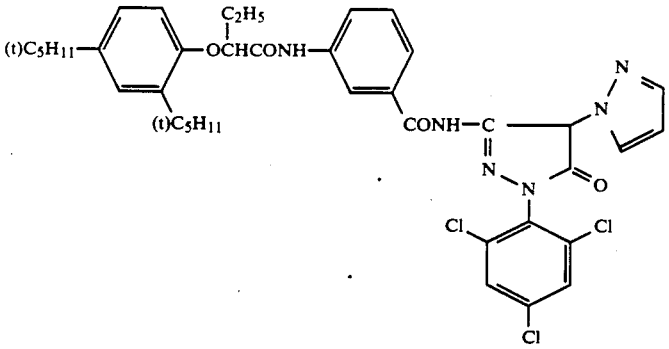
C-14
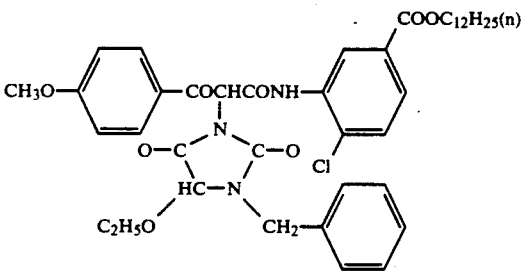
Cpd A
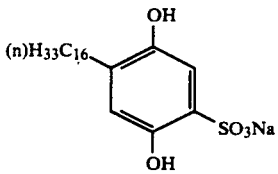
Cpd B -continued
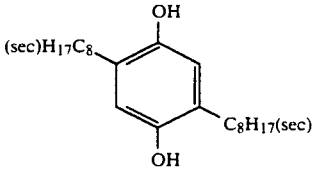
Sensitizing Dye I
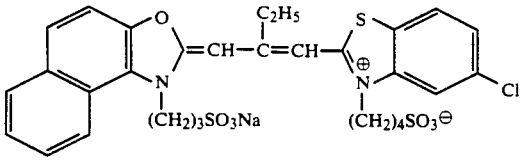
Sensitizing Dye II
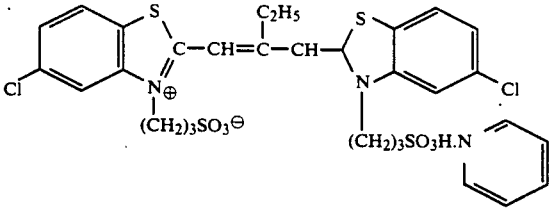
Sensitizing Dye III
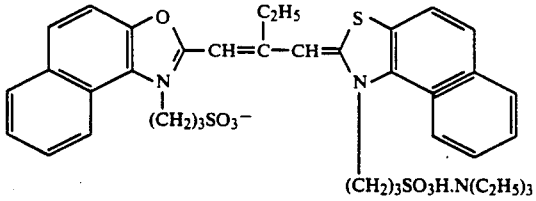
Sensitizing Dye IV
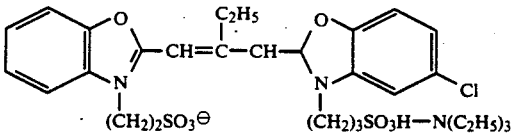
Sensitizing Dye V
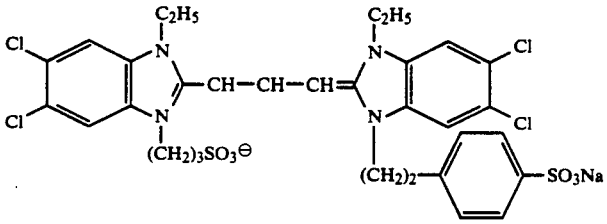
Sensitizing Dye VI
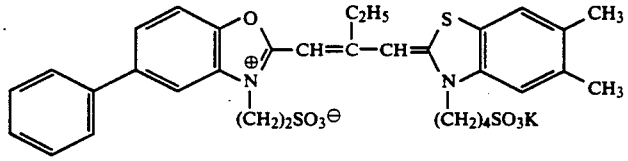
Sensitizing Dye VII -continued

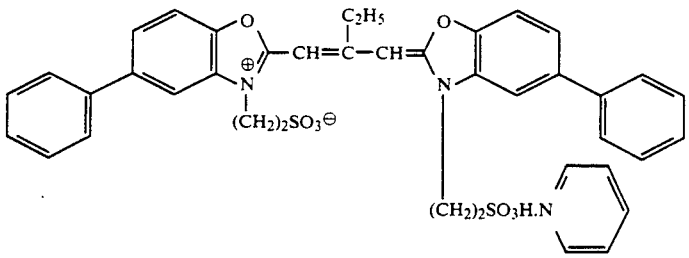

Sensitizing Dye VIII

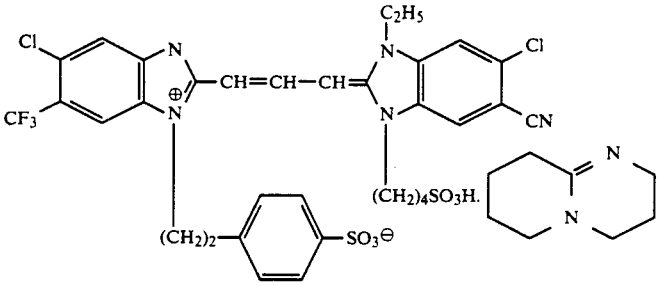

S-2

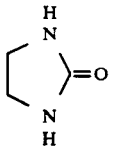

Sensitizing Dye IX

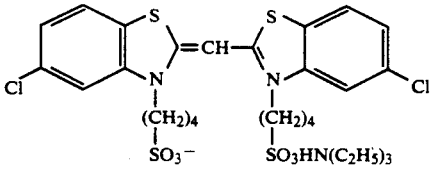

H-1

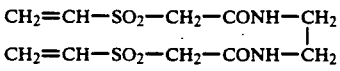

S-1

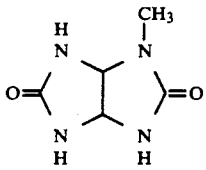

Cpd-C

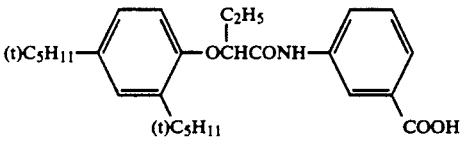

The multilayered color photosensitive material, Sample $N_4$, was cut into continuous band-like ones having a width of 35 mm and there a standard object was photographed in the open air utilizing the cut Sample $N_4$. Thereafter, Sample $N_4$ was processed, by an autodeveloping machine, according to the processing steps described in Table 25 given below.

TABLE 25

| Step | Processing Steps: Processing Time | Processing Temp. (°C.) | Tank Volume (l) | Amount Replenished* (ml) |
|---|---|---|---|---|
| Color Development | 3 min. 15 sec. | 38 | 8 | 45 |
| Bleaching | 1 min. | 38 | 4 | 20 |

TABLE 25-continued

| Step | Processing Steps: Processing Time | Processing Temp. (°C.) | Tank Volume (l) | Amount Replenished* (ml) |
|---|---|---|---|---|
| Bleaching-Fixing | 3 min. 15 sec. | 38 | 8 | 30 |
| Water Washing (1) | 40 sec. | 35 | 4 | Two-stage Counter-current Washing System |
| Water Washing (2) | 1 min. | 35 | 4 | 30 |
| Stabilization | 40 sec. | 35 | 4 | 20 |

*This amount is expressed as that per unit length (1 m) of the processed photosensitive material (35 mm in width).

In the foregoing processing steps, the water washing steps (1) and (2) were carried out according to a countercurrent water washing system from the bath (2) to the bath (1). The processing liquids having the following compositions were used in this processing method.

(Color Developing Liquid)

| Component | Mother Liquor (g) | Replenishing Liquid (g) |
|---|---|---|
| Diethylenetriaminepenta-acetic acid | 1.0 | 1.1 |
| 1-Hydroxyethylidene-1,1-diphosphonic acid | 2.0 | 2.2 |
| Sodium sulfite | 4.0 | 4.4 |
| Potassium carbonate | 30.0 | 32.0 |
| Potassium bromide | 1.4 | 0.7 |
| Potassium iodide | 1.3 (mg) | — |
| Hydroxylamine | 2.4 | 2.6 |
| 4-(N-Ethyl-N-β-hydroxy-ethylamino)-2-methyl-amiline.sulfate | 4.5 | 5.0 |
| Water (Amount required to obtain 1 liter of the intended solutions) | | |
| pH | 10.00 | 10.05 |

(Bleaching Liquid)

| Component | Mother Liquor and Replenishing Liquid (g) |
|---|---|
| Ammonium bromide | 100 |
| Ferric ammonium ethylenediamine-tetraacetate | 120 |
| Disodium ethylenediaminetetraacetate | 10.0 |
| Ammonium nitrate | 10.0 |
| Bleaching accelerator ($N(CH_3)_2$—$(CH_2)_2$—S—S—$(CH_2)_2$—$N(CH_3)_2$) | 2.0 |
| Aqueous ammonia | 17.0 (ml) |
| Water (Amount required to form 1 liter of the intended solutions) | |
| pH | 6.5 |

(Bleaching-Fixing Liquid)

| Component | Mother Liquor (g) | Replenishing Liquid (g) |
|---|---|---|
| Ammonium bromide | 50.0 | — |
| Ferric ammonium ethylenediamine-tetraacetate | 50.0 | — |
| Disodium ethylenediamine-tetraacetate | 5.0 | 1.0 |
| Ammonium nitrate | 5.0 | — |
| Sodium sulfite | 12.0 | 20.0 |
| Aqueous solution of ammonium thiosulfate (70%) | 240 (ml) | 400 (ml) |
| Aqueous ammonia | 10.0 (ml) | — |
| Water (Amount required to obtain 1 liter of the intended solutions) | | |
| pH | 7.3 | 8.0 |

(Stabilizing Solution)

| Component | Mother Liquor | Replenishing Solution |
|---|---|---|
| Formalin (30% w/v) | 2.0 ml | 3.0 ml |
| Polyoxyethylene-p-monononyl phenyl ether (average degree of polymerization = 10) | 0.3 g | 0.45 g |
| Water (Amount required to obtain 1 liter of the intended solutions) | | |

Using the foregoing processing steps, processing liquids and the following washing water, a color negative film was processed and results obtained were compared with each other.

| | |
|---|---|
| Washing Water A: (Comparative Example) | Tap water as used in Example 9 (Washing Water A); |
| Washing Water B: (Comparative Example) | This was the tap water (washing water A) containing sodium dichloroisocyanurate in an amount of 20 mg per liter of the washing water A; |
| Washing Water C: (Present Invention) | This was obtained by passing the tap water used in Example 9 as washing water A through a column packed with strong acidic Na-type cation exchange resin (manufactured and sold under the trade name of Diaion SK-1B by MITSUBISHI CHEMICAL INDUSTRIES LTD.); |
| Washing Water D: (Present Invention) | This was the foregoing washing water C (ion exchange water) to which sodium dichloroiocyanurate was added in an amount of 20 mg per liter of the water; |
| Washing Water E: (Present Invention) | This was prepared by passing the tap water (Washing water A) used in Example 8 through a column packed with an X-type zeolite (manufactured and sold under the trade name of Molecular Sieve, LINDE ZB-300 by UNION SHOWA INC.) and then adding sodium dichloro-isocyanurate in an amount of 20 mg per liter of the ion exchange water. |

In every processings in which the foregoing washing water a to E were utilized, a color negative film (35 mm in width) was processed at a rate of 30 m per day over 10 days followed by the cessation of the processing for 10 days and at this stage it was observed whether a bacterial floating matter was formed in each water washing bath or not during out of the operation. Thereafter, processing of a color negative film $N_4$ was again carried out and the surface thereof was observed on contamination for the purpose of comparison. Results obtained are listed in the following Table 26.

TABLE 26

| Processing No. | Washing Water | Concn. in the Fixal Washing Bath: Ca (mg/l) | Mg (mg/l) | Formation of Bacterial Membrane | Contamination of the Film |
|---|---|---|---|---|---|
| 1. (Comparative Example) | A | 22 | 9.5 | After 2 days | (+++) |
| 2. (Comparative Example) | B | 24 | 10 | After 2 days | (+++) |

TABLE 26-continued

| Processing No. | Washing Water | Concn. in the Fixal Washing Bath Ca (mg/l) | Mg (mg/l) | Formation of Bacterial Membrane | Contamination of the Film |
|---|---|---|---|---|---|
| 3. (Present Invention) | C | 1.8 | 0.9 | After 5 days | (+) |
| 4. (Present Invention) | D | 1.9 | 1.1 | Not observed even after 10 days | (−) |
| 5. (Present Invention) | E | 2.5 | 2.8 | Not observed even after 10 days | (−) |

In Table 26, the meanings of ideograms (−) . . . ( ) are those as defined in Example 9.

As seen from the results shown in Table 26, it is found that the present invention makes it possible to substantially suppress the formation of bacterial floating matter and the contamination of film in the water washing bath even in the processing of the color negative film.

EXAMPLE 12

The procedures of Example 11 were repeated except that the following processing steps and the processing liquids were used and the washing water E was prepared by treating the same tap water as before according to reverse osmosis technique using a cellulose acetate film having a surface area of 1 $m^2$ and under a pressure of 15 $kg/cm^2$) in place of X-type zeolite treatment. Consequently, the same results as in Example 11 were obtained.

TABLE 27

| Step | Processing Time | Processing Steps: Processing Temp. (°C.) | Tank Volume (l) | Amount Replenished* (ml) |
|---|---|---|---|---|
| Color Development | 2 min. 30 sec. | 38 | 8 | 15 |
| Bleaching-Fixing | 3 min. | 38 | 8 | 25 |
| Water Washing (1) | 30 sec. | 35 | 4 | Three-stage Counter-current Water Washing System 10 |
| Water Washing (2) | 30 sec. | 35 | 4 | |
| Water Washing (3) | 30 sec. | 35 | 4 | |
| Stabilization | 30 sec. | 35 | 4 | 5 |

*This is expressed as that per unit length (1 m) of the processed photosensitive material (35 mm in width). Moreover, the amount of the bleaching-fixing liquid carried over from the bleaching-fixing bath to the water washing bath (1) by the material during processing was 2 ml per unit length (1 m) of the material (35 mm in width).

In the aforementioned processing steps, the water washing steps (1) to (3) were carried out according to countercurrent water washing system from the bath (3) to the bath (1). The composition of each processing liquid was as follows:

| Component | Mother Liquor (g) | Replenishing Liquid (g) |
|---|---|---|
| (Color Developing Liquid) | | |
| Diethylenetriaminepenta-acetic acid | 1.0 | 1.1 |
| 1-Hydroxyethylidene-1,1-diphosphonic acid | 2.0 | 2.2 |
| Sodium sulfite | 4.0 | 4.9 |

-continued

| Component | Mother Liquor (g) | Replenishing Liquid (g) |
|---|---|---|
| Potassium carbonate | 30.0 | 42.0 |
| Potassium bromide | 1.6 | — |
| Potassium iodide | 2.0 (mg) | — |
| Hydroxylamine | 2.4 | 3.6 |
| 4-(N-Ethyl-N-β-hydroxy-ethylamino)-2-methylaniline.sulfate | 5.0 | 7.3 |
| Water (Amount required to form 1 liter of the intended solutions) | | |
| pH | 10.00 | 10.05 |
| (Bleaching-Fixing) | | |
| Ferric ammonium ethylene-diaminetetraacetate | 60.0 | 66.0 |
| Disodium ethylene-diaminetetraacetate | 10.0 | 11.0 |
| Sodium sulfite | 12.0 | 20.0 |
| Ammonium thiosulfate (70% w/v aqueous solution) | 220 (ml) | 250 (ml) |
| Ammonium nitrate | 10.0 | 12.0 |
| Bleaching accelerator | 0.5 | 0.7 |

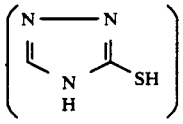

| | | |
|---|---|---|
| Aqueous ammonia | 13.0 (ml) | 12.0 (ml) |
| Water (Amount required to form 1 liter of the intended solutions) | | |
| pH | 6.7 | 6.5 |

EXAMPLE 13

The same test as in Example 11 was carried out using the following multilayered color photosensitive materials (hereunder referred to as Samples $N_5$ to $N_{10}$ instead of Sample $N_4$ and the same results as in Example 11 were obtained.

Multilayered color photosensitive materials (Samples $N_5$ to $N_{10}$) were formed on substrates of cellulose triacetate film provided with underlying coating by applying in order layers having the following compositions:

(Composition of the Photosensitive Layer

The numerical value corresponding to each component represents the coated amount thereof expressed as $g/m^2$ provided that the coated amount of silver halide stands for that reduced to the amount of silver. Moreover, the coated amount of sensitizing dyes and couplers used is expressed as moles per 1 mole of the silver halide contained in the same layer.

Sample $N_5$

1st Layer: Antihalation Layer

| | |
|---|---|
| Black colloidal silver | 0.18 (Ag) |
| Gelatin | 1.40 |

2nd Layer: Intermediate Layer

| | |
|---|---|
| 2,5-di-tert-pentadecylhydroquinone | 0.18 |
| C-1 | 0.07 |
| C-3 | 0.02 |
| U-1 | 0.08 |
| U-2 | 0.08 |
| HBS-1 | 0.10 |
| HBS-2 | 0.02 |
| Gelatin | 1.04 |

3rd Layer: First Red-sensitive Emulsion Layer

| | |
|---|---|
| Silver iodobromide emulsion (AgI content = 6 mole %; average grain size = 0.8μ) | 0.50 (Ag) |
| Sensitizing dye IX | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| Coupler C-2 | 0.146 |
| HBS-1 | 0.005 |
| C-10 | 0.0050 |
| Gelatin | 1.20 |

4th Layer: Second Red-sensitive Emulsion Layer

| | |
|---|---|
| Silver iodobromide emulsion (AgI content = 5 mole %; average grain size = 0.85μ) | 1.15 (Ag) |
| Sensitizing dye IX | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| C-2 | 0.060 |
| C-3 | 0.008 |
| C-10 | 0.004 |
| HBS-1 | 0.005 |
| Gelatin | 1.50 |

5th Layer: Third Red-sensitive Emulsion Layer

| | |
|---|---|
| Silver iodobromide emulsion (AgI content = 10 mole %; average grain size = 1.5μ) | 1.50 (Ag) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| C-5 | 0.012 |
| C-3 | 0.003 |
| C-4 | 0.004 |
| HBS-1 | 0.32 |
| Gelatin | 1.63 |

6th Layer: Intermediate Layer

| | |
|---|---|
| Gelatin | 1.06 |

7th Layer: First Green-sensitive Emulsion Layer

| | |
|---|---|
| Silver iodobromide emulsion (AgI content = 6 mole %; average grain size = 0.8μ) | 0.35 (Ag) |
| Sensitizing dye V | $3.0 \times 10^{-5}$ |
| Sensitizing dye VI | $1.0 \times 10^{-4}$ |

-continued

| | |
|---|---|
| Sensitizing dye VII | $3.8 \times 10^{-4}$ |
| C-6 | 0.120 |
| C-1 | 0.021 |
| C-7 | 0.030 |
| C-8 | 0.025 |
| HBS-1 | 0.20 |
| Gelatin | 0.70 |

8th Layer: Second Green-sensitive Emulsion Layer

| | |
|---|---|
| Silver iodobromide emulsion (AgI content = 5 mole %; average grain size = 0.85μ) | 0.75 (Ag) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| C-6 | 0.021 |
| C-8 | 0.004 |
| C-1 | 0.002 |
| C-7 | 0.003 |
| HBS-1 | 0.15 |
| Gelatin | 0.80 |

9th Layer: Third Green-sensitive Emulsion Layer

| | |
|---|---|
| Silver iodobromide emulsion (AgI content = 10 mole %; average grain size = 1.5μ) | 1.80 (Ag) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| C-16 | 0.012 |
| C-1 | 0.001 |
| HBS-2 | 0.69 |
| Gelatin | 1.74 |

10th Layer: Yellow Filter Layer

| | |
|---|---|
| Yellow colloidal silver | 0.05 (Ag) |
| 2,5-di-tert-pentadecylhydroquinone | 0.03 |
| Gelatin | 0.95 |

11th Layer: First Blue-sensitive Emulsion Layer

| | |
|---|---|
| Silver iodobromide emulsion (AgI content = 6 mole %; average grain size = 0.6μ) | 0.24 (Ag) |
| Sensitizing dye VIII | $3.5 \times 10^{-4}$ |
| C-9 | 0.27 |
| C-8 | 0.005 |
| HBS-1 | 0.28 |
| Gelatin | 1.28 |

12th Layer: Second Blue-sensitive Emulsion Layer

| | |
|---|---|
| Silver iodobromide emulsion (AgI content = 10 mole %; average grain size = 1.0μ) | 0.45 (Ag) |
| Sensitizing dye VIII | $2.1 \times 10^{-4}$ |
| C-9 | 0.098 |
| HBS-1 | 0.03 |
| Gelatin | 0.46 |

13th Layer: Third Blue-sensitive Emulsion Layer

| | |
|---|---|
| Silver iodobromide emulsion (AgI content = 10 mole %; average grain size = 1.8μ) | 0.77 (Ag) |
| Sensitizing dye VIII | $2.2 \times 10^{-4}$ |

-continued

| | |
|---|---|
| C-9 | 0.036 |
| HBS-1 | 0.07 |
| Gelatin | 0.69 |

10th Layer: First Protective Layer

| | |
|---|---|
| Silver iodobromide emulsion (AgI content = 1 mole %; average grain size = 0.07μ) | 0.5 (Ag) |
| U-1 | 0.11 |
| U-2 | 0.17 |
| Butyl p-hydroxybenzoate | 0.012 |
| HBS-1 | 0.90 |

15th Layer: Second Protective Layer

| | |
|---|---|
| Polymethylmethacrylate particles (diameter: 1.5μ) | 0.54 |
| S-1 | 0.15 |
| S-2 | 0.10 |
| Gelatin | 0.72 |

In each layer, a hardening agent of gelatin (H-1) and a surfactant were added in addition to the foregoing components.

Samples $N_6$ and $N_7$

Samples $N_6$ and $N_7$ were prepared in the same manner as described above in connection with Sample $N_5$ except that equivalent moles of C-11 and C-12 was used in 3rd and 4th layers in place of C-10. The structural formula or nomenclature of each compound used in preparing Samples $N_5$ to $N_7$ was as follows.

U-1

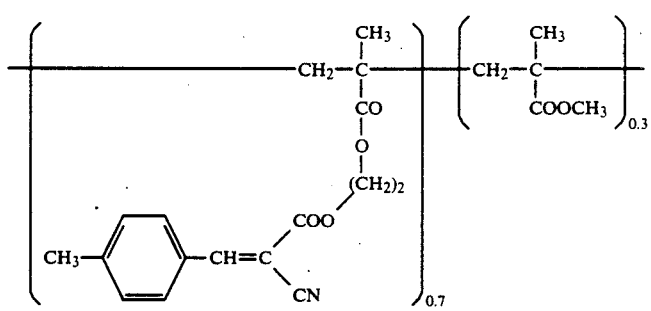

U-2

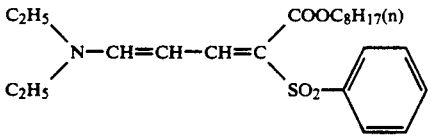

C-1

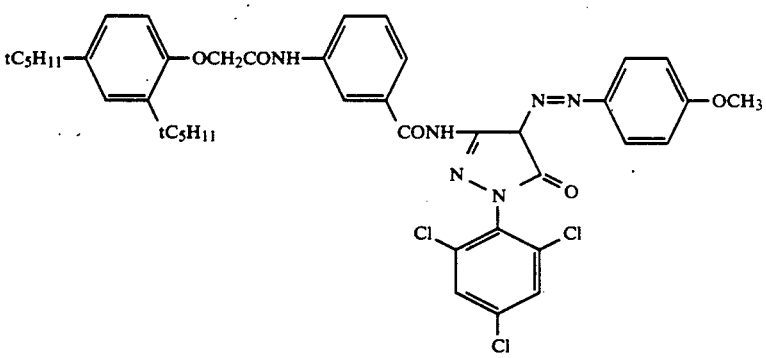

C-2

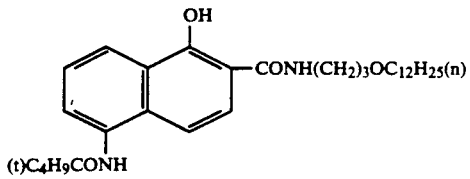

-continued
C-3
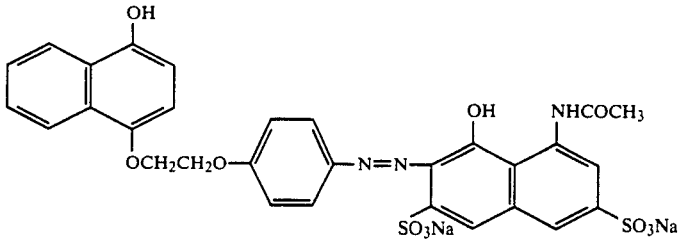
C-4
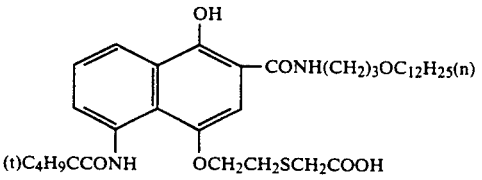
C-5
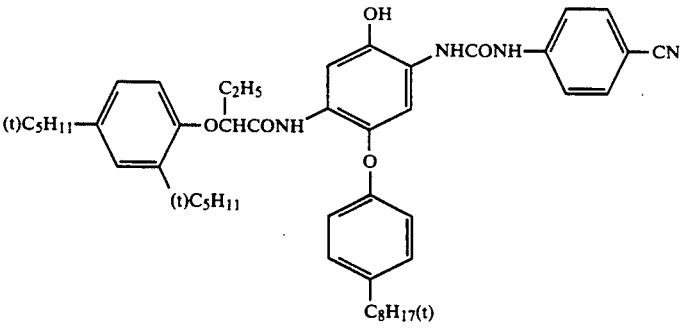
C-6
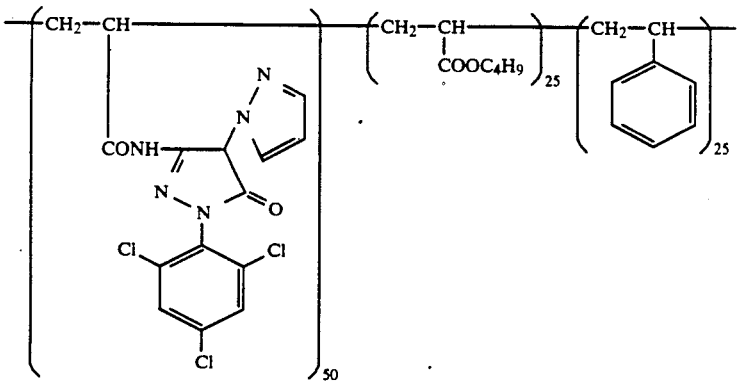
Average Molecular Weight: 30000
C-7
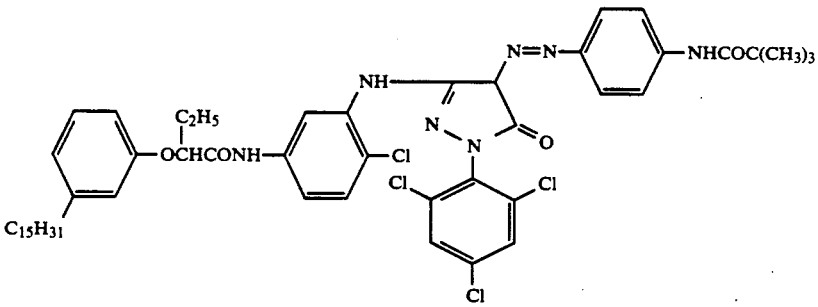

-continued
C-8
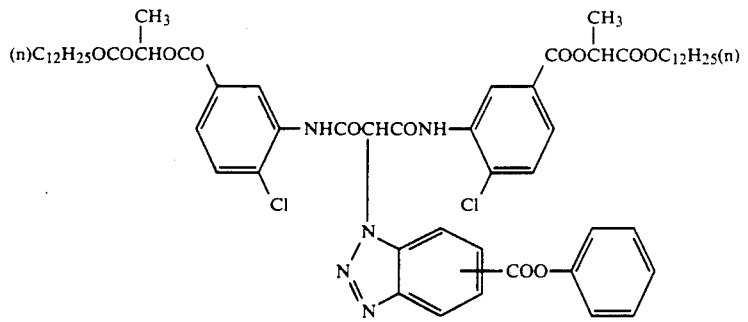
(Coupler disclosed in U.S. Pat. No. 4,477,563)
C-9
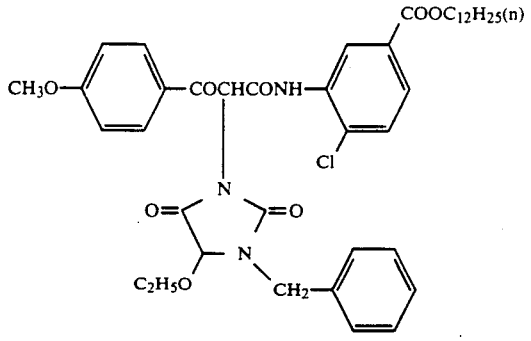
C-10
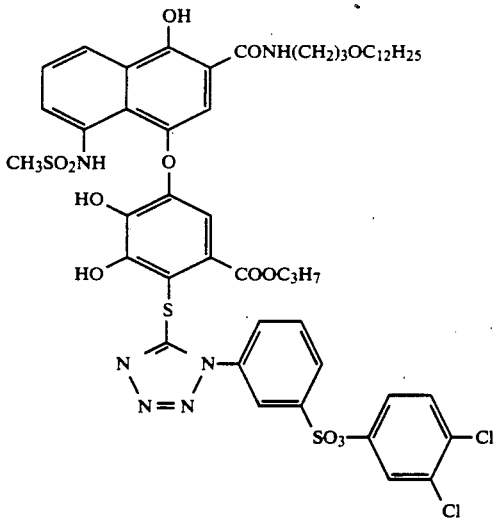
C-11
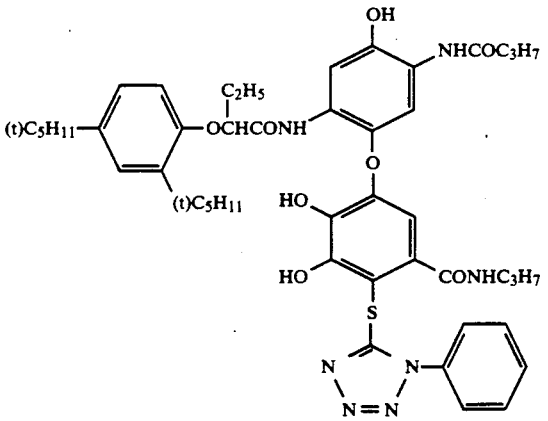

-continued
C-12
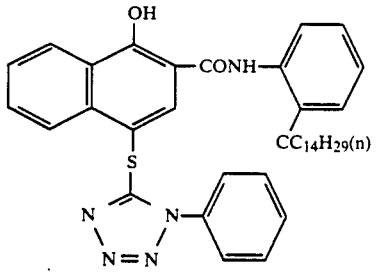
(Coupler disclosed in U.S. Pat. No. 3,227,554)
C-13
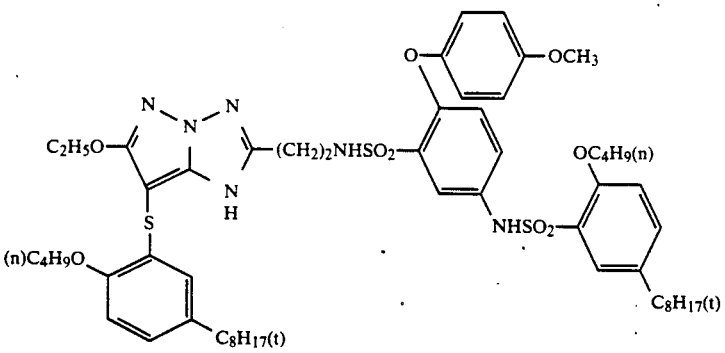
S-1
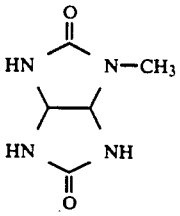
S-2
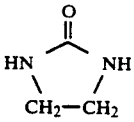
Tricresylphosphate HBS-1
Dibutylphthalate HBS-2
H-1
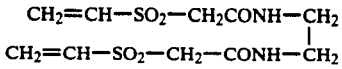
Sensitizing Dye
I
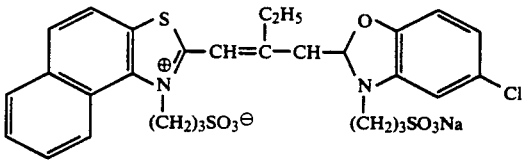
II
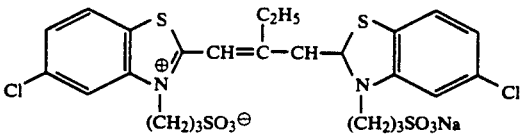

-continued
III
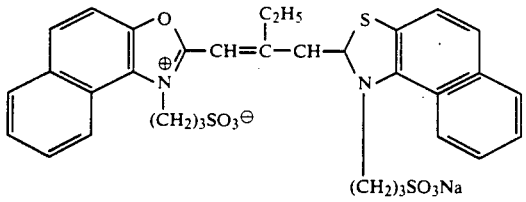
IV
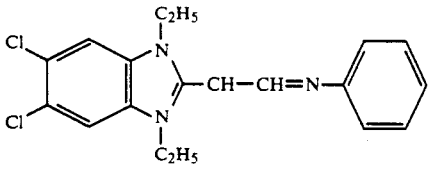
V
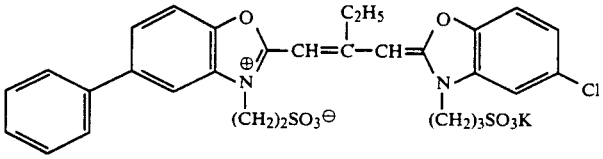
VI
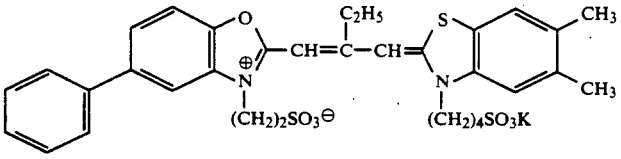
VII
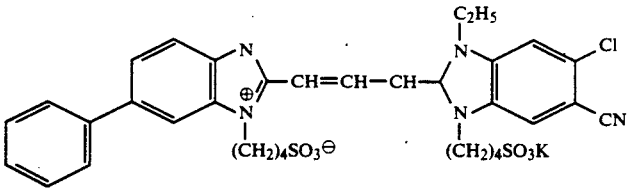
VIII
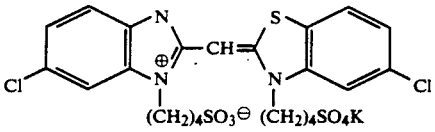
IX
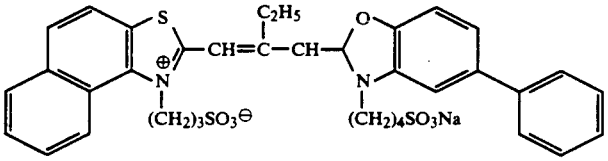
X
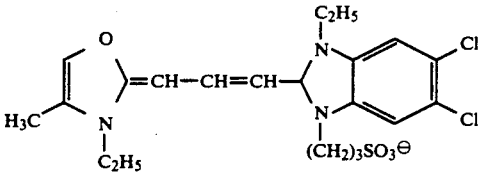
Sample N8
1st Layer: Antihalation Layer
| | |
|---|---|
| Black colloidal silver | 0.18 (Ag) |
-continued
| | |
|---|---|
| Gelatin | 0.40 |
2nd Layer: Intermediate Layer
| | |
|---|---|
| 2,5-di-tert-pentadecylhydroquinone | 0.18 |

-continued

| | |
|---|---|
| C-1 | 0.07 |
| C-3 | 0.02 |
| U-1 | 0.08 |
| U-2 | 0.08 |
| HBS-1 | 0.10 |
| HBS-2 | 0.02 |
| Gelatin | 1.04 |

3rd Layer: First Red-sensitive Emulsion Layer

| | |
|---|---|
| Silver iodobromide emulsion (AgI content = 6 mole %; average grain size = 0.8 μ) | 0.50 (Ag) |
| Sensitizing dye IX | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| C-2 | 0.146 |
| HBS-1 | 0.40 |
| C-10 | 0.008 |
| Gelatin | 1.20 |

4th Layer: Second Red-sensitive Emulsion Layer

| | |
|---|---|
| Silver iodobromide emulsion (AgI content = 5 mole %; average grain size = 0.85μ) | 1.15 (Ag) |
| Sensitizing dye IX | $5.1 \times 10^{-5}$ |
| Sensitzing dye II | $1.4 \times 10^{-5}$ |
| Sensitizing dye III | $2.3 \times 10^{-4}$ |
| Sensitizing dye IV | $3.0 \times 10^{-5}$ |
| C-2 | 0.060 |
| C-3 | 0.008 |
| C-10 | 0.004 |
| HBS-2 | 0.40 |
| Gelatin | 1.50 |

5th Layer: Third Red-sensitive Emulsion Layer

| | |
|---|---|
| Silver iodobromide emulsion (AgI content = 10 mole %; average grain size = 1.5μ) | 1.50 (Ag) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| C-5 | 0.012 |
| C-3 | 0.003 |
| C-4 | 0.004 |
| HBS-1 | 0.32 |
| Gelatin | 1.63 |

6th Layer: Intermediate Layer

| | |
|---|---|
| Gelatin | 1.06 |

7th Layer: First Green-sensitive Emulsion Layer

| | |
|---|---|
| Silver iodobromide emulsion (AgI content = 6 mole %; average grain size = 0.8μ) | 0.35 (Ag) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| C-6 | 0.120 |
| C-1 | 0.021 |
| C-7 | 0.030 |
| C-8 | 0.025 |
| HBS-1 | 0.20 |

-continued

| | |
|---|---|
| Gelatin | 0.70 |

8th Layer: Second Green-sensitive Emulsion Layer

| | |
|---|---|
| Silver iodobromide emulsion (AgI content = 5 mole %; average grain size = 0.85μ) | 0.75 (Ag) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| C-6 | 0.018 |
| C-8 | 0.004 |
| C-1 | 0.002 |
| C-7 | 0.003 |
| C-11 | 0.008 |
| HBS-1 | 0.10 |
| HBS-2 | 0.05 |
| Gelatin | 0.80 |

9th Layer: Third Green-sensitive Emulsion Layer

| | |
|---|---|
| Silver iodobromide emulsion (AgI content = 10 mole %; average grain size = 1.2μ) | 1.80 (Ag) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| C-6 | 0.011 |
| C-1 | 0.001 |
| HBS-2 | 0.69 |
| Gelatin | 1.74 |

10th Layer: Yellow Filter Layer

| | |
|---|---|
| Yellow colloidal silver | 0.05 (Ag) |
| 2,5-di-tert-pentadecylhydroquinone | 0.03 |
| Gelatin | 0.95 |

11th Layer: First Blue-sensitive Emulsion Layer

| | |
|---|---|
| Silver iodobromide emulsion (AgI content = 6 mole %; average grain size = 0.6μ) | 0.24 (Ag) |
| Sensitizing dye VIII | $3.5 \times 10^{-4}$ |
| C-9 | 0.27 |
| C-8 | 0.005 |
| HBS-1 | 0.28 |
| Gelatin | 1.28 |

12nd Layer: Second Blue-sensitive Emulsion Layer

| | |
|---|---|
| Silver iodobromide emulsion (AgI content = 10 mole %; average grain size = 1.0μ) | 0.45 (Ag) |
| Sensitizing dye VIII | $2.1 \times 10^{-4}$ |
| C-9 | 0.098 |
| HBS-1 | 0.03 |
| Gelatin | 0.46 |

13th Layer: Third Bluesensitive Emulsion Layer

| | |
|---|---|
| Silver iodobromide emulsion (AgI content = 10 mole %; average grain size = 1.8μ) | 0.77 (Ag) |
| Sensitizing dye VIII | $2.2 \times 10^{-4}$ |
| C-9 | 0.036 |
| HBS-1 | 0.07 |

-continued

| | |
|---|---|
| Gelatin | 0.69 |

14th Layer: First Protective Layer

| | |
|---|---|
| Silver iodobromide emulsion (AgI content = 1 mole %; average grain size = 0.07μ) | 0.5 (Ag) |
| U-1 | 0.11 |
| U-2 | 0.17 |
| HBS-1 | 0.90 |
| Gelatin | 0.95 |

15th Layer: Second Protective Layer

| | |
|---|---|
| Polymethylmethacrylate particles (diameter = about 1.5μ) | 0.54 |
| S-1 | 0.15 |
| S-2 | 0.05 |
| Gelatin | 0.72 |

To each of these layers, a hardening agent for gelatin (H-1) and a surfactant were added in addition to the foregoing components. The structural formula and nomenclature of each compounds used in preparing Sample $N_8$ were as follows:

U-1

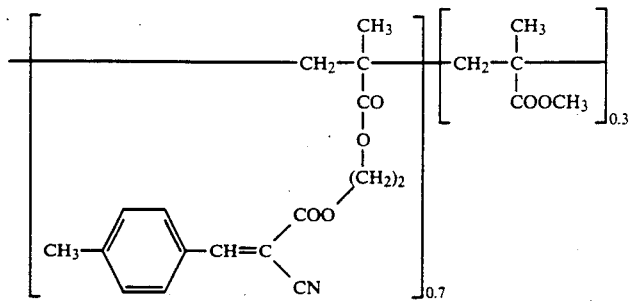

U-2

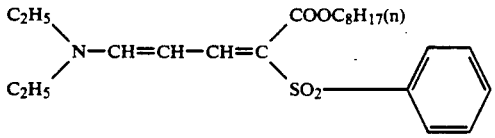

C-1

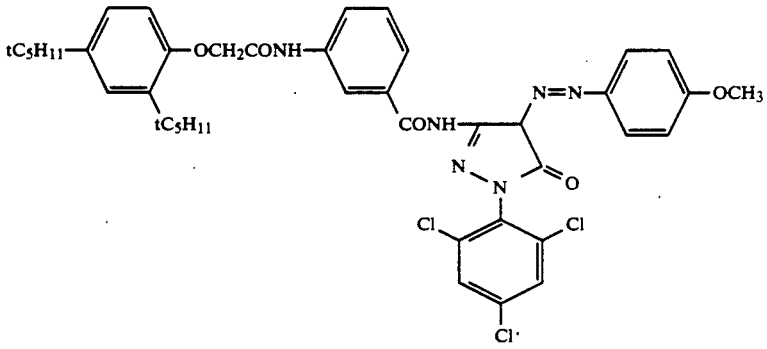

C-2

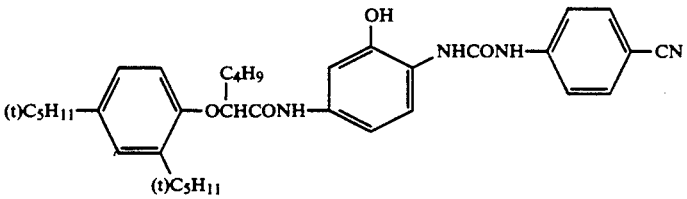

C-3

-continued
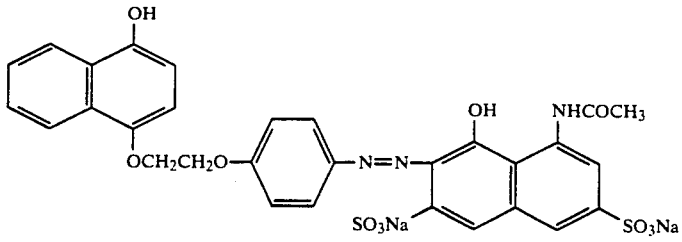
C-4
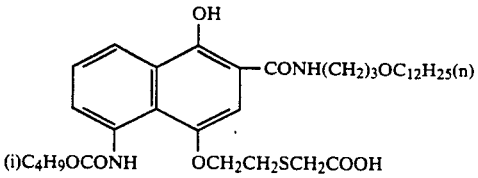
C-5
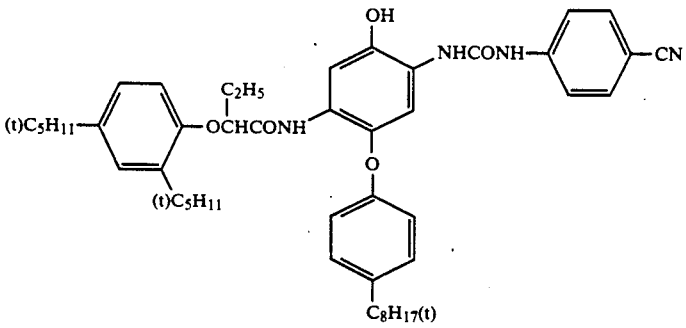
C-6
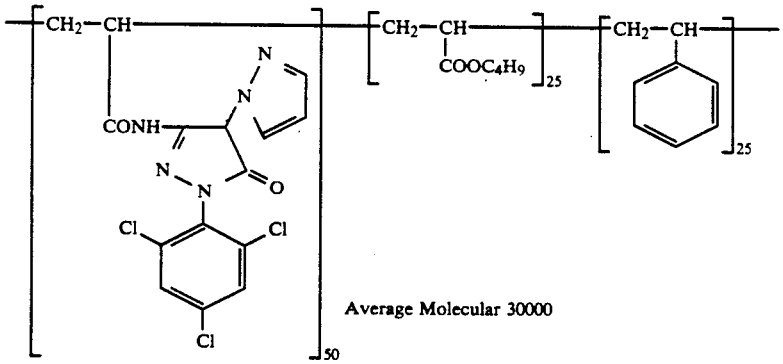
C-7
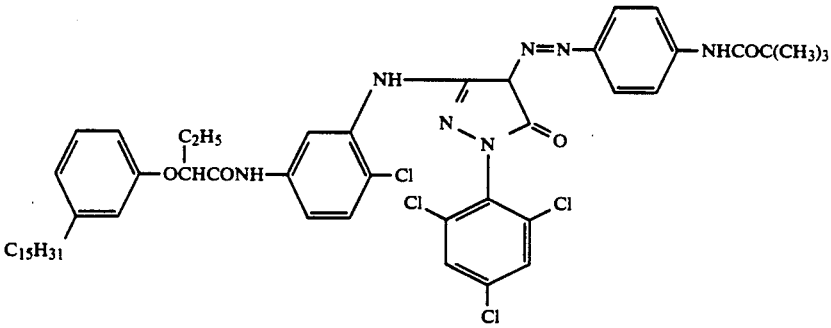
C-8

-continued
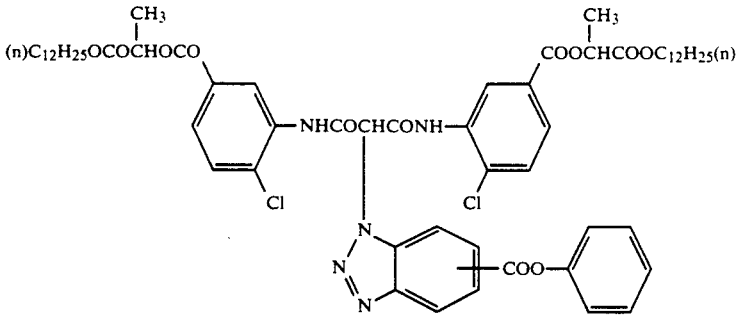
C-9
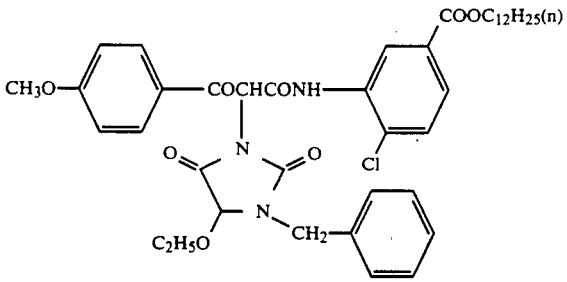
C-10
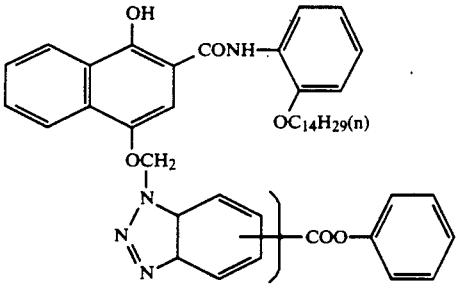
C-11
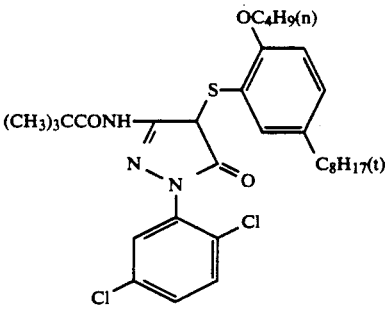
HBS-1
Tricresylphosphate
HBS-2
Dibutylphthalate
HBS-3
Tri-n-hexylphosphate
H-1
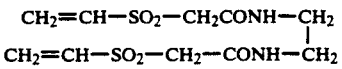
Sensitizing Dye -continued

I

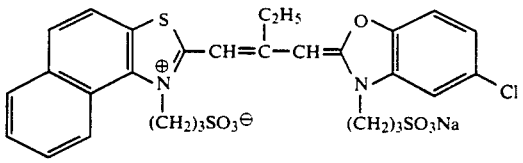

II

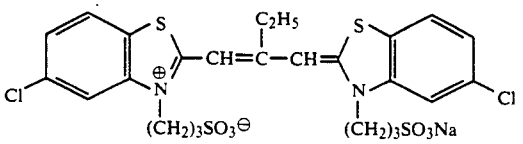

III

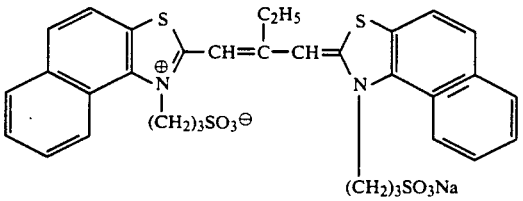

IV

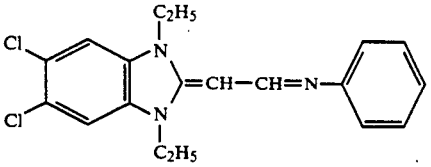

V

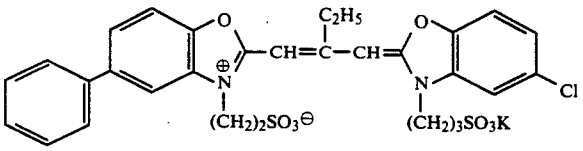

VI

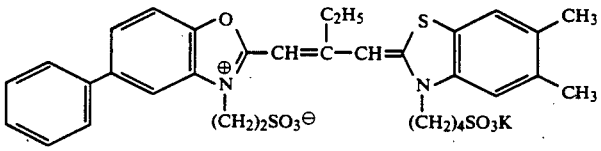

VII

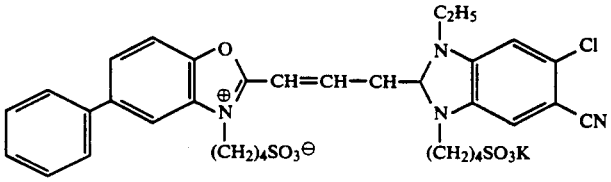

VIII

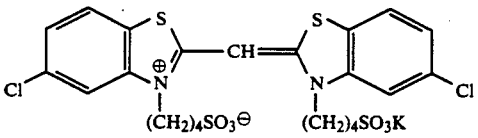

Sample N9

1st Layer: Antihalation Layer

A layer of gelatin containing black colloidal silver;

2nd Layer: Intermediate Layer

A layer of gelatin containing an emulsified dispersion of 2,5-di-tert-octylhydroquinone;

3rd Layer: Low Sensitive Red-sensitive Emulsion Layer (a gelatin layer containing the following components):

| | |
|---|---|
| Silver iodobromide emulsion (AgI content: 5 mole %) | 1.6 g/m$^2$ (Ag) |
| Sensitizing dye I | $6 \times 10^{-5}$ moles per mole of Ag |
| Sensitizing dye II | $1.5 \times 10^{-5}$ moles per mole of Ag |
| Coupler EX-1 | 0.04 moles per mole of Ag |
| Coupler EX-2 | 0.003 moles |

-continued

| | |
|---|---|
| Coupler EX-3 | per mole of Ag 0.0006 moles per mole of Ag |

4th Layer: High Sensitive Red-sensitive Emulsion Layer (a gelatin layer containing the following components):

| | |
|---|---|
| Silver iodobromide emulsion (AgI content = 10 mole %) | 1.4 g/m$^2$ (Ag) |
| Sensitizing dye I | $3 \times 10^{-5}$ moles per mole of Ag |
| Sensitizing dye II | $1.2 \times 10^{-5}$ moles per mole of Ag |
| Coupler EX-4 | 0.01 moles per mole of Ag |
| Coupler EX-10 | 0.01 moles per mole of Ag |

5th Layer: Intermediate Layer

The same layer as the foregoing 2nd layer;

6th Layer: Low Sensitive Green-sensitive Emulsion Layer (a gelatin layer containing the following components):

| | |
|---|---|
| Monodisperse silver iodobromide emulsion (AgI content = 4 mole %) | 1.2 g/m$^2$ (Ag) |
| Sensitizing dye III | $3 \times 10^{-5}$ moles per mole of Ag |
| Sensitizing dye IV | $1 \times 10^{-5}$ moles per mole of Ag |
| Coupler EX-5 | 0.05 moles per mole of Ag |
| Coupler EX-6 | 0.008 moles per mole of Ag |
| Coupler EX-3 | 0.0015 moles per mole of Ag |

7th Layer: High Sensitive Green-Sensitive Emulsion Layer (a gelatin layer containing the following components):

| | |
|---|---|
| Silver iodobromide emulsion (AgI content = 10 mole %) | 1.3 g/m$^2$ (Ag) |
| Sensitizing dye III | $2.5 \times 10^{-5}$ moles per mole of Ag |
| Sensitizing dye IV | $0.8 \times 10^{-5}$ moles per mole of Ag |
| Coupler EX-7 | 0.017 moles per mole of Ag |
| Coupler EX-6 | 0.003 moles |

-continued

| | |
|---|---|
| Coupler EX-8 | per mole of Ag 0.003 moles per mole of Ag |

8th Layer: Yellow Filter Layer

A gelatin layer of an aqueous gelatin solution containing yellow colloidal silver and an emulsified dispersion of 2,5-di-tert-octylhydroquinone;

9th Layer: Low Sensitive Blue-sensitive Emulsion Layer (a gelatin layer containing the following components):

| | |
|---|---|
| Silver iodobromide emulsion (AgI content = 4 mole %) | 0.7 g/m$^2$ (Ag) |
| Coupler EX-9 | 0.25 moles per mole of Ag |
| Coupler EX-3 | 0.015 moles per mole of Ag |

10th Layer: High Sensitive Blue-sensitive Emulsion Layer (a gelatin layer containing the following components):

| | |
|---|---|
| Silver iodobromide emulsion (AgI content = 6 mole %) | 0.6 g/m$^2$ (Ag) |
| Coupler EX-9 | 0.06 moles per mole of silver |

11th Layer: First Protective Layer

A layer of gelatin containing 5 g/m$^2$ (Ag) of silver iodobromide emulsion (AgI content = 1 mole %; average grain size = 0.07 $\mu$) and an emulsified dispersion of an ultraviolet absorber UV-1;

12th Layer: Second Protective Layer

A layer of gelatin containing polymethylmethacrylate particles (diameter = about 1.5 $\mu$).

In addition to the aforementioned components, each layer contained a hardening agent for gelatin (H-1) or a surfactant. The compounds used for preparing this Sample were as follows:

Sensitizing dye I: Pyridinium salt of anhydro-5,5'-dichloro-3,3'-di-($\gamma$-sulfopropyl)-9-ethyl-thiacarbocyaninehydroxide.

Sensitizing dye II: Triethylamine salt of anhydro-9-ethyl-3,3'-di-($\gamma$-sulfopropyl)-4,5,4',5'-dibenzothiacarbocyaninehydroxide.

Sensitizing dye III: Sodium salt of anhydro-9-ethyl-5,5'-dichloro-3,3'-di-($\gamma$-sulfopropyl)-oxacarbocyanine.

Sensitizing dye IV: Sodium salt of anhydro-5,6,5'-6'-tetrachloro-1,1'-diethyl-3,3'-di-{$\beta$-[$\beta$-($\gamma$-sulfopropyl)ethoxy]ethyl}-imidazolocarbocyaninehydroxide.

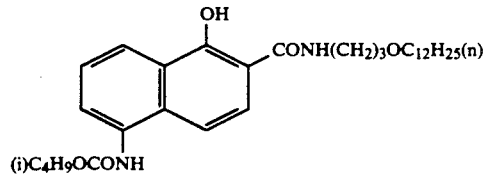

EX-1

-continued
EX-2
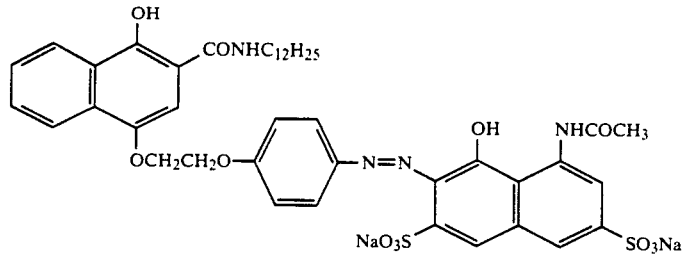
EX-3
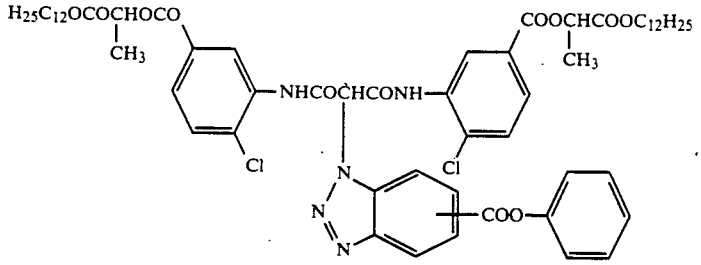
EX-4
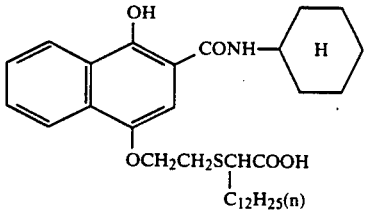
EX-5
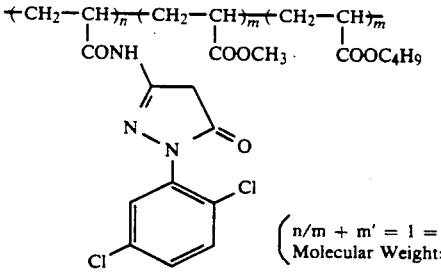
(n/m + m' = 1 = m + m' = 1 (weight ratio)
Molecular Weight: about 40,000)
EX-6
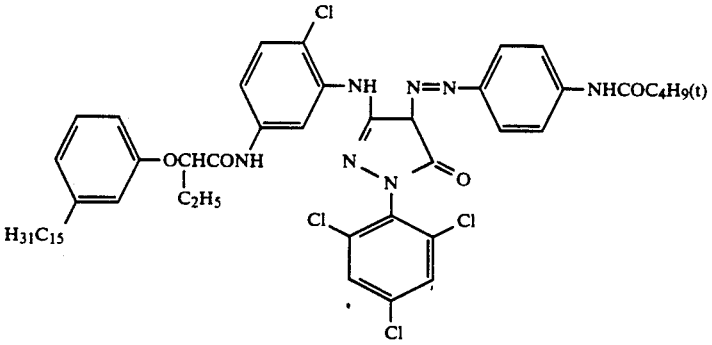

-continued
EX-7
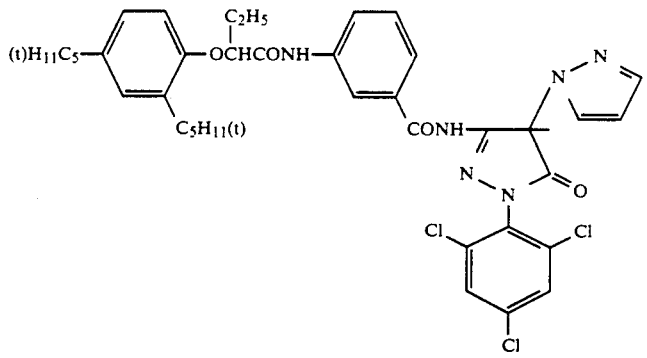
EX-8
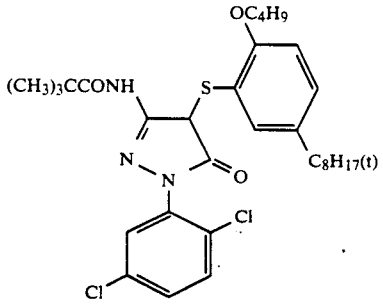
EX-9
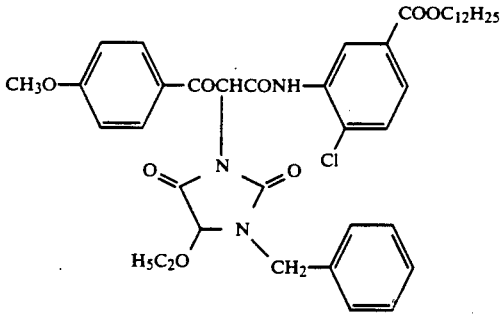
EX-10
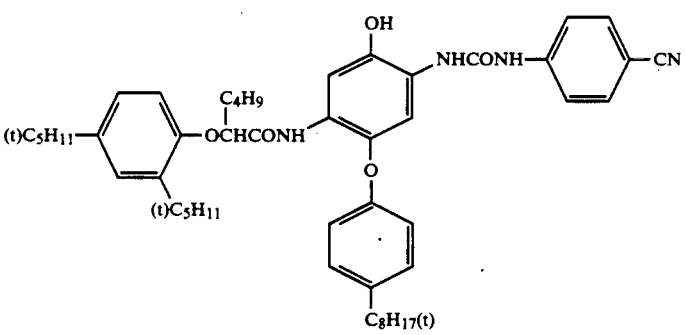
H-1
$CH_2{=}CH{-}SO_2{-}CH_2{-}CONH{-}(CH_2)_2NHCOCH_2SO_2CH{=}CH_2$
UV-1
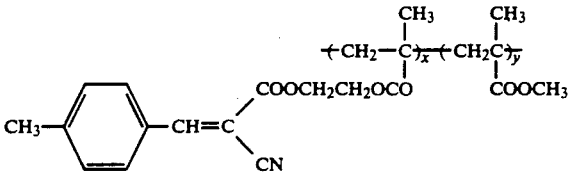
x/y = 7/3 (Weight ratio)

Sample $N_{10}$

1st Layer: Antihalation Layer (A layer of gelatin containing the following listed components:

| | |
|---|---|
| Black colloidal silver | 0.18 g/m$^2$ |
| Ultraviolet absorber C-1 | 0.12 g/m$^2$ |
| Ultraviolet absorber C-2 | 0.17 g/m$^2$ |

2nd Layer: Intermediate Layer (A layer of gelatin containing the following components):

| | |
|---|---|
| 2,5-di-tert-pentadecylhydroquinone | 0.18 g/m$^2$ |
| Coupler C-3 | 0.03 g/mm$^2$ |
| Silver iodobromide emulsion (AgI content = 1 mole %; average grain size = 0.07μ) | 0.15 g/m$^2$ (Ag) |

3rd Layer: First Red-sensitive Emulsion Layer (A gelatin layer containing the following components):

| | |
|---|---|
| Silver iodobromide emulsion (AgI content = 6 mole %; average grain size = 0.6μ) | 0.72 g/m$^2$ (Ag) |
| Sensitizing dye I | 7.0 × 10$^{-5}$ moles per mole of silver |
| Sensitizing dye II | 2.0 × 10$^{-5}$ moles per mole of silver |
| Sensitizing dye III | 2.8 × 10$^{-4}$ moles per mole of silver |
| Sensitizing dye IV | 2.0 × 10$^{-5}$ moles per mole of silver |
| Coupler C-4 | 0.320 g/m$^2$ |
| Coupler C-5 | 0.010 g/m$^2$ |
| Coupler C-3 | 0.050 g/m$^2$ |

4th Layer: Second Red-sensitive Emulsion Layer (A gelatin layer containing the following components):

| | |
|---|---|
| Silver iodobromide emulsion (AgI content = 10 mole %; average grain size = 1.5μ) | 1.6 g/m$^2$ (Ag) |
| Sensitizing dye I | 5.2 × 10$^{-5}$ moles per mole of silver |
| Sensitizing dye II | 1.5 × 10$^{-5}$ moles per mole of silver |
| Sensitizing dye III | 2.1 × 10$^{-4}$ moles per mole of silver |
| Sensitizing dye IV | 1.5 × 10$^{-5}$ moles per mole of silver |
| Coupler C-4 | 0.050 g/m$^2$ |
| Coupler C-6 | 0.210 g/m$^2$ |
| Coupler C-3 | 0.090 g/m$^2$ |

5th Layer: Third Red-sensitive Emulsion Layer (a layer of gelatin containing the following components):

| | |
|---|---|
| Silver iodobromide emulsion (AgI content = 10 mole %; average grain size = 2.0μ) | 1.6 g/m$^2$ (Ag) |
| Sensitizing dye I | 5.5 × 10$^{-5}$ moles per mole of silver |
| Sensitizing dye II | 1.6 × 10$^{-5}$ moles per mole of silver |
| Sensitizing dye III | 2.2 × 10$^{-5}$ moles per mole of silver |
| Sensitizing dye IV | 1.5 × 10$^{-5}$ moles per mole of silver |
| Coupler C-6 | 0.180 g/m$^2$ |
| Coupler C-3 | 0.005 g/m$^2$ |

6th Layer: Intermediate Layer (a gelatin layer)

7th Layer: First Green-sensitive Emulsion Layer (a layer of gelatin containing the following components):

| | |
|---|---|
| Silver iodobromide emulsion (AgI content = 5 mole %; average grain size = 0.5μ) | 0.55 g/m$^2$ (Ag) |
| Sensitizing dye V | 3.8 × 10$^{-4}$ moles per mole of silver |
| Sensitizing dye VI | 3.0 × 10$^{-5}$ moles per mole of silver |
| Sensitizing dye VII | 1.2 × 10$^{-4}$ moles per mole of silver |
| Coupler C-7 | 0.290 g/m$^2$ |
| Coupler C-8 | 0.040 g/m$^2$ |
| Coupler C-9 | 0.060 g/m$^2$ |

8th Layer: Second Green-sensitive Emulsion Layer (a layer of gelatin containing the components given below):

| | |
|---|---|
| Silver iodobromide emulsion (AgI content = 6 mole %; average grain size = 1.5μ) | 1.5 g/m$^2$ (Ag) |
| Sensitizing dye V | 2.7 × 10$^{-4}$ moles per mole of silver |
| Sensitizing dye VI | 2.1 × 10$^{-5}$ moles per mole of silver |
| Sensitizing dye VII | 8.5 × 10$^{-5}$ moles per mole of silver |
| Coupler C-7 | 0.210 g/m$^2$ |
| Coupler C-8 | 0.012 g/m$^2$ |
| Coupler C-9 | 0.009 g/m$^2$ |
| Coupler C-10 | 0.011 g/m$^2$ |

9th Layer: Intermediate Layer (a gelatin layer)

10th Layer: Third Green-sensitive Emulsion Layer (a layer of gelatin containing the following components):

| | |
|---|---|
| Silver iodobromide emulsion (AgI content = 10 mole %; average grain size = 2.0μ) | 1.5 g/m$^2$ (Ag) |
| Sensitizing dye V | 3.0 × 10$^{-4}$ moles per mole of silver |
| Sensitizing dye VI | 2.4 × 10$^{-5}$ moles per mole of silver |
| Sensitizing dye VII | 9.5 × 10$^{-5}$ moles per mole of silver |
| Coupler C-11 | 0.013 g/m$^2$ |
| Coupler C-10 | 0.070 g/m$^2$ |

11th Layer: Yellow Filter Layer (a layer of gelatin containing the following components):

| | |
|---|---|
| Dye Y-1 | 2.0 × 10$^{-4}$ moles/m$^2$ |
| 2,5-di-pentadecylhydroquinone | 0.031 g/m$^2$ |

12th Layer: First Blue-sensitive Emulsion Layer (a layer of gelatin containing the following components):

| | |
|---|---|
| Silver iodobromide emulsion (AgI content = 6 mole %; average grain size = 0.4μ) | 0.32 g/m$^2$ (Ag) |
| Coupler C-12 | 0.73 g/m$^2$ |
| Coupler C-13 | 0.052 g/m$^2$ |

13th Layer: Second Blue-sensitive Emulsion Layer (a layer of gelatin containing the following components):

| | |
|---|---|
| Silver iodobromide emulsion (AgI content = 10 mole %; average grain size = 1.0μ) | 0.40 g/m$^2$ (Ag) |
| Sensitizing dye VIII | 2.2 × 10$^{-4}$ moles per mole of silver |
| Coupler C-12 | 0.35 g/m$^2$ |

14th Layer: Emulsion Layer of finely divided Particles (a layer of gelatin containing the following components):

| | |
|---|---|
| Silver iodobromide emulsion (AgI content = 2 mole %; average grain size = 0.15μ) | 0.25 g/m$^2$ (Ag) |

15th Layer: Third Blue-sensitive Emulsion Layer (a gelatin layer containing the following components):

| | |
|---|---|
| Silver iodobromide emulsion (AgI content = 10 mole %; average grain size = 1.6μ) | 1.00 g/m$^2$ (Ag) |
| Sensitizing dye VIII | 2.3 × 10$^{-4}$ moles per |

-continued

| | |
|---|---|
| | mole of silver |
| Coupler C-12 | 0.15 g/m$^2$ |

16th Layer: First Protective Layer (a layer of gelatin containing the following components):

| | |
|---|---|
| Ultraviolet absorber C-1 | 0.14 g/m$^2$ |
| Ultraviolet absorber C-2 | 0.22 g/m$^2$ |

17th Layer: Second Protective Layer (a gelatin layer containing the following components):

| | |
|---|---|
| Polymethylmethacrylate particles (diameter = about 1.5μ) | 0.05 g/m$^2$ |
| Silver iodobromide emulsion (AgI content = 2 mole %; average grain size = 0.07μ) | 0.30 g/m$^2$ (Ag) |

In addition to the aforementioned components, each layer contained 4-hydroxy-6-methyl(1,3,3*a*,7)tetrazaindene as a stabilizer, a hardening agent for gelatin (H-1) and a surfactant.

The components used in preparing the sample were as follows:

Sensitizing Dye I

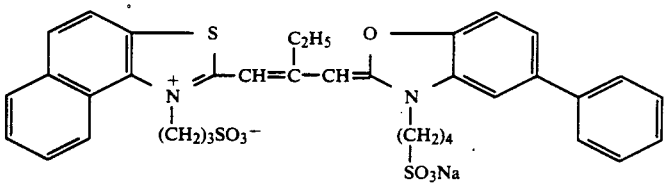

Sensitizing Dye II

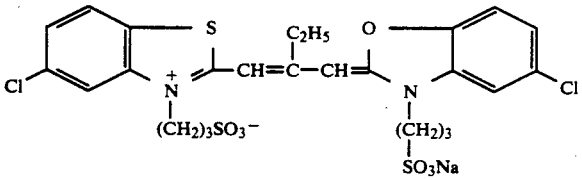

Sensitizing Dye III

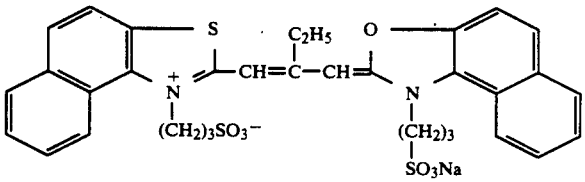

Sensitizing Dye IV

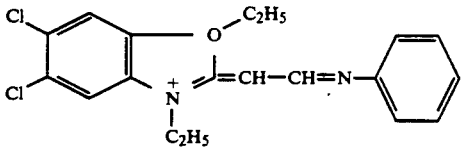

Sensitizing Dye V

-continued
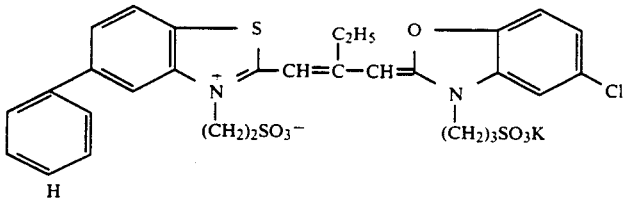
Sensitizing Dye VI
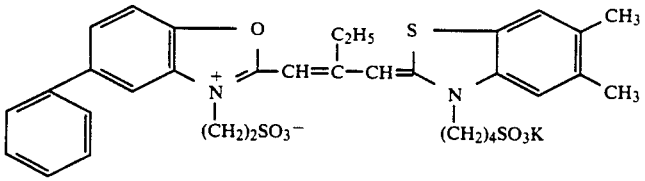
Sensitizing Dye VII
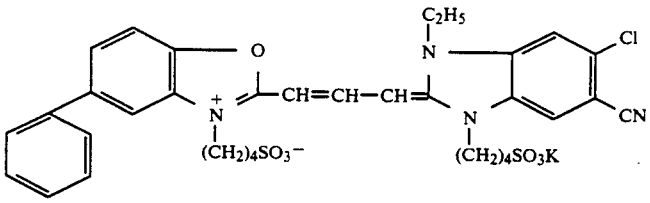
Sensitizing Dye VIII
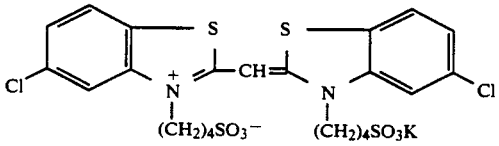
H-1
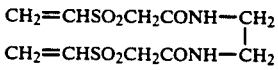
C-1
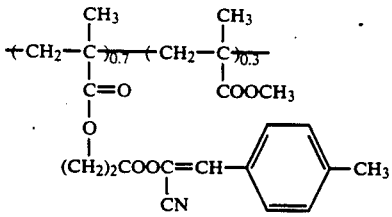
C-2
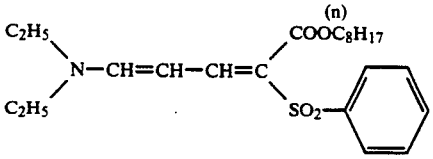
C-3
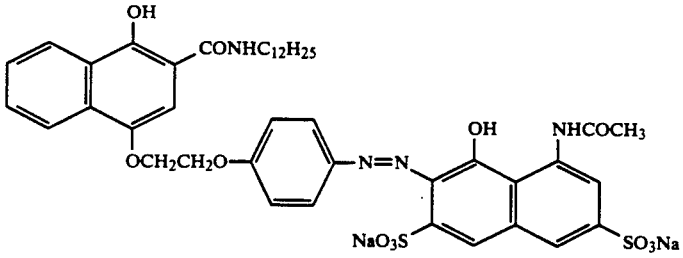

-continued
C-4
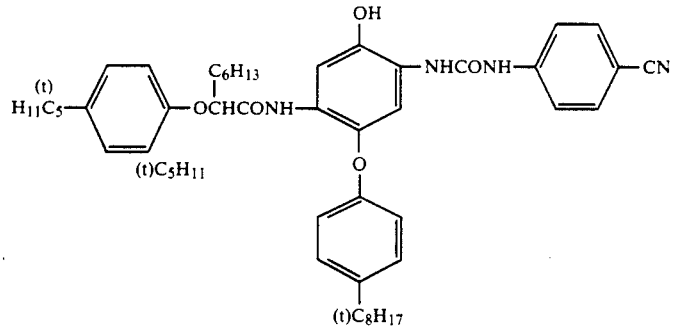
C-5
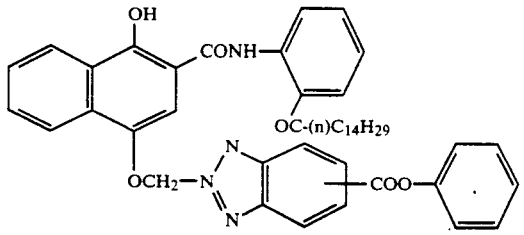
C-6
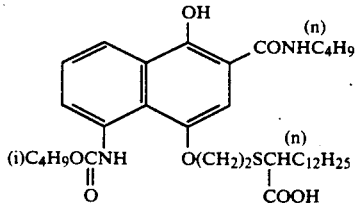
C-7
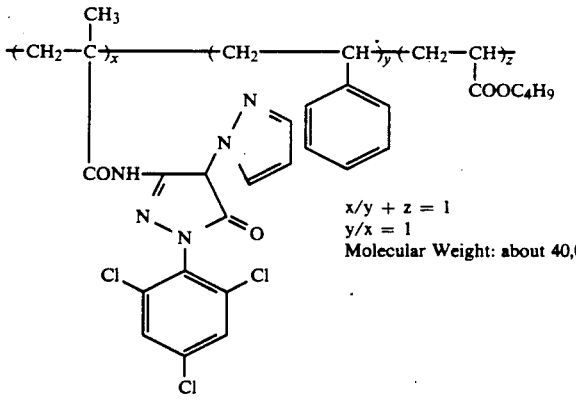
x/y + z = 1
y/x = 1
Molecular Weight: about 40,000
C-8
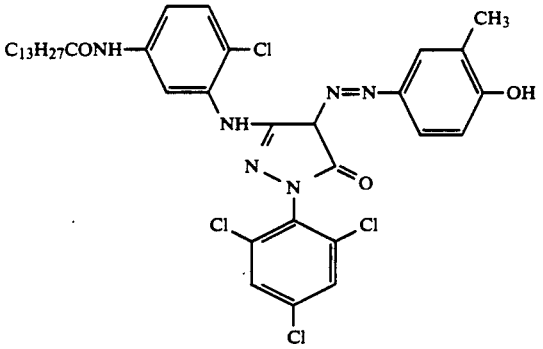
C-9

-continued
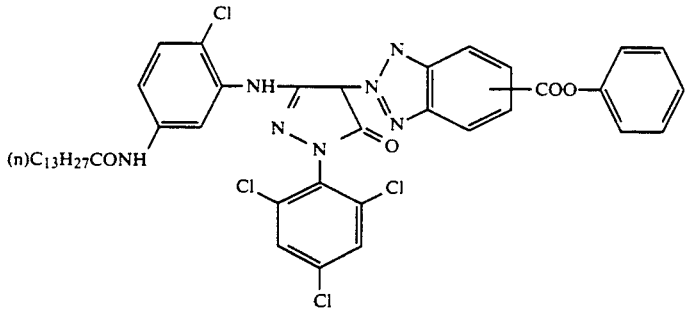
C-10
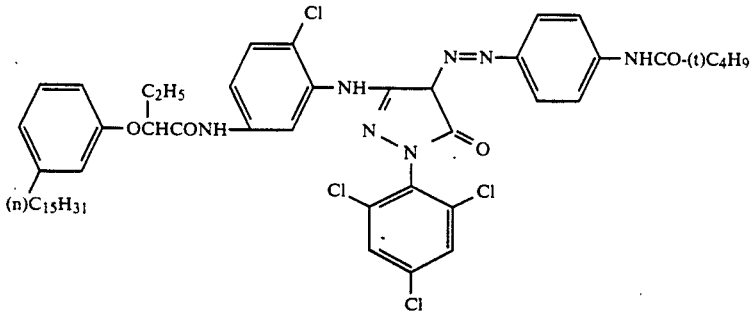
C-11
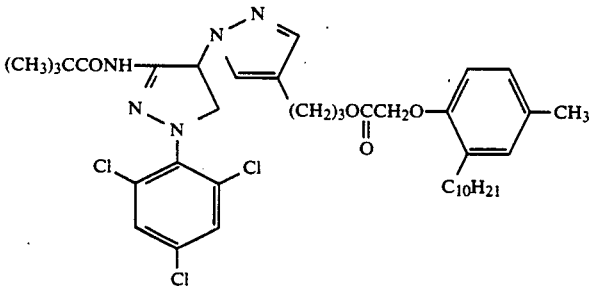
C-12
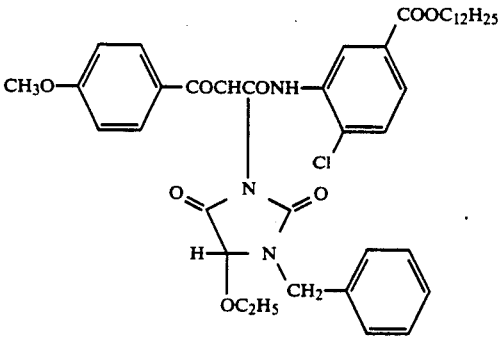
C-13
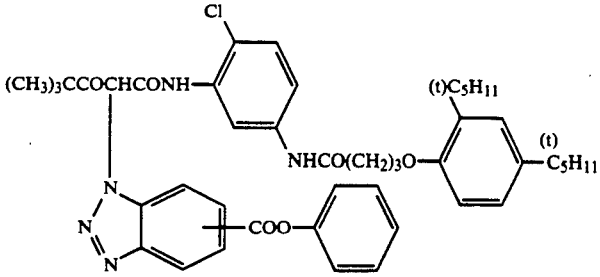
Y-1

-continued

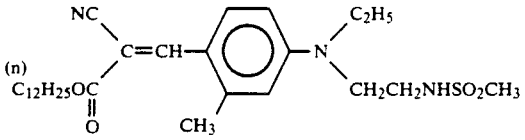

EXAMPLE 14

Color papers and color negative films were prepared according to the same procedures as in Examples 7 to 13 except that a part or whole of the yellow couplers, cyan couplers and magenta couplers as used in these Examples were replaced with the following ones and these color papers and color negative films were developed in the same manner as those disclosed in these Examples followed by washing with washing water from which calcium and magnesium were removed according to the present invention. Thus, excellent results similar to those attained in Examples 7 to 13 were observed.

Yellow Coupler (Y-1)

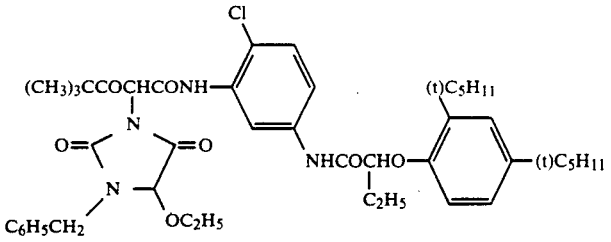

(Y-2)

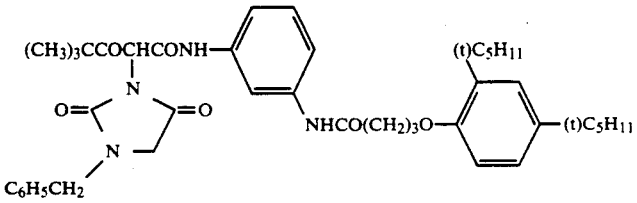

(Y-3)

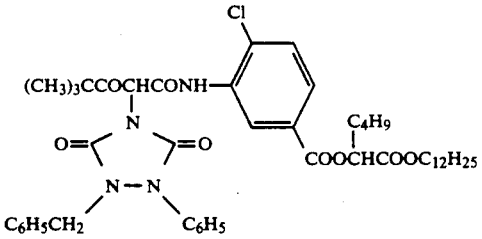

Magenta Coupler (M-1)

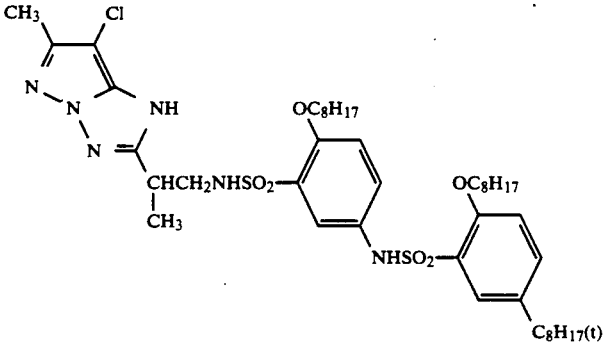

-continued
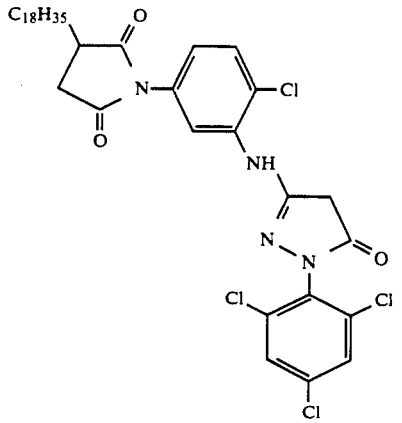
(M-2)
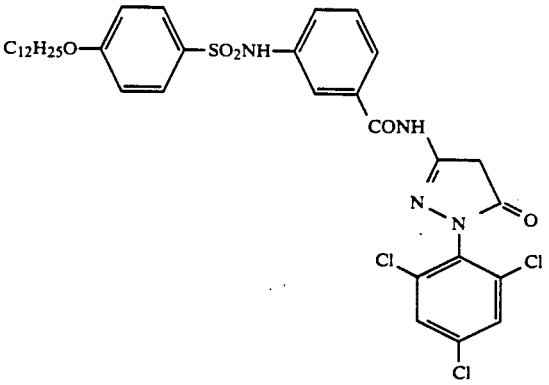
(M-3)
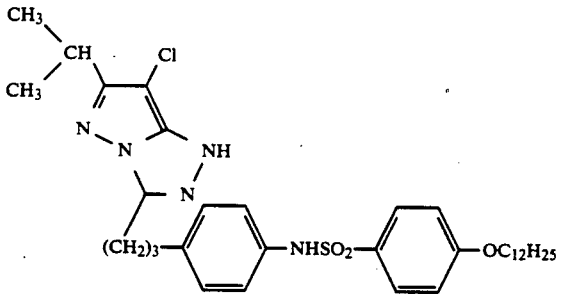
(M-4)
Cyan Coupler
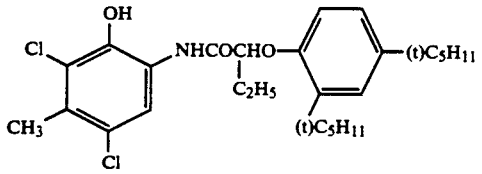
(C-1)
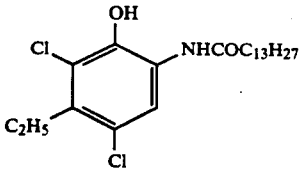
(C-2)

-continued (C-3)

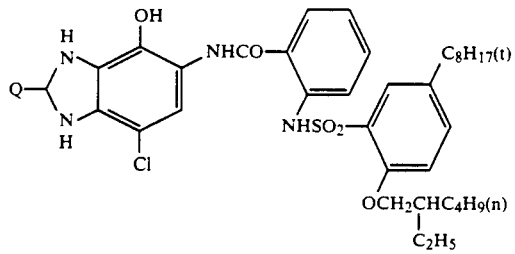

(C-4)

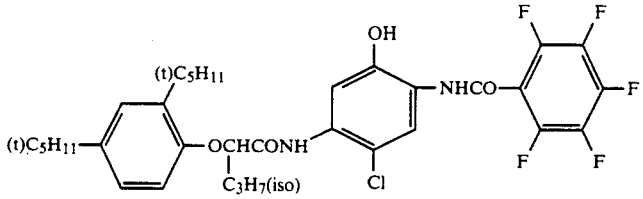

(C-5)

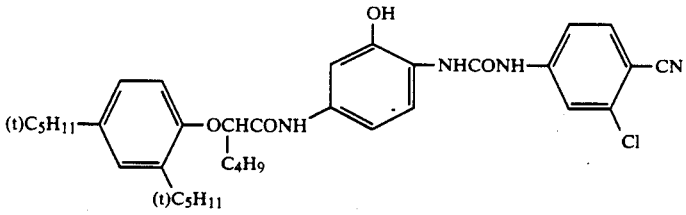

(C-6)

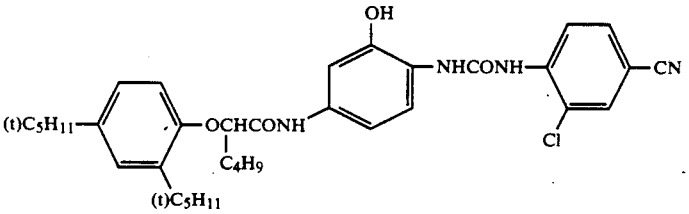

EXAMPLE 15

An X-ray photosensitive material (manufactured and sold under the trade name of HRA by Fuji Photo Film Co., Ltd.) was subjected to a running treatment utilizing a developer for X-ray films RD-V and a fixing liquid GF-1 (both of them are manufactured and sold by Fuji Photo Film Co., Ltd.)

TABLE 30

| Step | Processing Steps Temp. (°C.) | Time (sec.) | Amount Replenished* (ml) |
|---|---|---|---|
| Development | 35 | 24 | 55 |
| Fixing | 30 | 25 | 70 |
| Water Washing | 25 | 34 | 70 |
| Drying | 50-55 | 19 | — |

*The value was expressed as the amount per sheet of quart film.

In the above processing, water washing was carried out according to the water washing steps A to D in Example 7. The processing was effected at a rate of 5 sheets of quart film per day over 6 days followed by the out of the operation over 7 days and it was observed if there was formed a bacterial floating matter in the water washing bath during the out of the operation. As a result, the same effect as in Example 7 was achieved.

What is claimed is:

1. A method for processing silver halide photosensitive materials which comprises developing an exposed silver halide photosensitive material, fixing the developed photosensitive material and then washing the fixed material with washing water, wherein the washing water is replenished with a wash water replenisher wherein the volume of the replenisher is 1 to 50 times the volume of the liquid which is carried over by the photosensitive material from bath preceding the water washing bath per unit area of the photosensitive material and further wherein the amount of calcium and magnesium compounds present in the final bath in the water washing process is reduced to not more than 5 mg/l respectively, based on the weight of elemental calcium or magnesium, and the amount of calcium and magnesium compounds present in the washing water replenisher is not more than 5 mg/l, respectively, on the basis of elemental calcium and magnesium.

2. A method for processing as set forth in claim 1 wherein the water washing process is a multistage washing system comprising at least two water washing baths and replenishment of the washing water is carried out according to multistage countercurrent system.

3. A method for processing as set forth in claim 1 wherein the washing water is passed through a column packed with an ion exchange resin or treated with an apparatus for reverse osmosis to reduce the amount of calcium and magnesium compounds present in the replenishing washing water to not more than 5 mg/l, respectively, on the basis of the weight of elemental calcium or magnesium.

4. A method for processing as set forth in claim 1 wherein the amount of calcium and magnesium compounds present in the replenishing washing water is not more than 3 mg/l, respectively, on the basis of the weight of elemental calcium or magnesium.

5. A method for processing as set forth in claim 1 wherein the amount of calcium and magnesium compounds present in the replenishing washing water is not more than 2 mg/l, respectively, on the basis of the weight of elemental calcium or magnesium.

6. A method for processing as set forth in claim 1 wherein the replenishment of the washing water is carried out in an amount of 3 to 30 times of the volume liquid carried over by the photosensitive material from the bath preceding the water washing bath per unit area thereof.

7. A method for processing as set forth in claim 1 wherein at least one bath among the water washing baths and a replenishing tank therefor is irradiated with ultraviolet light.

8. A method for processing as set forth in claim 1 wherein the fixing is carried out with a fixing solution or a bleach-fixing solution.

9. A method for processing as set forth in claim 1 wherein the washing water is passed through a column packed with an ion exchange resin or treated with an apparatus for reverse osmosis to reduce the amount of calcium and magnesium compounds present in the final bath in the water washing process to not more than 5 mg/l, respectively, on the basis of the weight of elemental calcium or magnesium.

10. A method for processing as set forth in claim 1 wherein the washing water is replenished to the water washing bath in an amount of 1 to 50 times of the volume of liquid carried over by the photosensitive material from a bath preceding the water washing bath per unit area thereof.

11. A method for processing as set forth in claim 1 wherein the calcium and magnesium compounds are removed by treating the replenishing washing water with an ion exchange resin, zeolite or an apparatus for reverse osmosis.

12. A method for processing as set forth in claim 1 wherein the replenishing washing water is stabilized by adding an antibacterial or antifungus agent thereto or filtering it through a filter having an effective pore size of not more than 0.8 $\mu$.

13. A method for processing as set forth in claim 12 wherein the antibacterial or antifungus agent is at least one member selected from the group consisting of active halogen atom-releasing compounds, isothiazolone type compounds, benzoisothiazolone compounds, organoarsenide compounds and silver ion-releasing compounds.

14. A method for processing as set forth in claim 13 wherein the antibacterial or antifungus agent is at least one active halogen atom-releasing compound and the amount thereof falls within the range of 0.1 to 100 mg/l.

15. A method for processing as set forth in claim 13 wherein the antibacterial or antifungus agent is at least one silver ion-releasing compound and the amount thereof falls within the range of 0.005 to 10 mg/l.

16. A method for processing as set forth in claim 12 wherein the filter has a pore size of not more than 0.5 $\mu$.

17. A method for processing as set forth in claim 12 wherein the filter has a pore size of not more than 0.3 $\mu$.

18. A method for processing as set forth in claim 1 wherein the washing process is carried out subsequent to a process capable of fixing and the photosensitive material is a color photographic photosensitive material.

* * * * *

UNITED STATES PATENT AND TRADEMARK OFFICE

CERTIFICATE OF CORRECTION

PATENT NO. : 5,055,381

DATED : October 8, 1991

INVENTOR(S) : Akira ABE, et al.

It is certified that error appears in the above-identified patent and that said Letters Patent is hereby corrected as shown below:

On title page, item [75], add the following;

Kazuhiro AIKAWA, Minami-Ashigara, Japan

Signed and Sealed this

Ninth Day of March, 1993

*Attest:*

STEPHEN G. KUNIN

*Attesting Officer*

*Acting Commissioner of Patents and Trademarks*